US005102586A

United States Patent [19]

Fuji et al.

[11] Patent Number: 5,102,586

[45] Date of Patent: Apr. 7, 1992

[54] AGGLOMERATING PROCESS OF SINTER MIX AND APPARATUS THEREFOR

[75] Inventors: Norifumi Fuji; Shunji Iyama; Shoji Nitta; Kazuo Hosomi; Takumi Fukagawa; Hiroaki Ishikawa, all of Okayama; Yukio Konishi, Chiba, all of Japan

[73] Assignee: Kawasaki Steel Corporation, Japan

[21] Appl. No.: 425,749

[22] Filed: Oct. 23, 1989

[30] Foreign Application Priority Data

| | | | |
|---|---|---|---|
| Oct. 27, 1988 | [JP] | Japan | 63-269416 |
| Dec. 7, 1988 | [JP] | Japan | 63-307737 |
| Dec. 27, 1988 | [JP] | Japan | 63-327851 |
| Dec. 27, 1988 | [JP] | Japan | 63-327852 |
| Dec. 27, 1988 | [JP] | Japan | 63-327854 |
| Jan. 26, 1989 | [JP] | Japan | 1-15127 |
| Jan. 31, 1989 | [JP] | Japan | 1-21781 |
| Feb. 21, 1989 | [JP] | Japan | 1-39233 |
| Feb. 28, 1989 | [JP] | Japan | 1-45158 |
| Jun. 23, 1989 | [JP] | Japan | 1-159755 |
| Aug. 31, 1989 | [JP] | Japan | 1-223042 |

[51] Int. Cl.[5] ..... B29B 9/08; B29C 67/02

[52] U.S. Cl. ..... 264/40.1; 23/313 R; 75/770; 75/773; 264/40.7; 264/69; 264/117; 425/140; 425/145; 425/150; 425/204; 425/205; 425/222

[58] Field of Search ..... 264/69, 117, 40.1, 40.7, 264/56; 75/770, 773; 23/313 R; 425/222, 456, 201, 204, 205, 209, 140, 145, 150

[56] References Cited

U.S. PATENT DOCUMENTS

| | | | |
|---|---|---|---|
| 3,649,248 | 3/1972 | Ishimitsu et al. | 23/313 R |
| 3,900,293 | 8/1975 | Sjoberg et al. | 264/117 |
| 4,183,738 | 1/1980 | Carmon | 23/313 R |
| 4,277,253 | 7/1981 | Walter et al. | 23/313 R |

FOREIGN PATENT DOCUMENTS

| | | | |
|---|---|---|---|
| 56-51012 | 12/1981 | Japan | 264/117 |
| 1009503 | 4/1983 | U.S.S.R. | 264/69 |
| 1386667 | 4/1988 | U.S.S.R. | 75/770 |

OTHER PUBLICATIONS

Chemical Engineers' Handbook, Perry and Chilton, 5th ed., pp. 8-29 to 8-30.

*Primary Examiner*—Mary Lynn Theisen
*Attorney, Agent, or Firm*—Dvorak and Traub

[57] ABSTRACT

An agglomerating process and an apparatus therefor for preparation of sinter mix having the basis of kneading with vibration to make raw feed in capillary state and then agglomerating the kneaded material with tumbling vibration. By using the particular process, apparatus and various kinds of raw feeds, sintering characteristics of the product shows superiority in size distribution, permeability, strength, and activities, resulting cost, power and material consumptions of the process are remarkably improved.

26 Claims, 67 Drawing Sheets vibrating intensity : 5G
inner diameter : 250mm
Number of troughs : 5

AGGLOMERATING PROCESS OF SINTER MIX AND APPARATUS THEREFOR

BACKGROUND OF THE INVENTION

1. Field of the Invention

The present invention relates to an agglomerating process and an apparatus therefor of iron ore sinter mix to be supplied to a Dwight-Lloyd continuous sintering machine, and in particular, to the technology of the steps in which the raw feed for sintering preparation is mixed and kneaded with vibrating media and then agglomerated by tumbling.

2. Description of the Conventional Technology

According to the conventional technology, the raw feed for sintering preparation (fine powdery stone, limestone, fine coke, quicklime, and fine return cake, etc.) contained in the storage bins for blending of the raw feed is supplied at desired quantities by a constant feeder situated at the lower portion of the storage bins onto a belt conveyor, heaping multilayers. The raw feed is added with water to make water content of 5 to 7 weight % and is blended and agglomerated into sinter mix in a drum mixer. The sinter mix is transferred to a sinter supply hopper and is charged onto pallets of the sintering machine through a drum feeder and a sinter supply chute, respectively placed on the lower part of the hopper. Then, fine coke in the sinter mix is ignited by an ignition burner and sintering operation proceeds.

In the case above, fine powdery iron ore having particles of grain size less than 63 μm (undersize particle screened by the minimum sieve defined in Japanese Industrial Standard Z8801) of more than 60 weight % is also used.

There are troubles in the conventional sintering process. That is, when fine powdery iron ore of more than 10 weight % is contaied in the sinter mix, permeability through the sintering bed is prohibited and the sintering productivity decreases. It is accordingly necessary to add much binders (quicklime, slaked lime and the like) in the sinter mix to improve permeability, increasing cost of binders.

In order to solve the shortcomings above of the conventional art, the fine powdery iron ore of about 60 weight % and the nuclei composed of fine return cake or iron ore of about 40 weight % are previously agglomerated in a drum mixer or disc pelletizer, the agglomerated material is blended with the other raw feed for sintering preparation, and the blend is charged to the drum mixer to be mixed and agglomerated.

The nuclei agglomeration or granulation method of fine powdery iron ore is described in "The Journal of The Iron and Steel Institute of Japan", vol. 71, No. 10 (1985), entitled "Granulation of sinter feed and its role in sintering." In this case, it is necessary to use nuclei and therefore the required capacity of the mixer must be 1.4 times of that of the ordinary mixer as the same fine powdery iron composition, disadvantageously rising the cost of installation.

According to other granulation method, a fine iron ore of up to about 40 weight % is blended with 60 weight % of ordinary iron ore raw feed and the blend is supplied to the disc pelletizer, in which the blend is agglomerated into green pellets of 5 to 10 mm in diameter. Then fine powdery coke is added to cover outer surfaces of the green pellets, and the covered pellets are transferred to the sinter supply hopper for sintering. The conventional method above is described in "The Journal of The Iron and Steel Institute of Japan", vol. 73, No. 11 (1987), entitled "Fundamental Investigation on Production Conditions of New Iron Ore Agglomerates for Blast Furnace Burdens and Evaluation of Their Properties."

According to the shortcomings of the conventional method above, the bulk density of a green ball is low and the crushing strength of the ball is low, so that the ball is friable in the course of transferring to the sintering bed, inhibiting the permeability of the sintering bed. It is disadvantageously necessary that the mean grain size of the green pellets must be so large as 8 to 10 mm and the pellets must be covered with carbon. When the outer-clad coke does not be adhered uniformly to the outer surfaces of the green pellets, the inner portion of the balls may not melt and the balls may disassemble to a single pellet or become to fine return cakes in the crushing stage of the sintered products.

According to the other conventional agglomerating method using a wet grinding mixer described in Japanese Patent publication Sho 43(1968)-6256, the raw feed for sintering preparation is ground, controlled in water content, mixed in the wet grinding mixer such as a ball mill or a rod mill, then the blend is agglomerated into green pellets through a vertical-type, or cylindrical-type, or other agglomerator.

According to the conventional agglomerating method above, a step of dry or wet grinding operation and another step of water-controlling mixing operation are done in a rotating rod mill or a ball mill. The installation is relatively too large to the yield, necessisating vast power consumption and too much expenses.

SUMMARY OF THE INVENTION

An object of the present invention is to produce strong green mini-pellets of the desired grain size range of 2 to 10 mm at high productivity.

Another object of the present invention is to agglomerate a fine powdery iron ore including more than 60 weight % of grain size less than 63 μm as well as a fine ore difficult to properly agglomerate.

A further object of the present invention is to provide an agglomerating method in which the sinter mix having improved permeability through the sinter layer of the sintering bed is produced.

Still further object of the present invention is to provide a method and an apparatus to obtain superior sinter mix in size and reduction characteristics at low cost by controlling raw materials, additives, operating conditions or producing and blending systems.

According to the present invention, the agglomerating method for preparing sinter mix to be supplied to a Dwight-Lloyd continuous sintering machine provides two stages. The first stage of the agglomerating method comprises the steps of containing a number of media for mixing and kneading in a vessel, of applying a vibrating intensity of circular motion of 3 G to 10 G (G designates the acceleration of gravity) to the vessel in order to revolve the media, of supplying the raw feed for sintering preparation and water which are added to the aerospaces in the vibrating-revolving media for mixing and kneading to mix and knead the raw feed in order to produce capillary state agglomerating charge for the following agglomerating stage. The second stage of the present invention comprises the steps of applying a vibrating intensity of not less than 3 G to the capillary state agglomerating charge to tumble, and, of agglomerating the charge into strong and rigid green mini-pellets.

The agglomerating apparatus for suitably carrying out the process of the present invention comprises a serial assembly of a vibrating kneader provided with a vibrating generator for giving tumbling motion to the media for mixing and kneading of the raw feed held among the media, and a vibrating agglomerator for applying vibrating motion to the agglomerating charges fed from the vibrating kneader.

After the second stage of the present invention, it is possible to add a third stage so as to prepare measurement and feed back control system, or to adhere the additives of one or more kinds selected from the group consisting of coke, limestone, silica and dolomite on the surfaces of the agglomerated mini-pellets.

BRIEF DESCRIPTION OF THE DRAWING

FIG. 12(*b*) is a section along line B—B of FIG. 11.

PREFERRED EMBODIMENTS OF THE PRESENT INVENTION

(1) Embodiments of First and Second stages

First, the basic principle of the present invention will be described.

The inventive method of the present invention of agglomerating process comprises two stages. In the first stage, a strong circular vibrating intensity is applied to a lot of media contained in a cylindrical vessel so as to let them revolve. The media are of circular sectional rods for mixing and kneading raw feed of fine iron ore for sintering preparation. When raw feed for sintering preparation is charged to the vessel, a cooperative action of compacting, shearing, tumbling, pressing, kneading, and mixing by the vibrating-revolving media is applied to these particles of the raw feed among the media in order to let water in the particles of the raw feed exude out and extend uniformly over the surfaces of the particles. As a result, the particles are made of capillary state and adhered to each other becoming plastic condition.

The process or mechanism mentioned above will be described with reference to FIG. 16.

Figures 16, 16A:
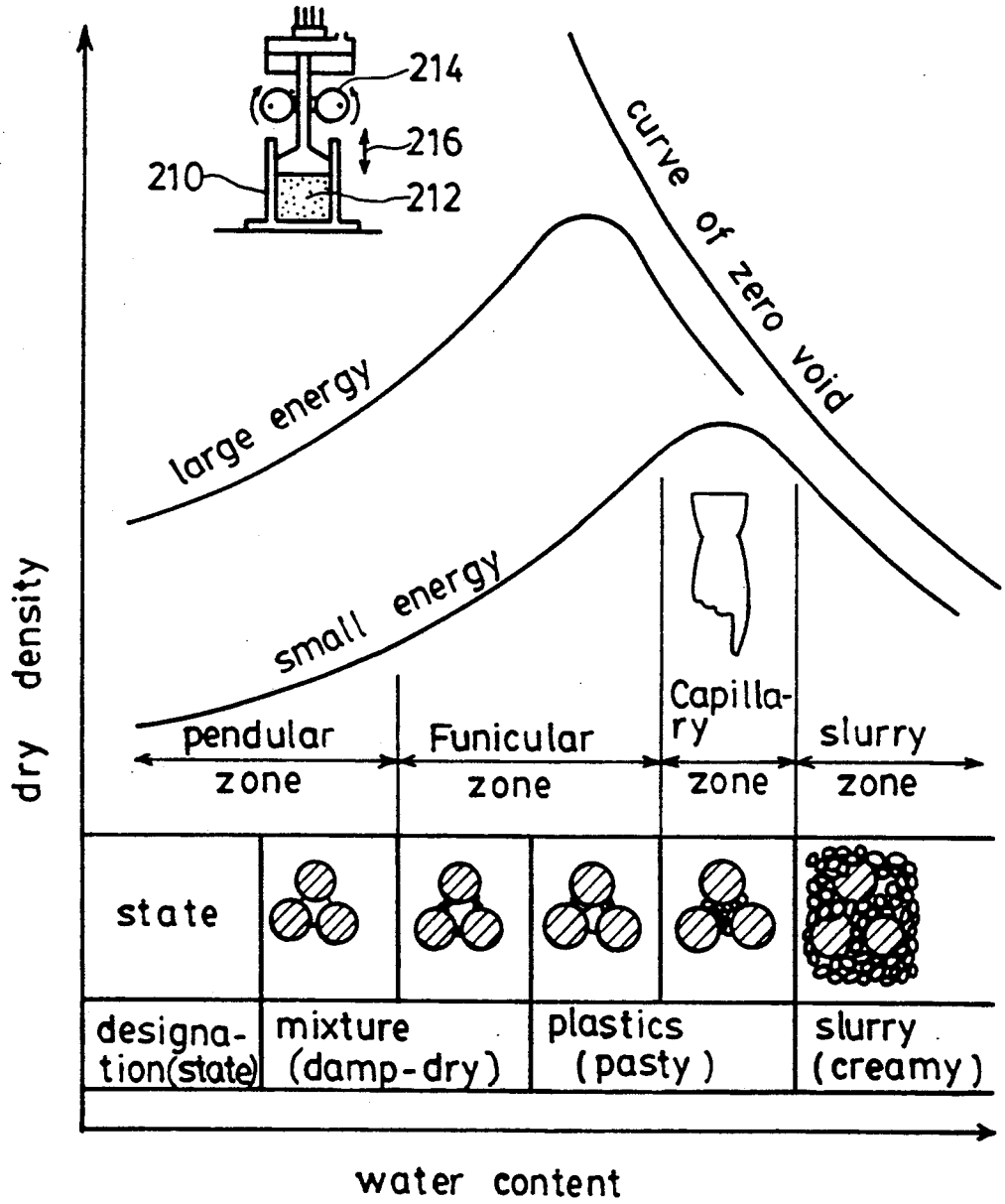
FIG. 16 is an explanatory view for the principle according to the present invention.

As shown in FIG. 16(*a*), it is known that, when a powder 212 having a certain water content is filled in a compression cylinder 210 and applied by a vibrating compression 216 by a vibrator 214, a bulk density of the powder 212 in the cylinder 210 would increase. The density and the features of the powder 212 vary according to the particular water content of the particles of the powder and the lever of vibrating power or energy to be applied to the particles, and resultantly the density thereof increases corresponding to the filling or compacting condition of the fine particles.

As is shown in FIG. 16(*b*), when the water content of the powder is low, spaced containing air are existed among fine particles and the fine particles are in dried and dispersed condition. Increasing the water content of the fine powder and vibrating the powder, water spreads uniformly over the surfaces of particles disappearing any air spaces or air layers inn the powder. As a result, whole particles become pasty and sticky plastic condition and a dry bulk density of the fine powder approaches to the voidless density curve.

When the water content further increases, the condition of the powder becomes of muddy slurry condition. The plastic condition which has a water content lower than that of the slurry condition and has least air spaces or air layers is called a capillary state. The powder in the capillary state has the highest dry bulk density and solid plastic condition. The powder in the capillary state can be obtained by giving the most suitable water content corresponding to the particular condition of powdery particles and applying a vibrational compression of a suitable energy to the powder.

The present invention relates to an agglomerating process of sinter mix and to an apparatus therefor, in which the raw feed is mixed and kneaded with vibration obtaining a powder of capillary state and then the powder is agglomerated by tumbling with vibration.

Consequently, it is noted that, in the first stage of the present invention, the most suitable water content and the most suitable vibrating intensity selected according to the characteristics of the fine powdery raw feed for sintering preparation are applied to the feed in order to disperse water drops on the particle surfaces uniformly in a form of thin water membrane, to decrease the void among particles and to produce material for agglomerating charge in the capillary state.

The optimum water content varies 5 to 7% for mixing and kneading whole raw feed having wide grain size range, and 9 to 12% for dealing with only fine powder raw feed having fine grain size and large surface area.

Accordingly, in the mixing and kneading stage, water amount to be added is determined by considering the difference between the optimum value and that contained in the raw feed.

Figure 17:
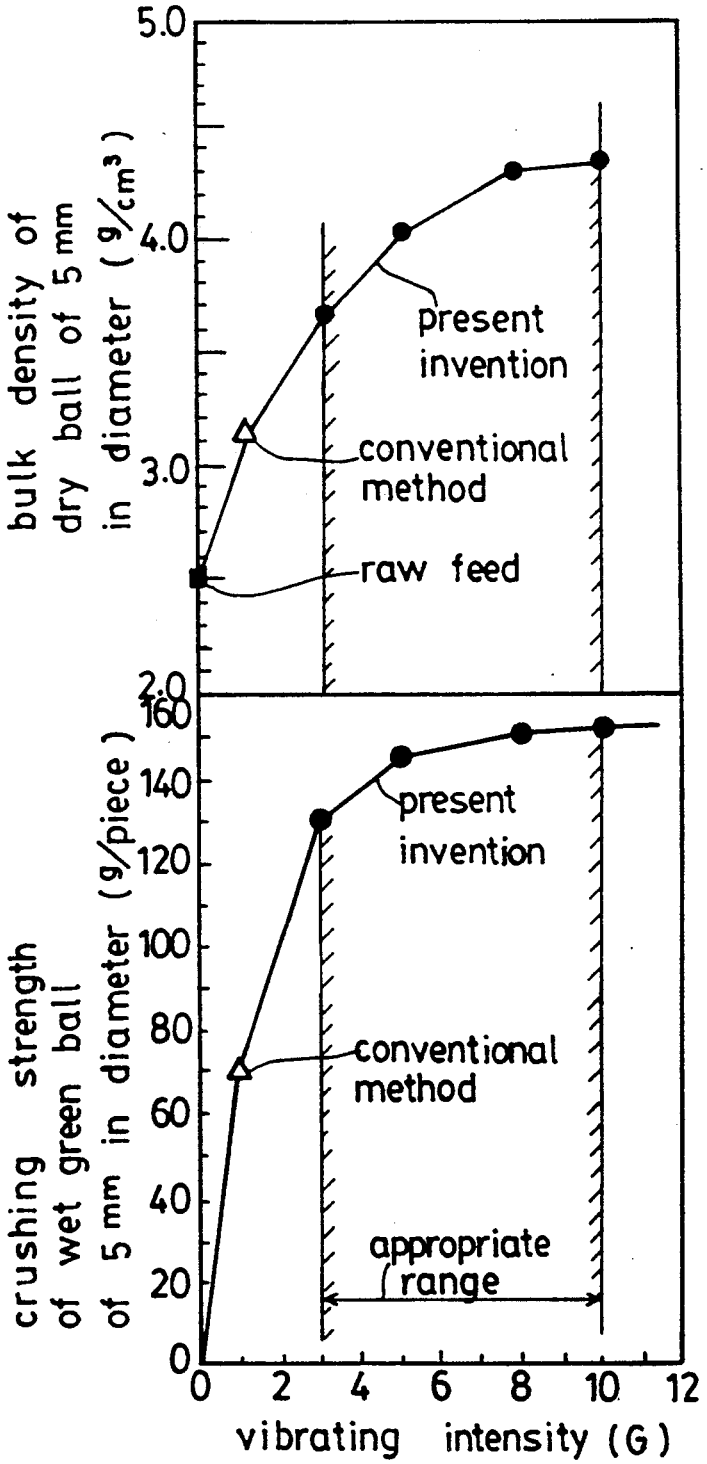
FIG. 17 is an explanatory of limeted range of the vibrating intensity the vibrating kneader.

Next, FIG. 17 depicts the bulk density and the crushing strength of the agglomerated ball when the vibration intersity of the mixing and kneading changes. Other bulk density and crushing strength of comparative agglomerate according to the conventional process are also shown in FIG. 17.

The bulk density of the raw feed before being agglomerated is 2.5 g/cm$^3$ and the bulk density of dried agglomerates pelletized with a disc pelletizer was 3.1 g/cm$^3$. On the other hand, according to the preferred embodiment of the present invention, the bulk density of the agglomerate was 3.6 to 4.4 g/cm$^3$ corresponding to the vibration intensity, which shows very high density.

Contrary to about 70 g/piece of the crushing strength of the agglomerate (wet ball) formed by means of the conventional disc pelletizer, the crushing strength was very high such as about 130 to 150 g/piece according to the vibration intensity in the preferred embodiment of the present invention.

FIG. 17 shows that, when the vibrating intensity of the kneader is less than 3 G, the effect of mixing and kneading agglomerating is small, and when the vibrating intensity exceeds 10 G the effect is saturated. Resultantly, it is understood that the suitable range of the vibrating intensity to be applied to the kneader above is from 3 G to 10 G.

Figure 19:
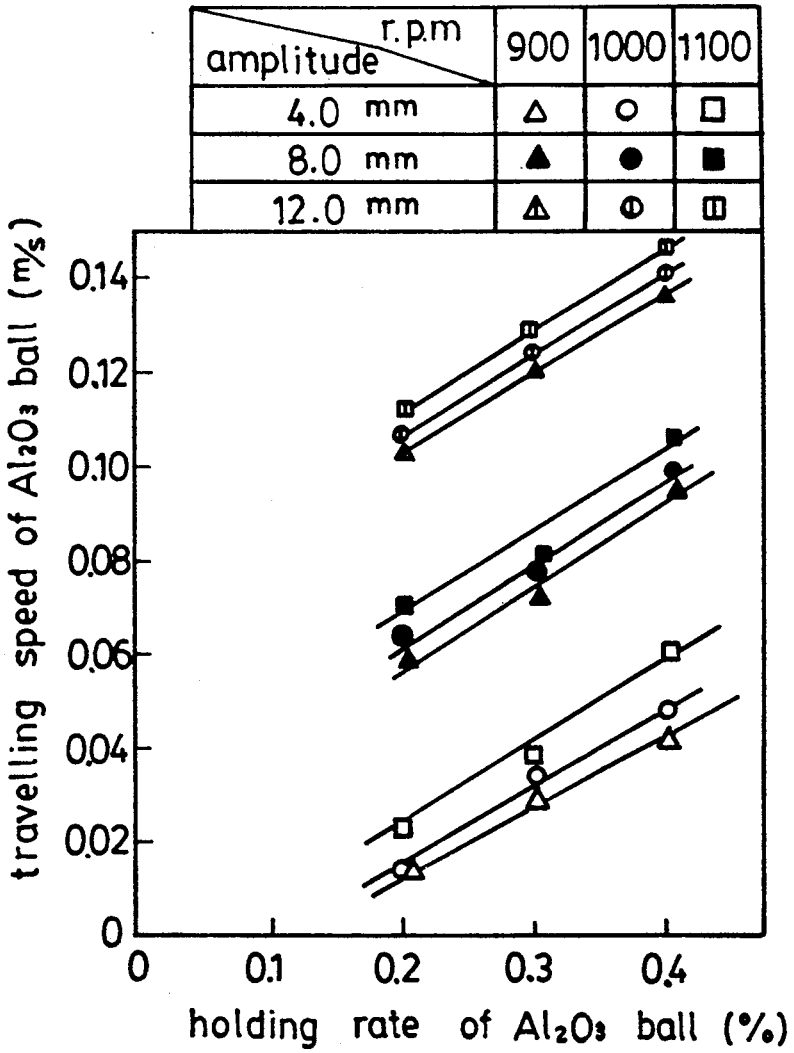
FIG. 19 is an experimental data of the vibrating kneader using $Al_2O_3$ balls of a graph showing a relation between holding rate of the balls inside the kneader and ball travelling speed.

FIG. 19 shows an experimental results of change in ball travelling speed, in which experimental balls of $Al_2O_3$ are charged into the drum of the vibrating kneader according to the present invention in place of rods, and an amplitude and a frequency of vibration of the vibrating kneader and a holding rate of balls inside the kneader respectively are changed variously. It is understood that the greater the holding rate increases and the larger the vibration amplitude becomes, the more the ball travelling speed increases.

The word "holding rate"$\pi$refers to a ratio between a bulk volume of material contained in a vessel and whole inner volume of the vessel.

This shows that, when a large productivity in the vibrating kneader is required, it is more preferable to make the vibration amplitude lager than to select the larger frequency, because the larger vibration amplitude makes the travelling speed of the material contained in the kneader effectively higher.

Figure 20:
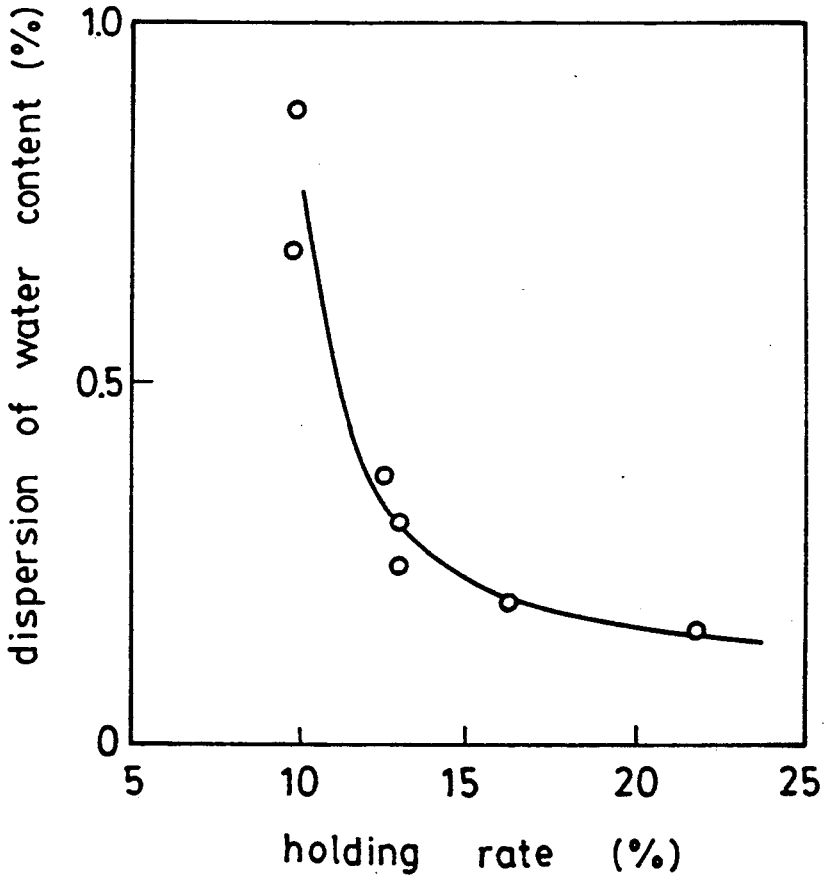
FIG. 20 is a graph of a relation between the holding rate of the media and dispersion of water content after kneading.

FIG. 20 shows the relation between a holding rate of media in the kneader and dispersion of water content of the kneaded material. Taking Kudremukh mine ore for example, the water dispersion decreases as the holding rate exceeds 13% and the dispersion becomes saturated at a constant value as the holding rate reaches 20% or 23%. In order to keep the holding rate at high, it is disadvantageously necessary to increase the capacity of the vibrator, then the upper limit of the holding rate is determined practically up to 50%.

Consequently, the holding rate of 20% to 50% is the most preferable when operating the kneader in the range of 3 G to 10 G of the vibration intensity in the kneading stage.

During the sequential agglomerating stage, a strong circular or horizontal vibration is applied to the kneaded material which is fed from the kneading stage so that the bulk density of the raw material increases and water exudes on the surface of the particles of the raw material. As a result, due to the watery surface of the particles of the raw material, adjacent particles were adhered to each other, growing the particle size.

Figure 18:
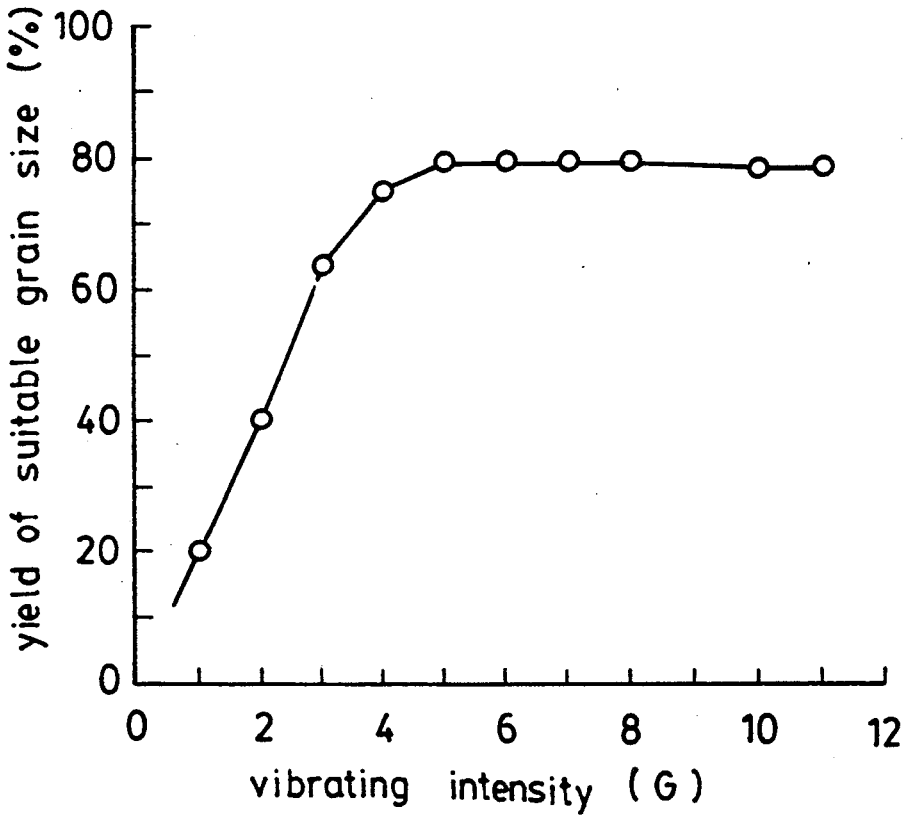
FIG. 18 is an explanatory of limited range of the vibrating intensity of the agglomerator.

FIG. 18 shows a relation between the vibrating intensity of the agglomerator and the yield of agglomerates having the most suitable grain size of 2 to 5 mm. It is preferable to tumble and agglomerate the raw feed by using the vibrating intensity of not less than 3 G. It is consequently said that the vibrating intensity of not less than 3g is necessary to agglomerate the raw feed for sintering preparation when the yield of suitable grain size of more than 60 weight % is a target. Such tendency is also seen when the grain size is 2 to 10 mm.

It is explicit that the present invention enables to agglomerate strong green mini-pellets from the raw feed of only fine powdery iron ore containing grain size less than 63 μm of more than 60 weight %.

Reference to productivity of the vibrating agglomerator, the production rate Q is shown by the next equation.

$$Q = (\pi/4) \cdot D^2 \cdot \phi \cdot \gamma \cdot Vp \cdot n \quad \text{(a)}$$

$$Vp = f(\alpha, \beta, \mu) \frac{\pi^2 \cdot N^2 \cdot S}{900} \quad \text{(b)}$$

wherein,

D: drum diameter
$\alpha$: trough slant angle
$\phi$: holding rate of raw material
$\beta$: angle of repose of raw material
$\gamma$: bulk density of raw material
$\mu$: coefficient of friction
Vp: raw material travelling speed
N: frequency of vibration
n: number of drums
S: amplitude When $\phi$, $\gamma$, Vp are made constant, the following equation is obtained.

$$Q = K \cdot D^2 \cdot n \quad \text{(c)}$$

It was found that when the diameter of the drum D increases, some troubles arise.

According to the experiments of operation of the vibrating agglomerator, the drums having diameters of 250 mm and 300 mm show excellent performance in agglomerating. However, when the diameter of the drum is 340 mm, some caked particles of the raw material starts to be generated in the drum. When the diameter of the drum is up to 450 mm, the situation is worsen and much caked clusters are generated in the drum and it is very difficult to agglomerate the raw material in good condition.

Consequently, it is necessary to install an agglomerating drum of a diameter less than 450 mm in the agglomerator, preferably it is less than 340 mm. While, considering the situation from the productivity for agglomeration, decreasing the diameter of the drums results in decreasing the production rate. Consequently it is proposable to combine a plurality of agglomerating drums of the small diameter and operate than at the same time.

As a result, the agglomerating appratus of one of preferred embodiment according to the present invention has a plurality of agglomerating troughs in a drum. The toughs are applied circular vibrating motions from the drum compulsorily.

The apparatus of the present invention provides a vibrating kneader for the raw feed to be mixed and kneaded to capillary state, and a vibrating agglomerator, which are arranged in series after the kneader. By suitably controlling the water content and vibrating intensity in the first kneading stage and the second agglomerating stage, the agglomerating method of the present invention can be preferably carried out.

Embodiment of the apparatus according to the present invention will be described in detail.

Figure 1:
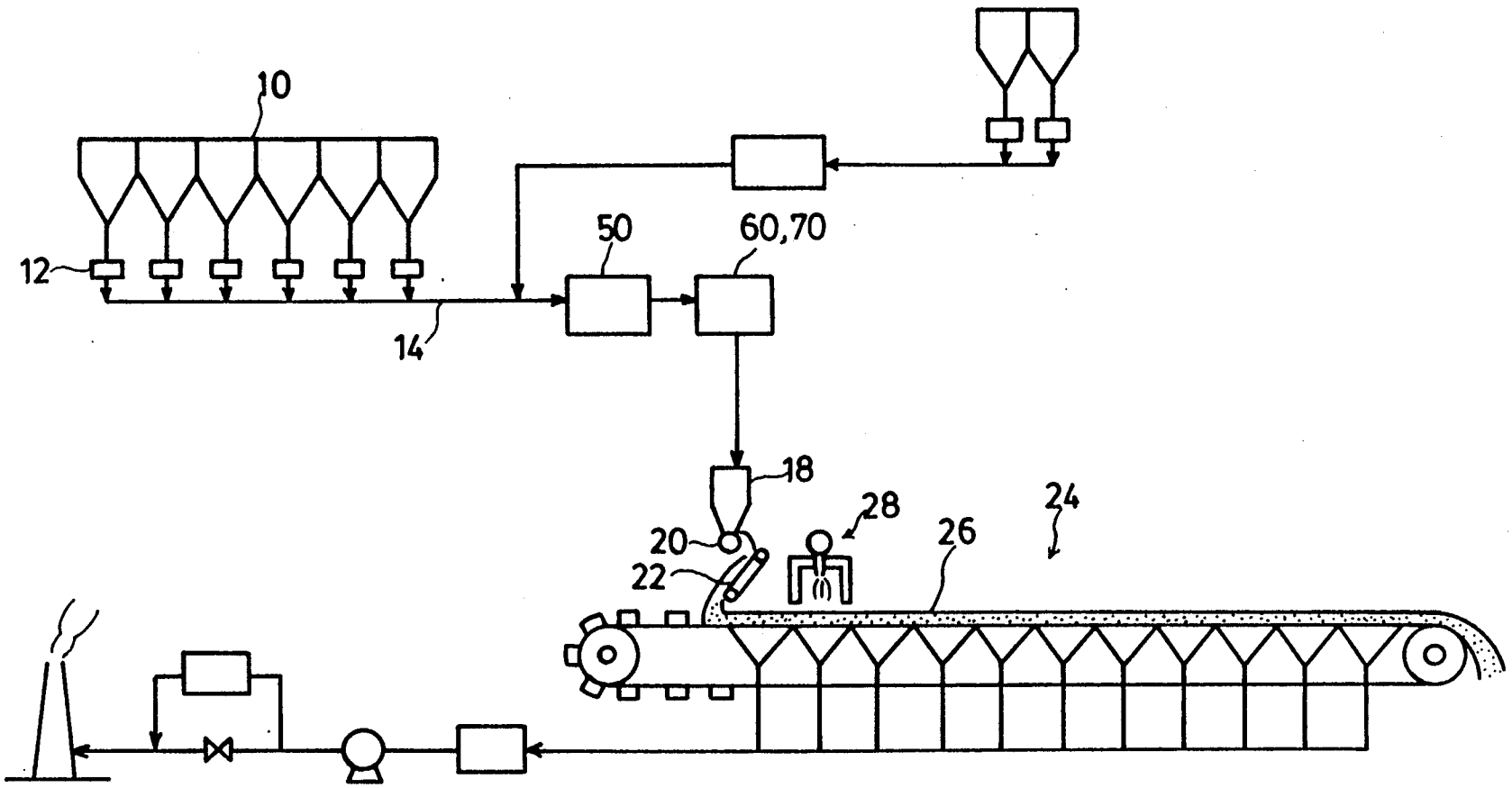
FIG. 1 shows the whole view of the sintering process according to the present invention.

First, as shown in FIG. 1, a set of distribution bins 10, respectively contain raw materials for sintering preparation, such as fine return cake, limestone, coke, fine iron ore. The fine iron ore and various raw materials in the bins 10 are discharged by constant feeders 12 situated at the lower portions of the bins 10, then these materials respectively are laid on a belt conveyor 14 and conveyed. The materials are sent to a vibrating kneader 50 of the present invention in which the raw feed is mixed and kneaded with vibrating media. The kneaded material for sintering preparation is conveyed from the vibrating kneader 50 to an agglomerator 60 or 70 of the present invention in order to produce green mini-pellet of 2 to 5 mmin size.

Figure 2:
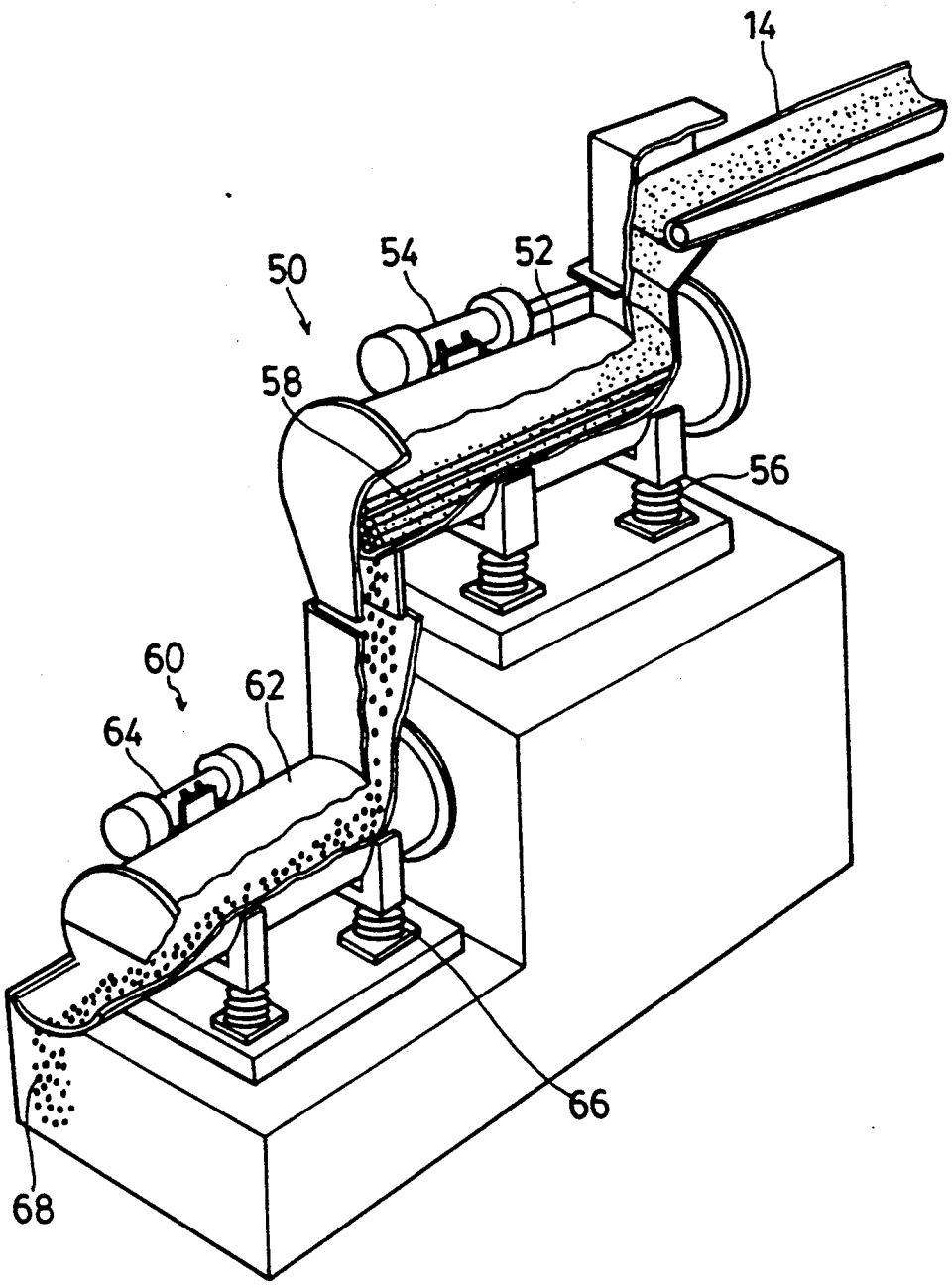
FIG. 2 is a part-broken perspective view of an embodiment apparatus of the present invention.
Figure 3:
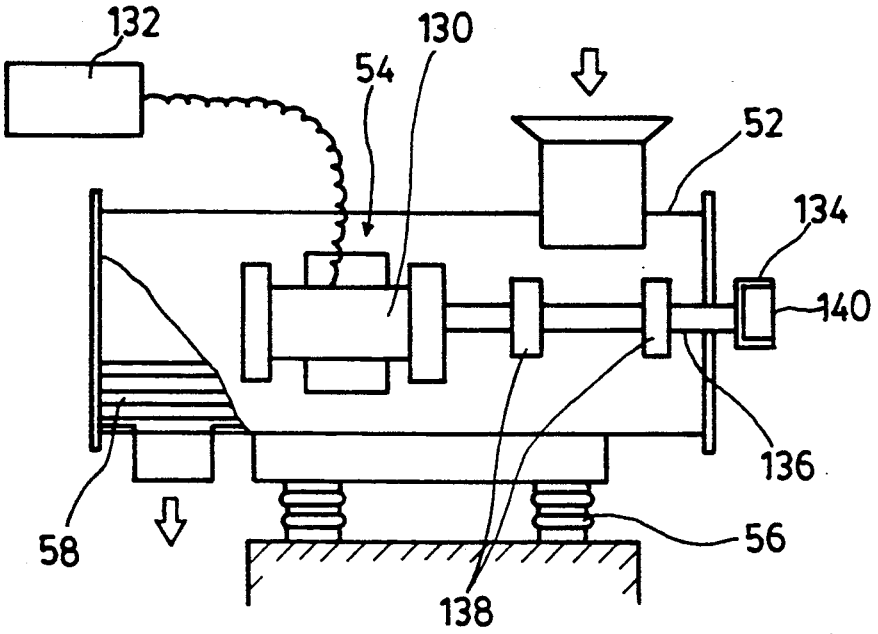
FIG. 3 is an explanatory side view of the vibrating kneader according to the present invention.

FIG. 2 is a perspective view of a preferred apparatus for carrying out suitably the agglomerating process according to the present invention. One embodiment of the vibrating kneader 50 is explained with reference to FIGS. 3 and 4, respectively showing a side view and a sectional view of the vibrating kneader. This vibrating kneader 50 has a drum 52 of a shape of drum or cylinder which contains media composed of a lot of rods to be used for mixing and kneading of the raw feed. A pair of vibrators 54 are attached to both sides of the drum 52 and a whole structure of the vibrating kneader 50 is supported resiliently on spring mounts 56.

Figure 4:
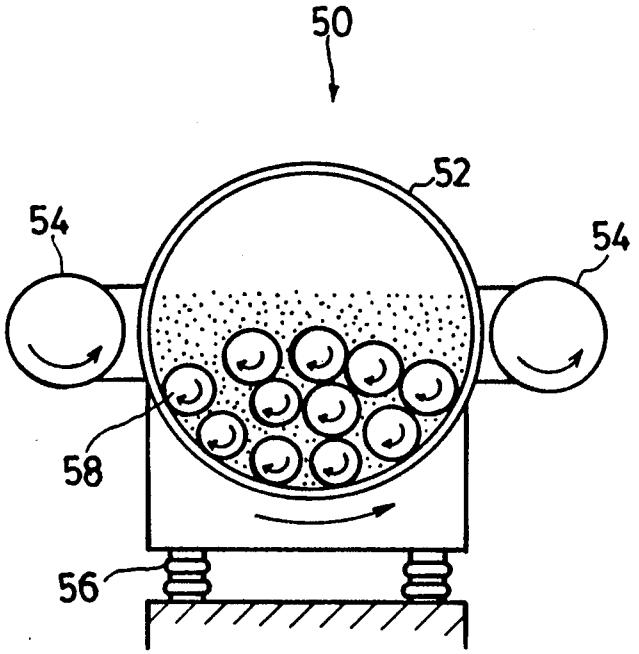
FIG. 4 is a cross-section of vibrating kneader shown in FIG. 2.

The two vibrators 54 are functionally connected each other and attached to the drum 52 at its sides as shown apparently in FIG. 4 so as to rotate synchronously in a balanced condition. A vibration motor or vibromotor 130 of the vibrator 54 rotate changeably in speed by a frequency converter 132. The vibrator 54 enables to apply circular vibrative motions of the acceleration varied in a wide range to the drum 52 and the media therein for mixing and kneading of the raw feed cooperated with the operation of the spring mounts 56. The timing belt 134 synchronizes one of vibromotors 130 with another one. The reference numerals 138 is a bearing and 140 is a pulley.

An embodiment of a vibrating agglomerator using vibrating intensity in circular motion will be described.

Figure 5:
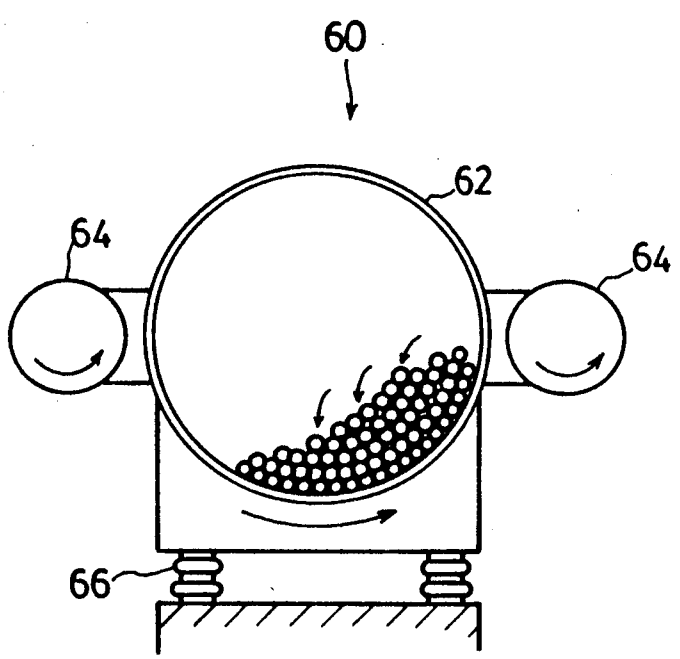
FIG. 5 is a transverse sectional view of the vibrating agglomerator of FIG. 2.

FIG. 5 depicts a cross sectional view of the vibrating agglometator 60 shown in FIG. 2 having a cylindrical drum as an agglomerating part.

Figure 6:
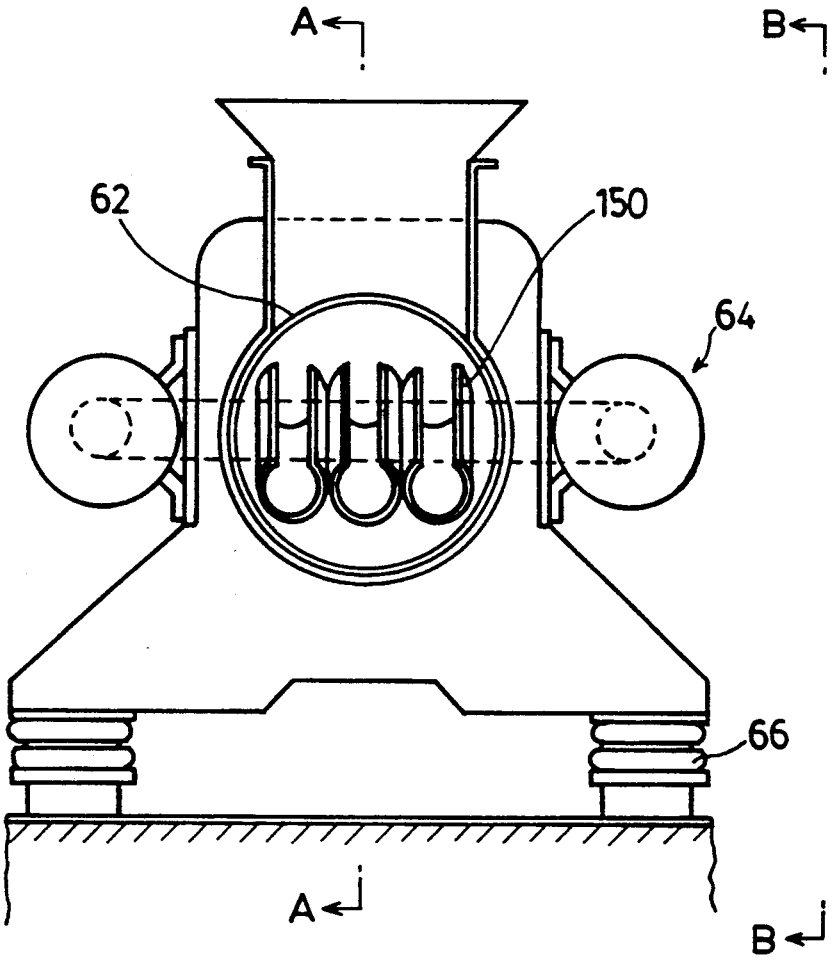
FIG. 6 is an explanatory front view of a circular vibrating agglomerator according to the present invention.
Figure 7:
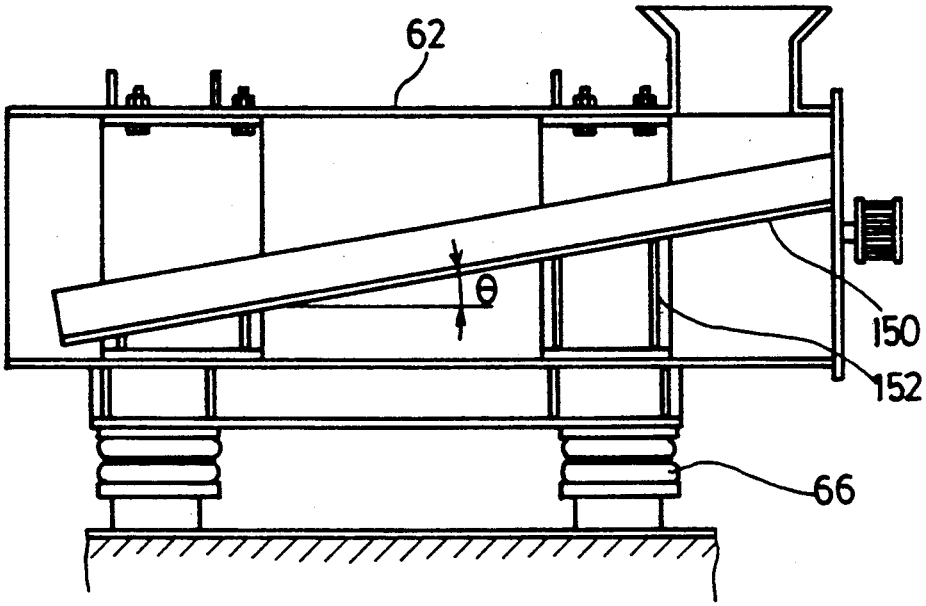
FIG. 7 is a sectional view taken along the arrow A—A of FIG. 6.
Figure 8:
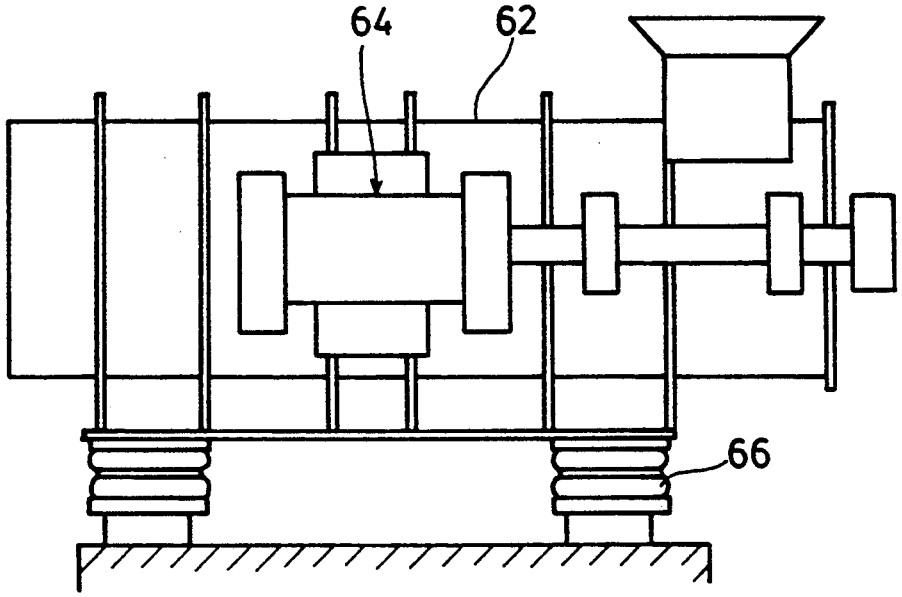
FIG. 8 is a side view taken along the arrow B—B of FIG. 6.

FIGS. 6 to 8 show an embodiment of the agglomerator according to the present invention with agglomerating troughs as an agglomerating part. FIG. 6 is a front view of the agglomerator 60, FIG. 7 is a sectional view taken along the line A—A, and FIG. 8 is a view seen from the arrow B—B.

The drum 62 has three agglomerating troughs 150 of a circular section which are installed fixedly therein so as to slant downwardly at their front ends through a supporting bracket 152 at a slant angle of $\theta$. Vibrating force of the vibrator 64 is transferred to the agglomerating troughs 150, so that the raw feed for sintering preparation (the kneaded material from the kneader) receives compulsorily the circular motion through the agglomerating troughs 150. The kneaded material tumbles and proceeds along the troughs 150 and consequently these particles are gradually agglomerated. The vibration driving mechanism for the vibrator 64 is the same as that of the vibrating kneader.

Figure 9:
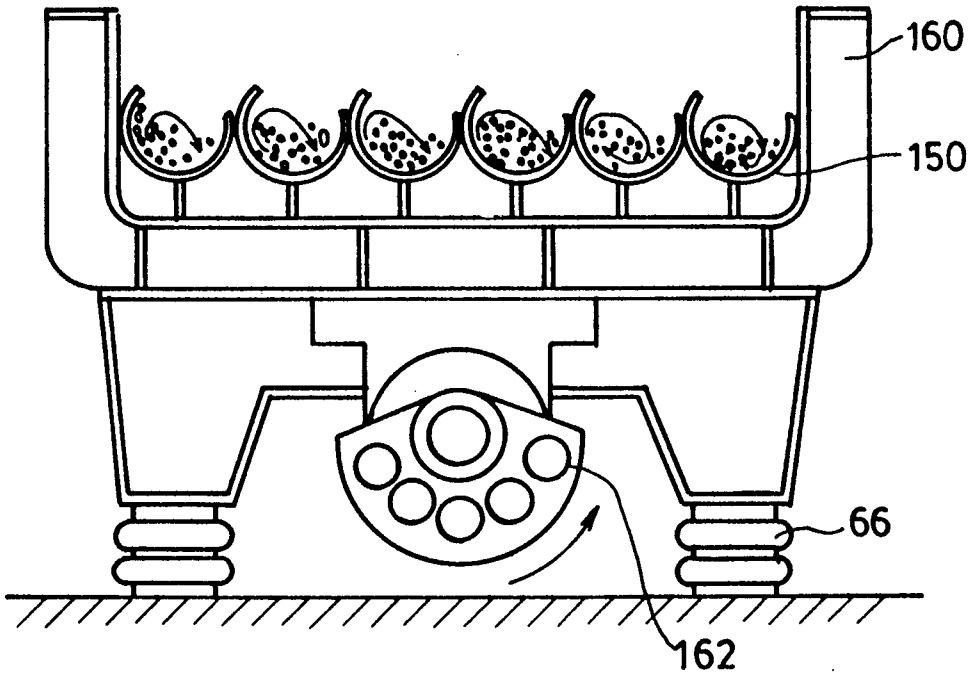
FIG. 9 is a frontal sectional view of another embodiment of the present invention.
Figure 10:
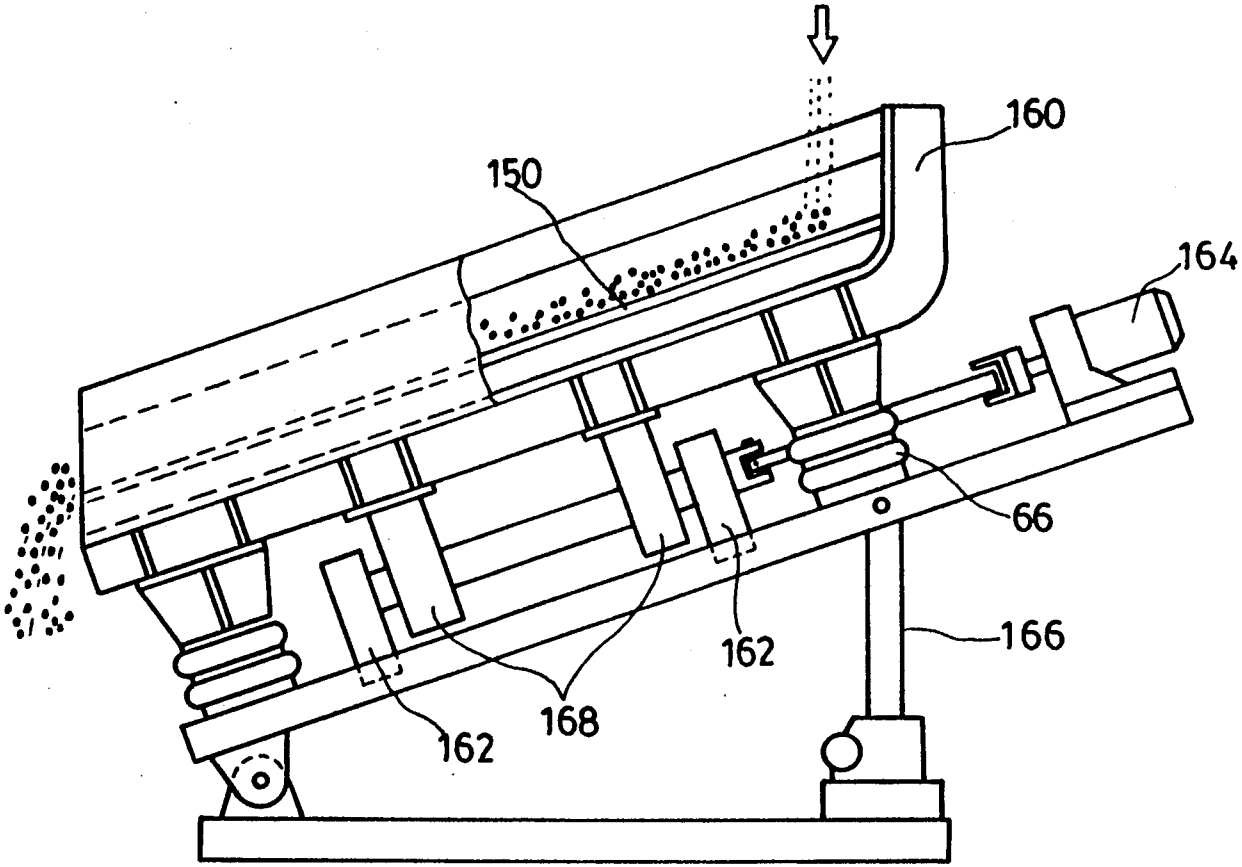
FIG. 10 is a side elevational view of FIG. 9.

FIGS. 9 and 10 show another embodiment of the vibrating agglomerator which is provided with a set of square-shaped agglomerators 150 in place of the drum-shaped agglomerators 150 in the previous embodiment. FIG. 9 depict a front sectional view of the vibrating agglomerator and FIG. 10 shows a side view thereof.

These troughs 150 are installed in a trough holder 160 and the agglomerator itself is fixed to a machine frame through spring mountings 66 so as to change the slant angle of the trough holder 160.

The trough holder 160 has a set of bearings 168 as shown in FIG. 10 in detail and shaft provided with a set of unbalanced weights 162 passes through the bearings 168. The shaft has a motor 164 at its front end. Driving the motor 164 rotates unbalanced weights 162, so that circular vibrating motion of the unbalanced weights 162 is transferred to the trough holder 160.

The productive capacity Q of a single trough 150 of the agglomerator of the present invention is calculated by the equation $$Q=(\pi/4)\cdot D_1^2\cdot\phi_1\cdot\gamma\cdot Vp$$

wherein, $D_1$: inner diamete of the pipe (m)

$\phi_1$: holding rate of material in the trough $\gamma$: bulk density of raw material ($t/m^3$)

Vp: transfer speed of raw material (m/h)

Figure 21:
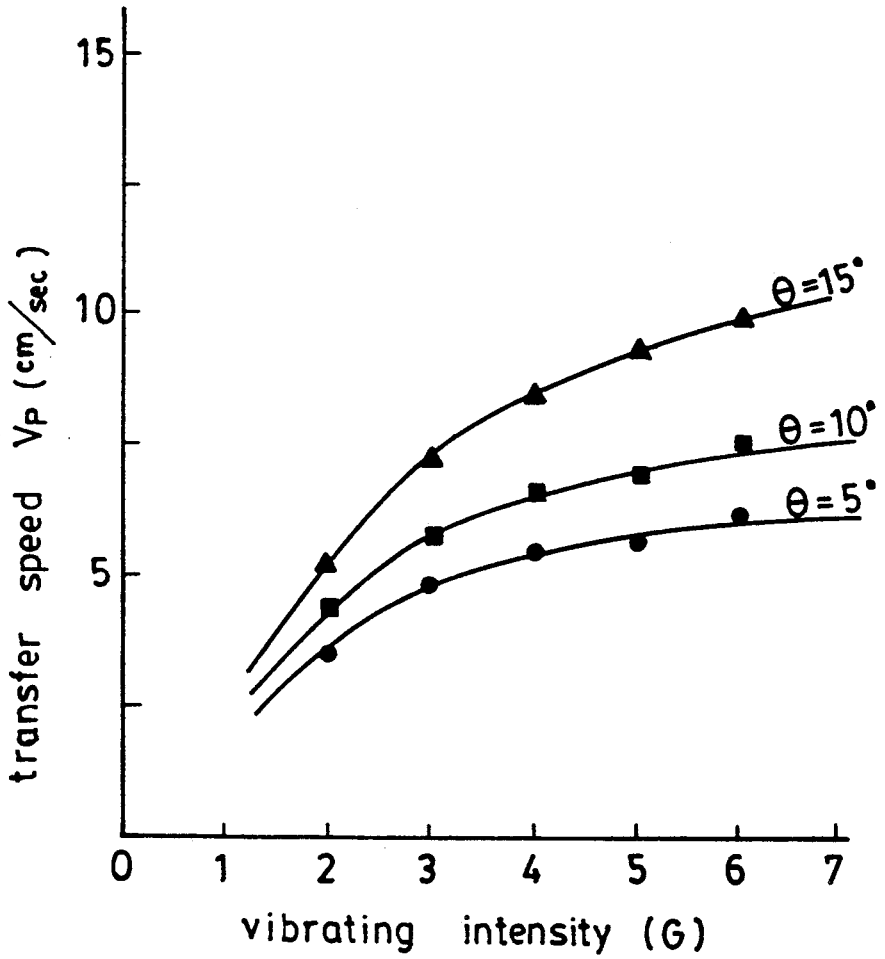
FIG. 21 is a graph of a relation between the vibrating instensity and the transfer speed.

The transfer speed VP of raw material changes according to vibration frequency and amplitude of the trough holder, and a slant angle of the troughs. The change of the transfer speed relative to various slant angles of the trough is shown in FIG. 21. The vibration intensity (acceleration) $\alpha$ is shown by the following equation.

$$\alpha=0.55\times10^{-3}\cdot N^2\cdot S$$

wherein, N: rpm S: amplitude (m)

The desired agglomerating capacity can be attained by selecting and the necessary number of troughs and installing them paralled within the trough holder. For example, supposing holding rate: 0.4 inner diameter of the trough: 0.3 m frequency of vibration: 1200 rpm amplitude: 8 mm=0.008 m The following is expressed.

$$\alpha=0.55\times10^{-3}\times12000^2\times0.008=6.3$$

The following equation is obtained from FIG. 21.

$$Vp \approx 15\ \text{cm/sec} = 540\ \text{m/h}$$

$$Q = (\pi/4)\times(0.3)^2\times0.4\times1.8\times540 = 27\ \text{t/h per though}$$

Required number of troughs $=120/27\approx5$

Consequently, when five troughs of 300 mm in diameter are installed in the trough holder and then slant angle is set at 10 degrees, the desired productive capacity of agglomerator is attained.

Figure 11:
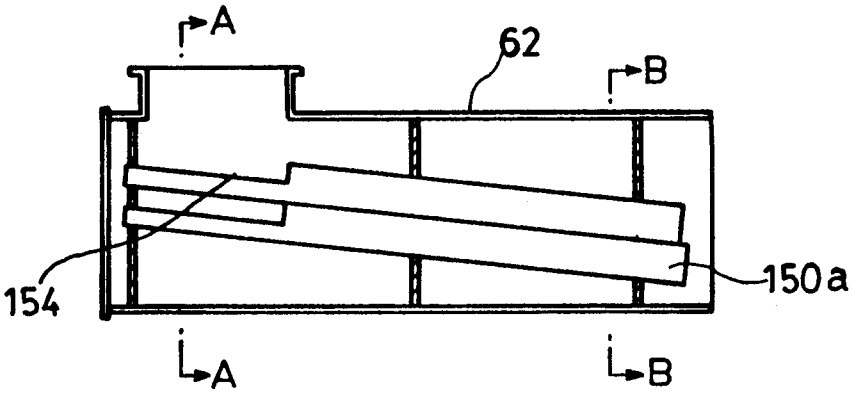
FIG. 11 is an explanatory view of the embodiment shown in FIG. 7.
Figure 12A:
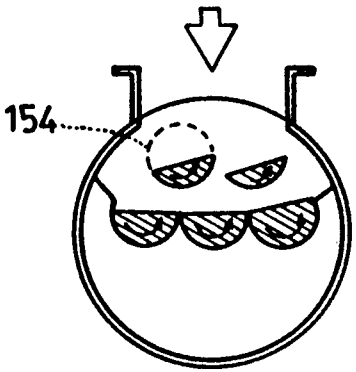
FIG. 12 is an explanatory view of agglomerating behavior of the particles in the agglomerator shown in FIG. 11, FIG. 12(*a*) is a section along line A—A of FIG. 11.
Figure 12B:
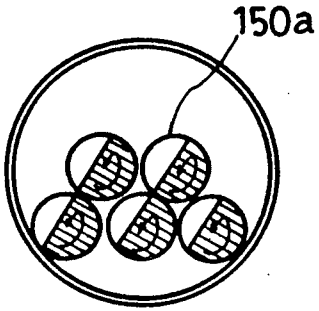

FIG. 11 is a side sectional view of the drum 62 which is another embodiment of the trough 150 shown in FIG. 7. And FIG. 12(*a*) and (*b*) illustrate respectively arrow A—A and B—B of the drum 62.

According to the embodiment of the present invention, the troughs 150*a* are of circular sections and have cut-off portions 154 for charging raw material therethrough, the portions of which are placed directly below the raw material charging port.

Next, an embodiment using horizontal oscillating vibration will be explained hereafter.

Figure 13:
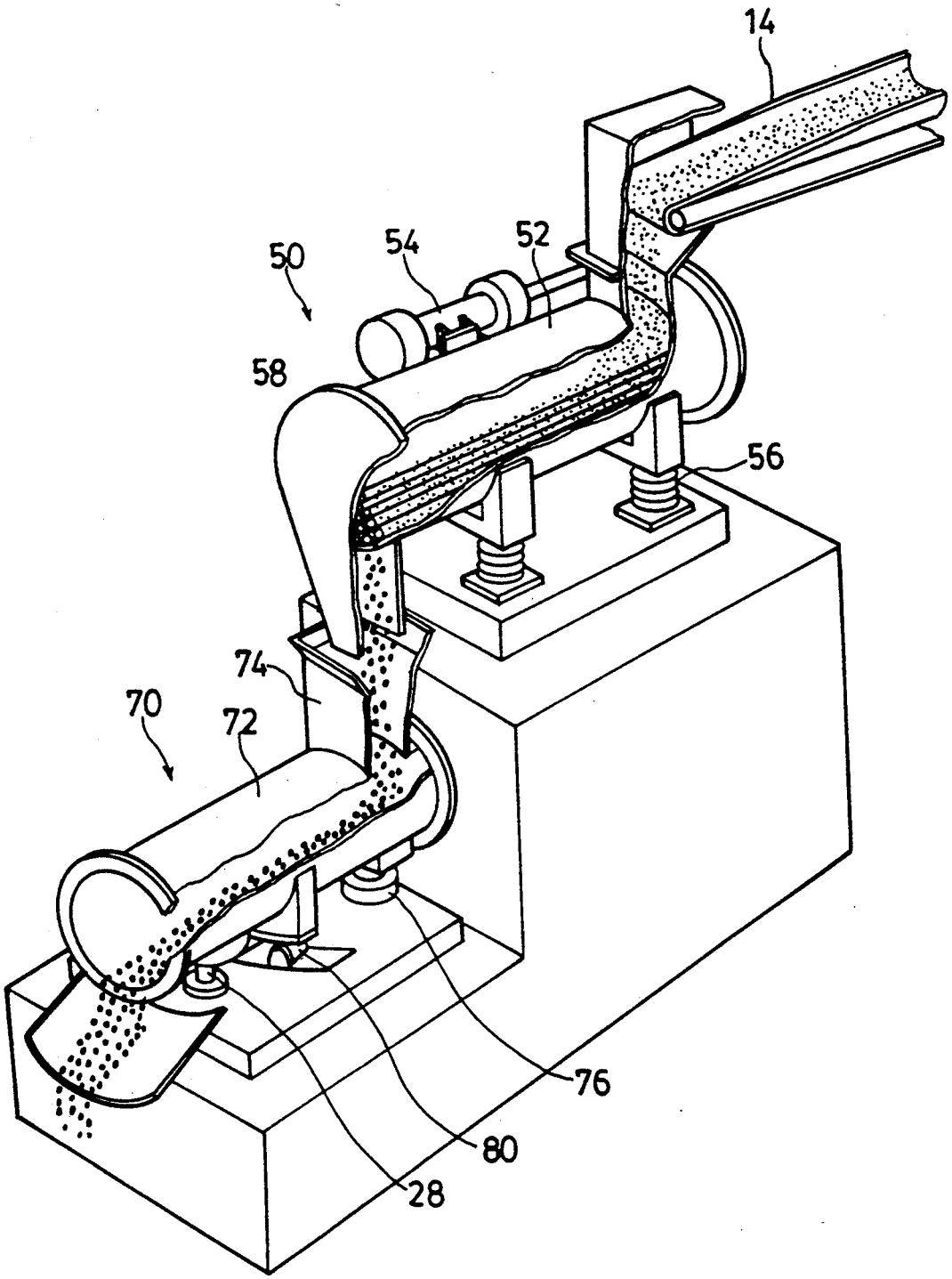
FIG. 13 is a part-broken perspective view of an embodiment including the horizontal vibrating agglomerator according to the present invention, FIG. 14(*a*) is an explanatory side view of the vibrating agglomerator shown in FIG. 13, FIG. 14(*b*) is an arrow B—B view, FIG. 14(*c*) is a view of an arrow C—C, FIG. 14(*d*) is a view of arrow D—D.
Figure 14A:
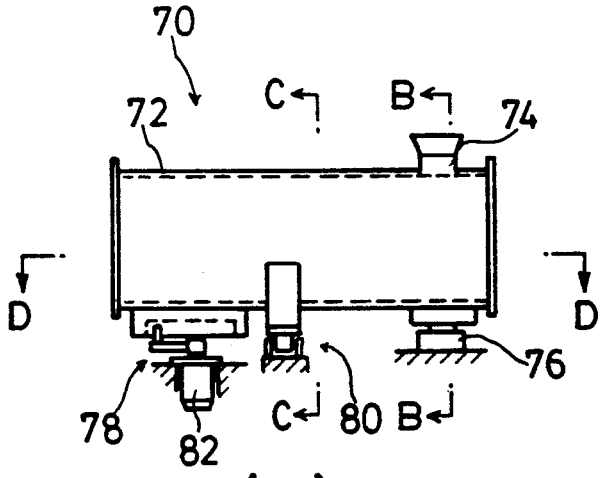
Figure 14B:
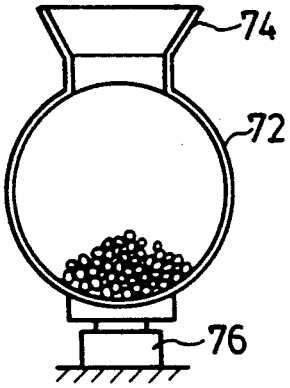
Figure 14C:
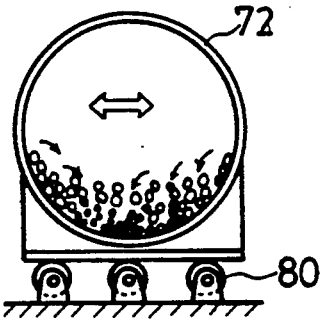
Figure 14D:
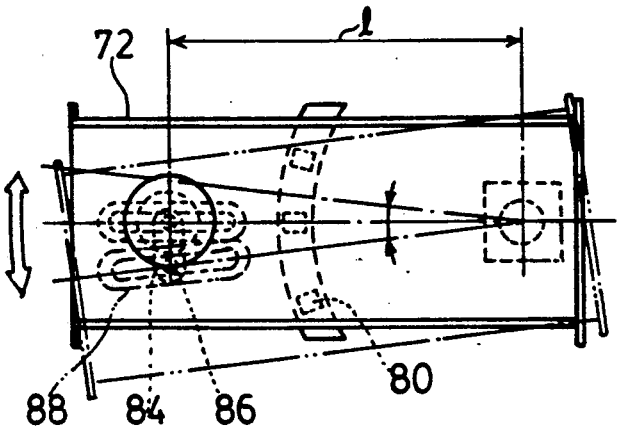

FIG. 13 shows still another embodiment employing a vibrating agglomerator 70 oscillating horizontally in place of the agglomerator 60 of FIG. 2. FIG. 14(*a*) depicts the whole structure of the vibrating agglomerator 70, FIG. 14(*b*) is a sectional view taken along the line B—B, FIG. 14(*c*) is a sectional view taken along the line C—C, and FIG. 14(*d*) is a sectional view taken along the line D—D.

The agglomerator 70 has a charging port 74 of raw material installed at the upper portion of one end of the drum 72 positioned horizontally. The pivot bearing 76 is placed on the lower end of the drum 72 so as to coincide with the center line of the charging port 74. A turning drive apparatus 78 placed on the lower end of another end of the drum 72 supports the weight of the drum 72 so as to slide horizontally freely through a set of guide rollers 80. Further the turning drive apparatus 78 has a link 84 attached to the output shaft of the motor 82 and a pin 86 of the link 84, which pin is guided through a groove 88 formed at the under surface of the drum 72 in a manner of free-rotation.

Figure 27:
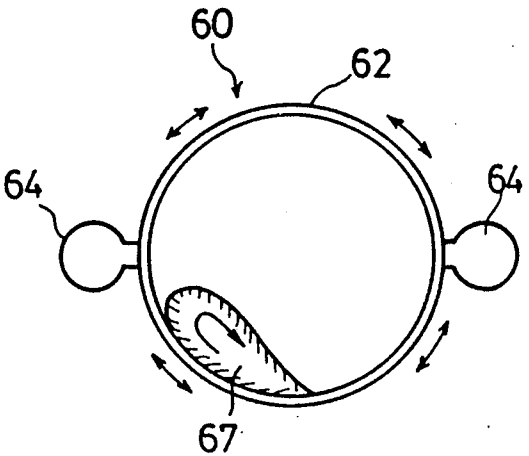
FIG. 27 shows the particle behavior explanation in the agglomerator according to the present invention.
Figure 27:
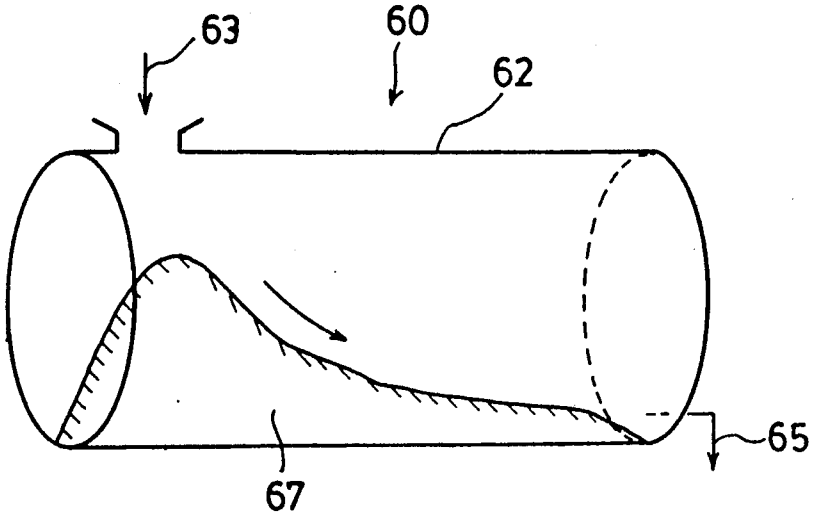

Meanwhile, a single drum vibrating agglomerator is schematically shown in FIG. 27.

In the agglomerating process as shown in FIG. 27, the agglomerating charge 67 for agglomerating mini-pellet is supplied to the horizontal cylindrical drum 62 through the supply port 63 after they are mixed and kneaded with vibration in the first stage, tumbled vibratingly by means of a pair of vibration generators 64, agglomerated, and finally discharged through the discharge port 65. When the supply feed rate amount of the raw feed decreases, the holding rate of the agglomerating charge 67 in the drum 62 decreases and the retention time extends, resulting in some enlargement of the agglomerated size.

When the vibrating intensity and water content increase, the grain size of the mini-pellets becomes large. The vibrating intensity of the vibration agglomerator can be controlled according to the vibration frequency of the vibrator 64.

The specifications of the vibrating kneader 50 and the vibrating agglomerator 60 or 70 of the embodiment will be shown below.

(1) kneader
drum: horizontal type cylindrical
vibration manner: circular
vibrating intensity: 3 G to 10 G
amplitude: stroke 5 mm to 20 mm
vibration frequency: 500 to 2000 rpm
rod volume: 10 to 50% of interior volume of the drum
rod diameter: 10 mm to 100 mm
retention time of powdery material: more than 20 sec (2) agglomerator
vibration manner: circular or horizontal oscillation
vibration intensity: not less than 3 G
amplitude: stroke 5 mm to 15 mm
vibration frequency: 500 to 1500 rpm
retention time of powdery material: more than 20 sec The relation between rpm of the motor and the vibration force F is expressed by the following equation (1).

$$F=(W/G)\cdot\omega^2\cdot x=W\cdot\alpha \quad (1)$$

Consequently, the vibrating acceleration or vibration intensity $\alpha$ is obtained through the following equation (2).

$$\begin{aligned}\alpha &= (\omega^2/G)\cdot x \\ &= (2\pi/60)^2\cdot N^2\cdot x/2000\,G \\ &= 5.48\times10^{-6}\times 1/9.8\times N^2\ x\end{aligned} \quad (2)$$

wherein,
F: vibration force (Kg)
W: weight of vibrator (Kg)
G: acceleration of gravity
$\omega$: angular velocity (rad/s)
x: full amplitude (mm)
N: number of revolution (rpm)

Figure 15:
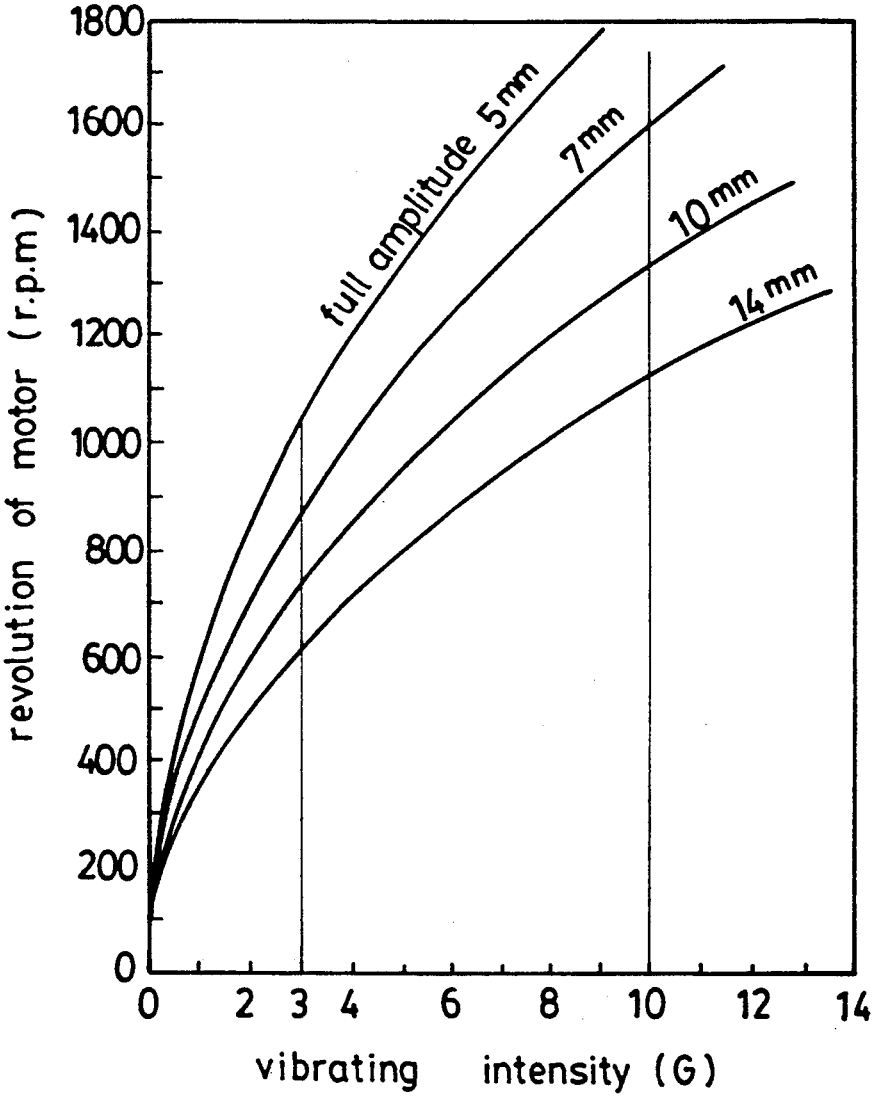
FIG. 15 is a graph showing a relation between the vibrating intensity and the revolution of a motor.

FIG. 15 is a graph showing a relation between the revolution of the motor and acceleration of the vibration. When the full amplitude of the drum of the vibration kneader is 7 mm and the revolution of the motor in the range of 900 to 1600 rpm, the suitable vibration acceleration mentioned above drops in the range of 3 G to 10 G. When the full amplitude of the drum of the vibration agglomerator is 7 mm and the revolution of the motor in the range of 900 to 1200 rpm, the suitable vibrating acceleration is not less than 3g. In order to change the full amplitude of the drum, the number of revolution can be selected so as to determine the suitable vibration acceleration.

Next, still another embodiment of the present invention will be explained in which a circular vibration is used in the second stage of the process of the present invention. It is of course that the functional effect of the apparatus using the circular vibration in the second stage is substantially identical to that of the previous apparatus using the horizontal oscillation vibration in the second stage.

The cylindrical drum of an inner diameter of 194 mm and a length of 494 mm (ratio of length and diameter is 2.5), having a containing capacity of 15 liters is supplied with a lot of steel bars of 30 mm in diameter so as to fill the drum at a holding rate of 25%. The raw feed for sintering preparation of 1.2 t/h is fed to the cylindrical drum, to which circular motion of an amplitude 7 mm and a vibrating intensity 6 G is applied in order to mix the raw material with the media of steel bars and knead them with vibration. The raw feed for sintering preparation is charged to other cylindrical drums of the same size and circular motion of an amplitude 7 mm and a vibration intensity 4 G is applied to the material, agglomerating it.

Figure 31:
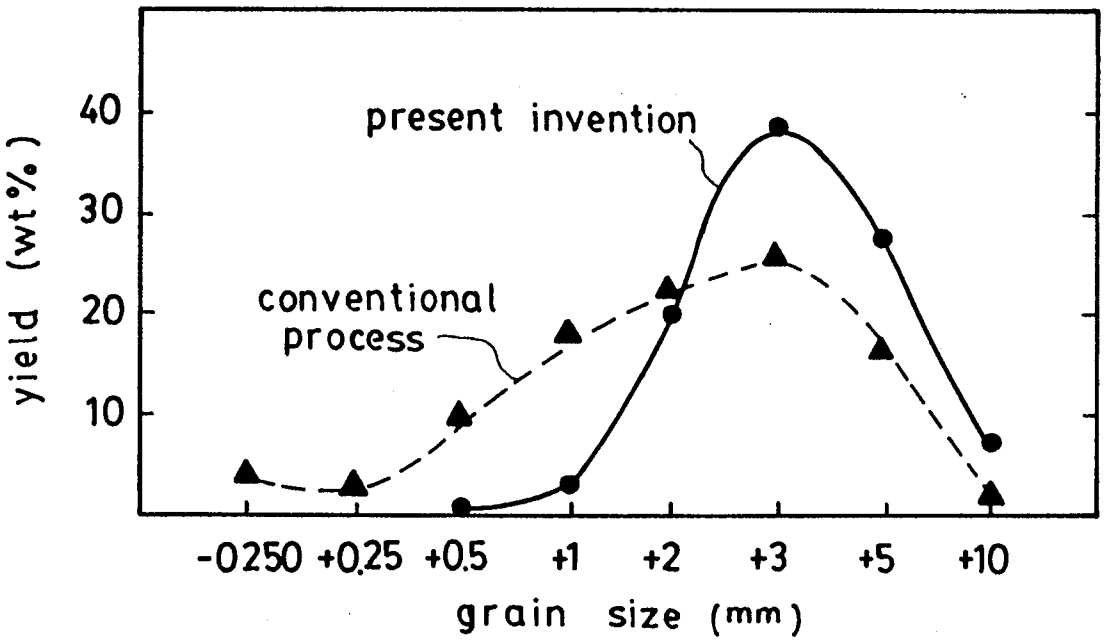
FIG. 31, 32 and 33 are graphs each showing the example of the grain size distribution of the present invention and the comparing conventional process.

FIG. 31 shows grain size distribution of the sinter product made by agglomerating all volume of raw feed for sintering preparation having an ordinary grain size distribution. FIG. 31 shows grain size distributions of the sinter product made by drum mixers with the same raw feed or material in order to compare the processes of the present invention and the conventional art. According to the embodiment of the present invention, the water content is 6.2 weight % and the total time of kneading and agglomerating is one minute. The comparable conventional process of a disc pelletizer has the water content of 6.5 weight % and the total time for pelletizing is five minutes. As shown in FIG. 31, the yield of the present invention has a peak on the grain size of 2 to 5 mm.

Figure 32:
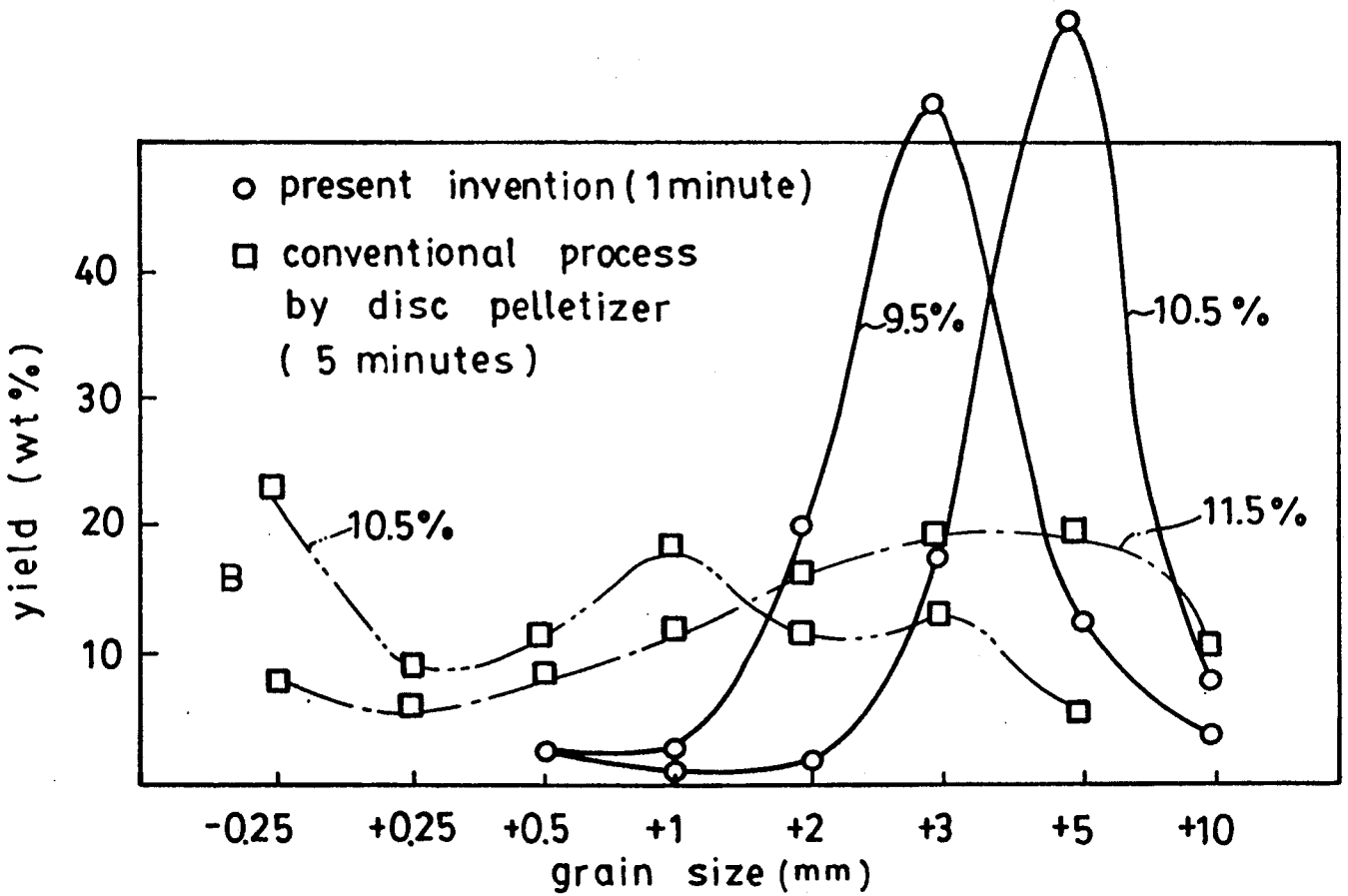

FIG. 32 shows the grain size distribution of the agglomeration which has been previously made of fine powder raw material (more than 90 weight % of particles of grain diameter of less than 125 $\mu$m) according to the condition of a kneading and agglomerating time of one minute, and the water content of 9.5 weight % and 10.5 weight % respectively.

In the drawing of FIG. 32, a product grain size distribution of the conventional process is made by a disc pelletizer of an agglomeration time of five minutes, the water content of 10.5 weight % and 11.5 weight %.

Figure 33:
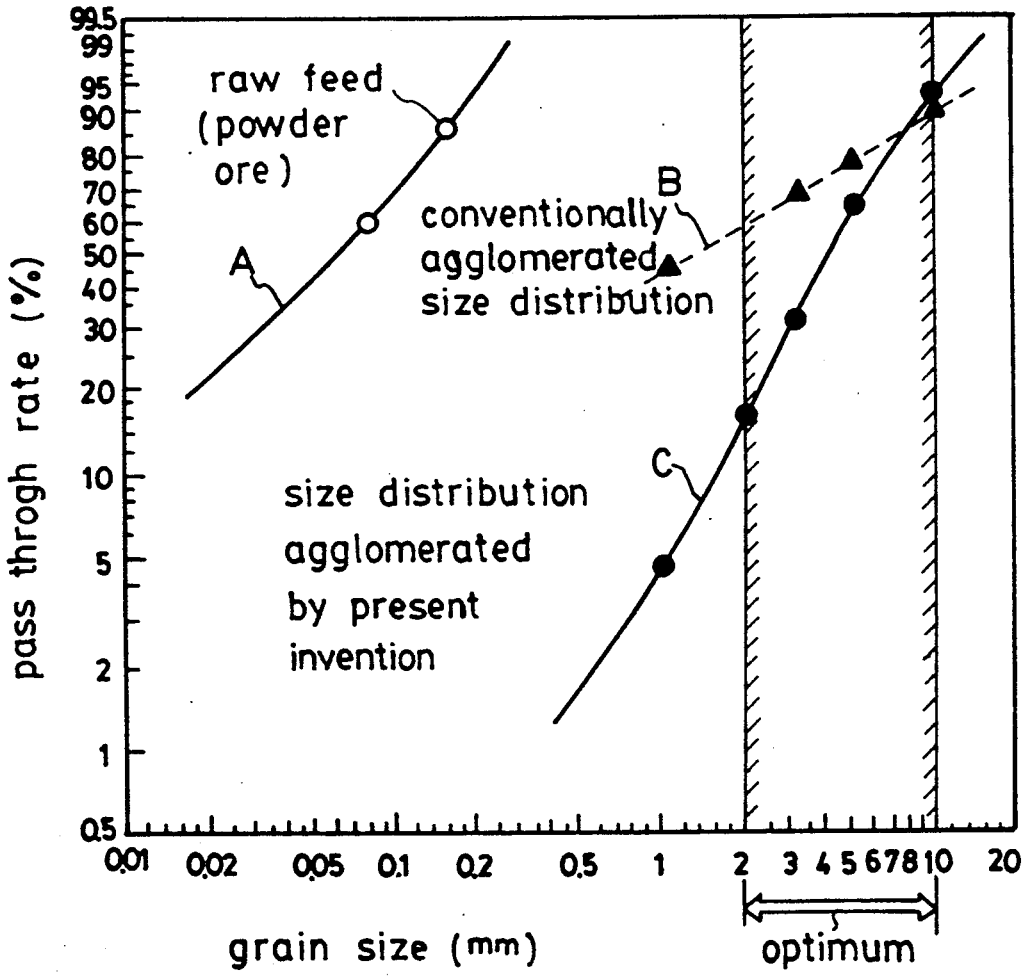

FIG. 33 shows a grain size distribution by the line B of the product of agglomeration made by a disc pelletizer, of the raw material having the initial or before-agglomeration grain size shown by the line A. The line C shows the result of the embodiment of the present invention.

FIG. 31 to 33 apparently depict that the process of the present invention enables to made produc of 2 to 5 mm of the grain size and good yield.

Figure 34:
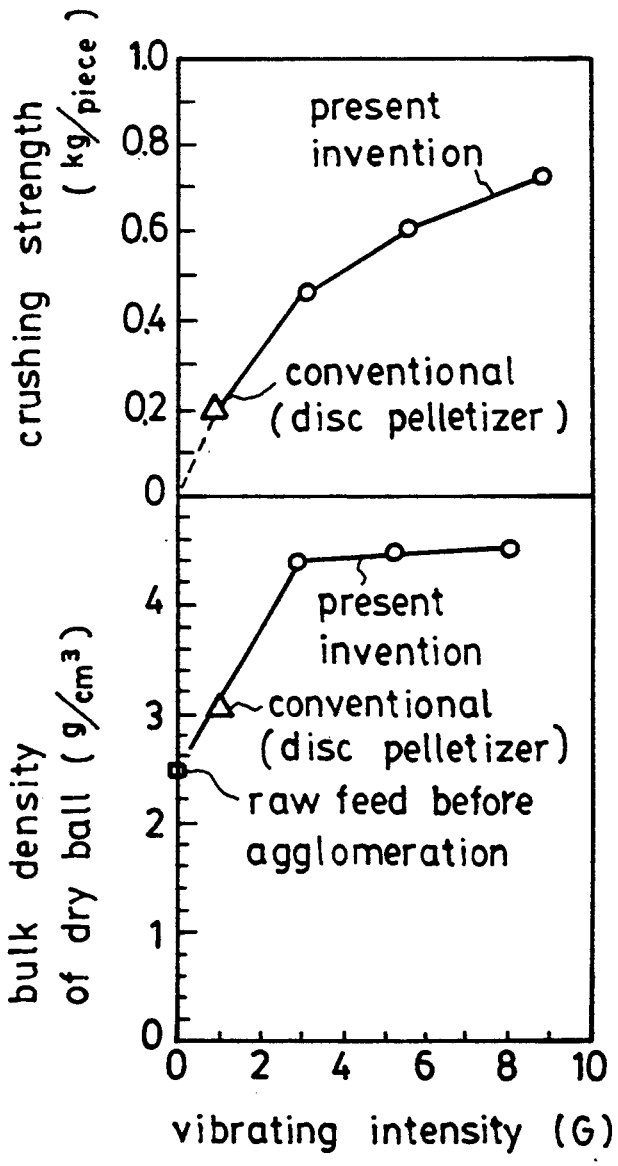
FIG. 34 is a graph showing the vibrating intensity of the vibrating kneader and crushing strength and the bulk density of the agglomerated green ball.

FIG. 34 shows the relation among the acceleration of vibration of the vibrating agglomerator and crushing strength as well as apparent specific weight of the product (grain size 5 mm). In order to compare, bulk density of pre-agglomation material or agglomerating charge and the crushing strength and apparent specific weight of the product made by a disc pelletizer. It is explicit that the vibration agglomerating process according to the present invention enables to obtain product having good characteristics.

Figure 35:
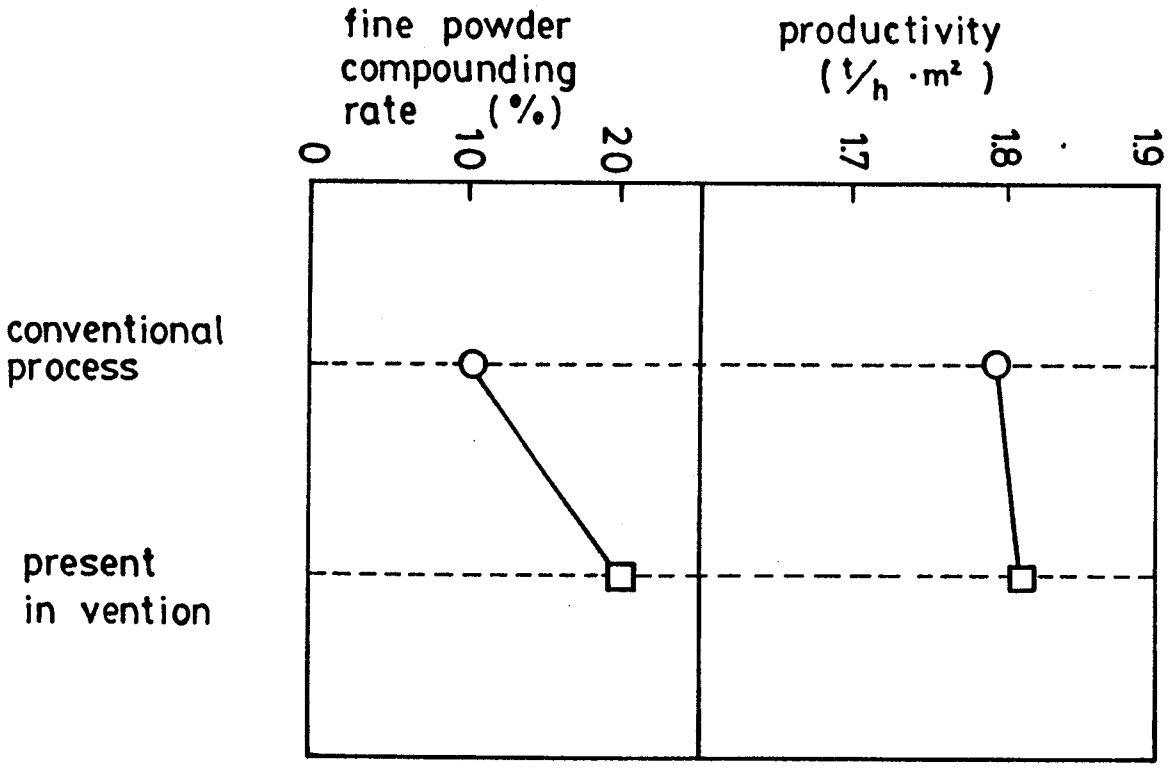
FIG. 35 is a graph showing the fine powdery iron ore compounding ratio and sitering productivity of the present invention and conventional art, FIG. 36(*a*), (*b*) show a vertical sectional view explanating the change of the holding rate due to the change of the slant angle of the vibrating agglomerator according to the present invention.

FIG. 35 shows the proportion of compounding and the production rate of the fine powdery ore according to the conventional drum mixer and the present invention. According to the present invention, it is apparent that the yield improves more than that of the conventional process even though fine powdery iron ore of 20 weight % is compounded in the raw feed for sintering preparation.

(2) An embodiment in which the holding rate of the raw feed in the cylindrical agglomerator is controlled by feed rate, slant angle and/or vibrating intensity.

Figure 37:
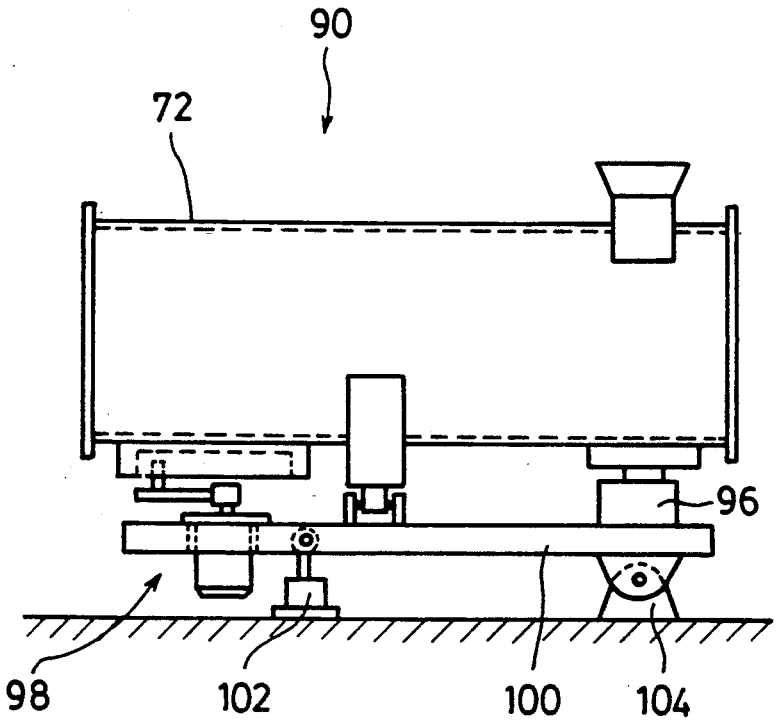
FIG. 37 is a side elevational view of an embodiment of the vibrating agglomerator carrying out suitably the present inventive process.
Figure 38:
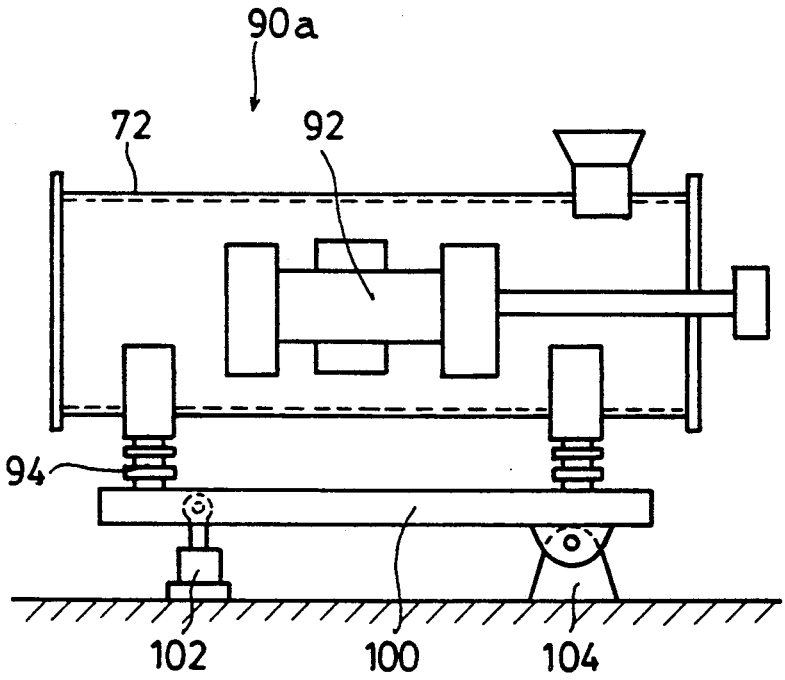
FIG. 38 is a side view of an embodiment of another vibrating agglomerator for suitably carrying out the present inventive method.

As shown in FIGS. 1 and 2, the raw feed for sintering preparation is quantitatively distributed through the constant feeder 12 and supplied to the vibrating kneader 50 through the belt conveyor 14, being kneaded therein. FIGS. 37 and 38 are side views of the vibration agglomerator for suitably carrying out the second stage after the first stage of the present invention.

FIG. 37 shows the vibrating agglomerator 90 provided with a horizontal cylindrical drum 72 which is supported by a vertical pivot shaft 96 at its raw material supply end. A vibrator 98 attached to the lower side of the drum 72 at its material discharge end, which oscillates horizontally the drum. Both the vertical shaft 96 and the vibration generator 98 are placed on a machine frame 100 which is provided with a slanting device 102 and a pin supporting bracket 104.

FIG. 38 shows another embodiment of the vibration agglomerator 90*a*. The drum 72 of the vibrating agglomerator 90*a* is supported through a set of spring devices 94. The drum 72 has a pair of vibrators 92 installed at both sides of the drum 72. The left and right vibrators are adapted to apply synchronous circular motion to the drum 72 for tumbling the agglomerating charge contained in the drum 72. Similar to the manner of the agglomerator 90 shown in FIG. 37, the agglomerator 90*a* is wholly supported on the machine frame 100 and the frame 100 has a slanting device 102 and a pin supporting bracket 104.

Figure 36:
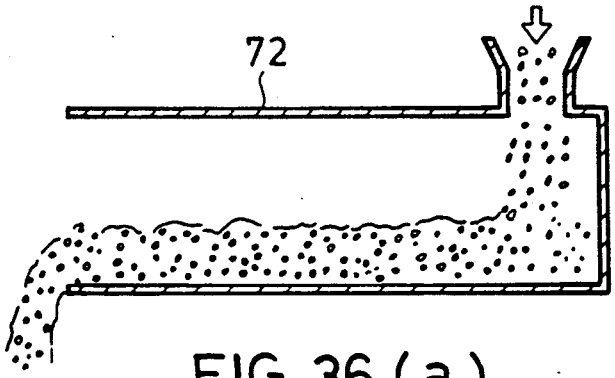
Figure 36:
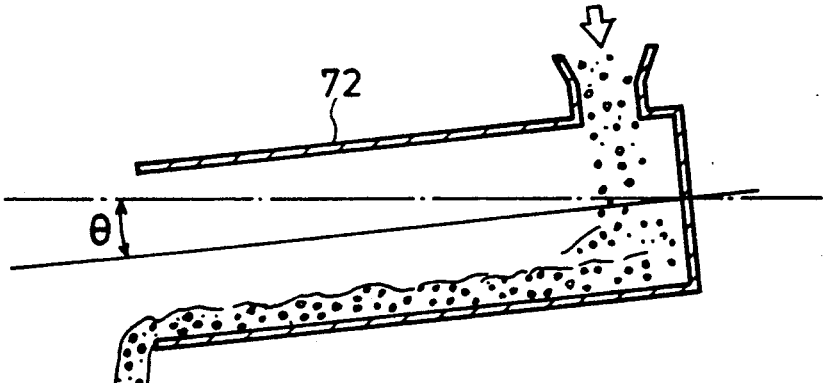

FIG. 36(*a*) and (*b*) are axial sectional views of the cylindrical vibrating agglomerator; (*a*) in a horizontal position, (*b*) in front-down condition along the travelling direction of agglomerating charge. The holding rate of the agglomerating charge in the drum is small in case of (*b*). With the same slant angle, the larger the vibrating power is, the smaller the holding rate becomes.

Figure 22:
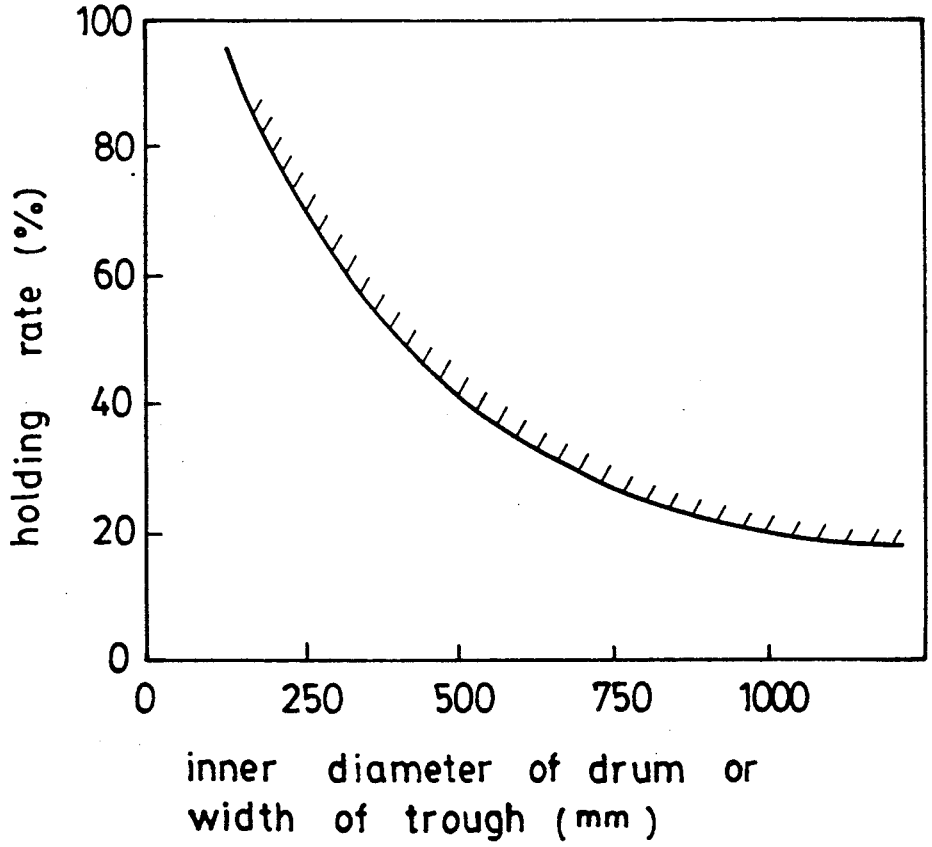
FIG. 22 is a graph showing a relation between the inner diameter of the drum or width of the trough and an appropriate holding rate.

A holding rate Φ of materials in a circular or trough agglomerator has remarkable effects on agglomerating characteristics such as yield of suitable grain size, dispersion in grain size, strength of the product and the like as well as productivity. FIG. 22 shows an allowable holding rate. It is required to determine feed rate of raw charge and/or slant angle and/or vibrating intensity of the agglomerator in order to control the holding rate at optimum condition.

A holding rate is calculated by the following equation.

$$\begin{aligned}\Phi &= 4Q/(\pi \cdot \gamma D^2 \cdot V_p \cdot n) \\ &= K \cdot Q/V_p \\ &= K \cdot Q/f(\theta, \alpha)\end{aligned} \tag{3}$$

wherein;

K: constant $\alpha$: vibrating acceleration

Figure 23:
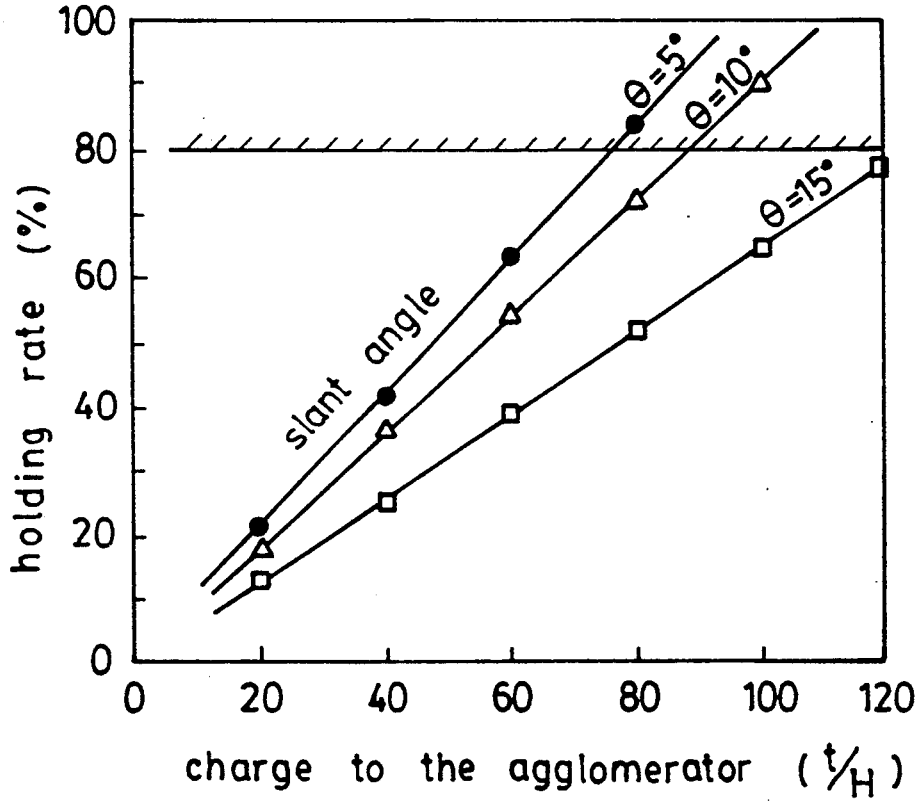
FIG. 23 and 24 are graphs each showing a relation between the charge rate and the holding rate of the agglomerator.

As seen, the holding rate Φ is proportional to feed rate Q and inversely proportional to transfer velocity $V_p$. Transfer velocity varies according to the vibrating acceleration and the slant angle which is illustrated in FIG. 23.

The holding rate Φ may be suitably controlled by one or more of the factors of the feed rate Q, slant angle, $\theta$ and vibrating intensity.

The maximum value of the holding rate varies according to the diameter of the drum. The reasons are considered that a small drum has high transfer velocity of the particles and short time for contacting the material with the drum shell. Further, easy transmission of vibrating effect allows to apply high holding rate.

On the other hand, in a large drum in diameter, large holding rate causes thick layer to retard vibration transmission.

FIG. 23 shows in an embodiment a relation between a holding rate and the feed rate as well as slant angle under the condition of circular vibration of 5 G in an agglomerator composed of five circular sectional troughs of 250 mm in diameter. FIG. 23 shows that when the holding rate is controlled less than 80%, the feed rate Q should be less than 75 t/h, 90 t/h, 125 t/h, under slant angles of 5, 10, 15 degrees respectively.

Figure 24:
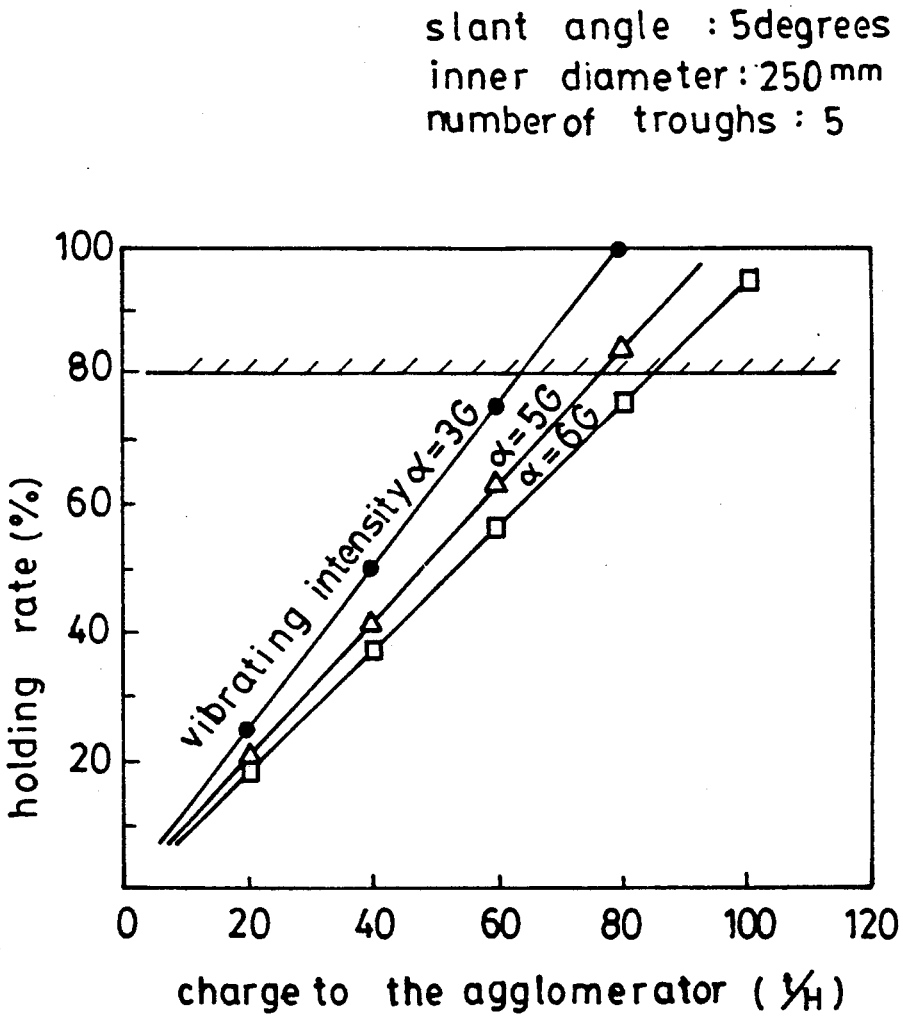
Figure 26:
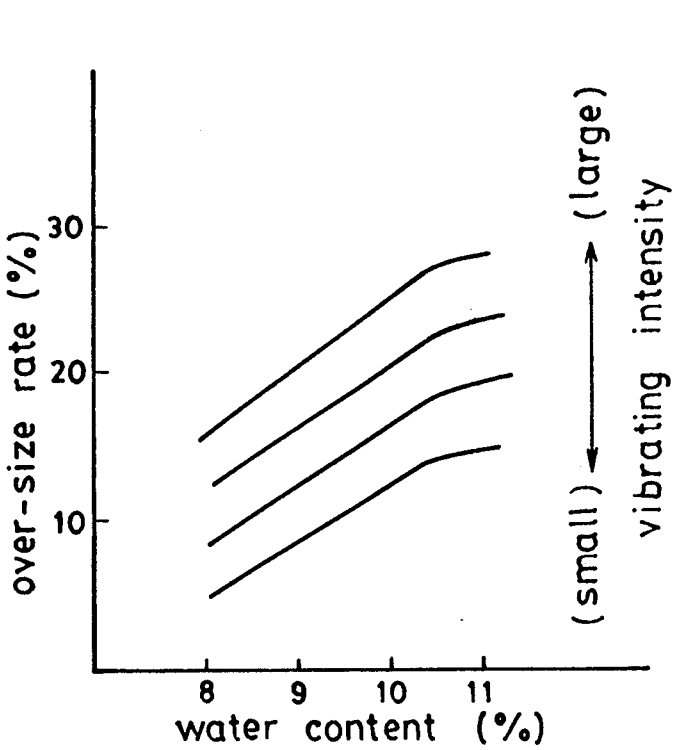
FIG. 26 is a relation graph between the water content and the over-size rate in the weight % of the grain more than 10 mm of grain size when taken the vibrating intensity as a parameter.

FIG. 24 also illustrates a relation under constant slant angle of 5 degrees: the feed rate Q should be controlled less than 64 t/h, 76 t/h, 85 t/h corresponding to vibration intensities 3 G, 5 G, 6 G respectively.

The agglomeration made by the agglomerator shown in FIG. 37 of FIG. 38 has the grain size distribution as shown in FIG. 31.

It is apparent that it is easily possible to produce green mini-pellets being compact, condense, good in grain size distribution and strong as shown in FIG. 34. Further it is possible to improve the proportion of distribution of fine powdery iron ore and use a lot of raw material of a low cost, descreasing the amount of binder to used in the stage. As a result, apparently it is possible to manufacture low cost agglomerating charge for sintering preparation with a good sintering production rate.

(3) An embodiment in which the over-size rate of more than 10 mm of grain size in the produced mini-pellets is measured in the second stage and the water content is adjusted in the first stage.

Figure 40:
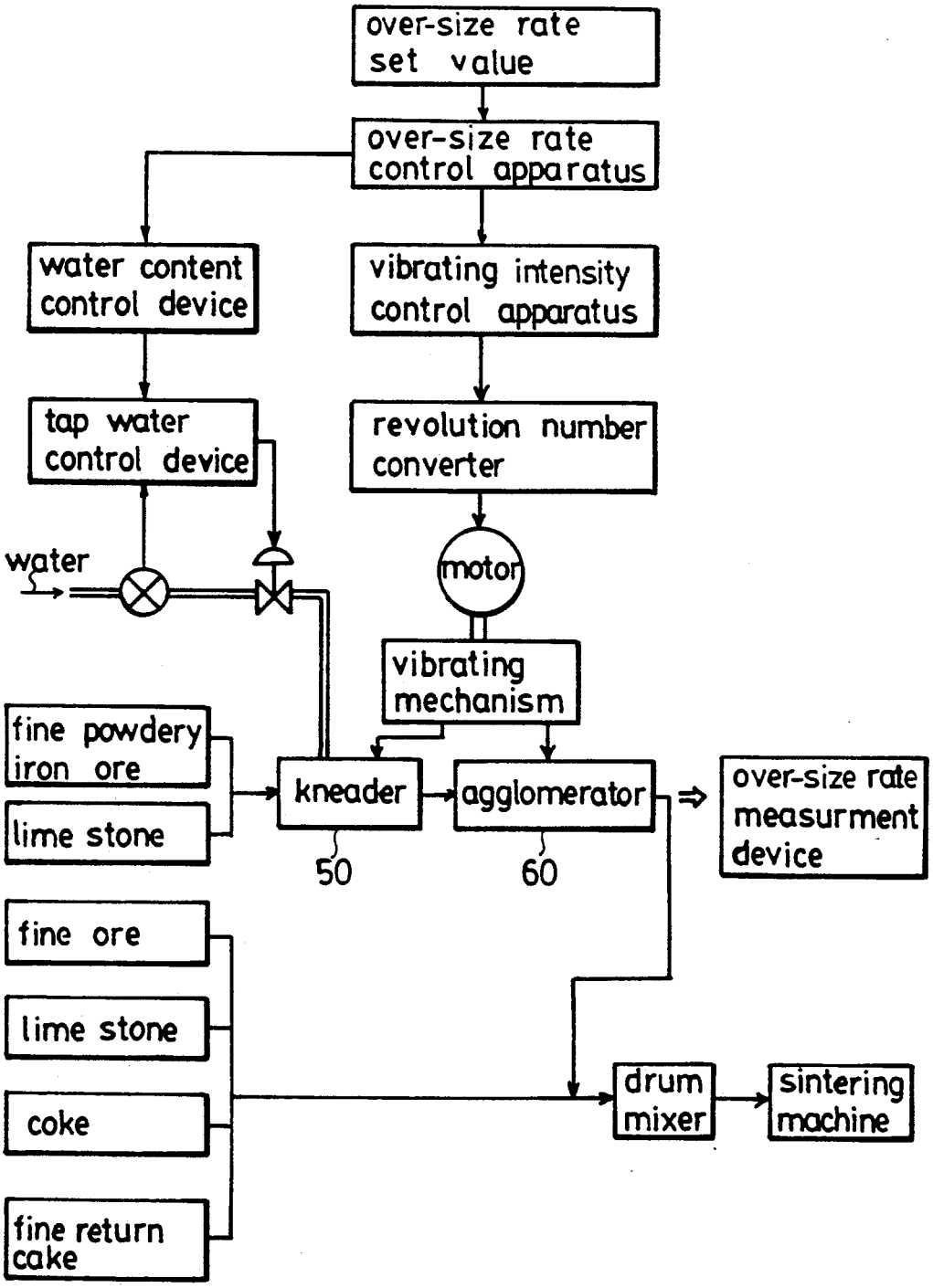
FIG. 40 is a system explanatory view of the control apparatus for suitably carrying out the over-size rate control.

FIG. 40 is a system explanation of agglomaration process for agglomerating charge, in which the embodiment is carried out suitably. As shown in FIG. 40, limestone and fine powdery iron ore of agglomerating charge is charged with water to the kneader 50 containing media for mixing and kneading the raw feed with vibration, and a vibrating intensity of 3 G to 10 G is applied to the kneader to make the raw material in capillary state. Then, the raw material kneaded is charged to an agglomerator 60 provided with a vibrating drum and the axis of the vibrating cylinder is slanted in the range of plus/minus 10 degrees and the vibrating intensity is controlled not less than 3 G. The agglomerator agglomerates the kneaded material by tumbling into a form of rigid green mini-pellets. Then, oridnary sintering charge or material consisting of fine ore, limestone, coke, and fine return cake is mixed in a drum mixer together with the previously prepared green mini-pellets, re-agglomerated, and charged into a sintering machine.

In the embodiment of the sintering preparation system according to the present invention, an over-size rate of more than 10 mm of grain size of the green mini-pellets agglomerated after being tumbled as described above is measured. On the basis of the deviation between the measured value and the set value, vibrating intensity of the kneader and the agglomerator, and water to be added to the kneader are controlled to suitably agglomerate the charge to make the over-size rate optimum.

Figure 25:
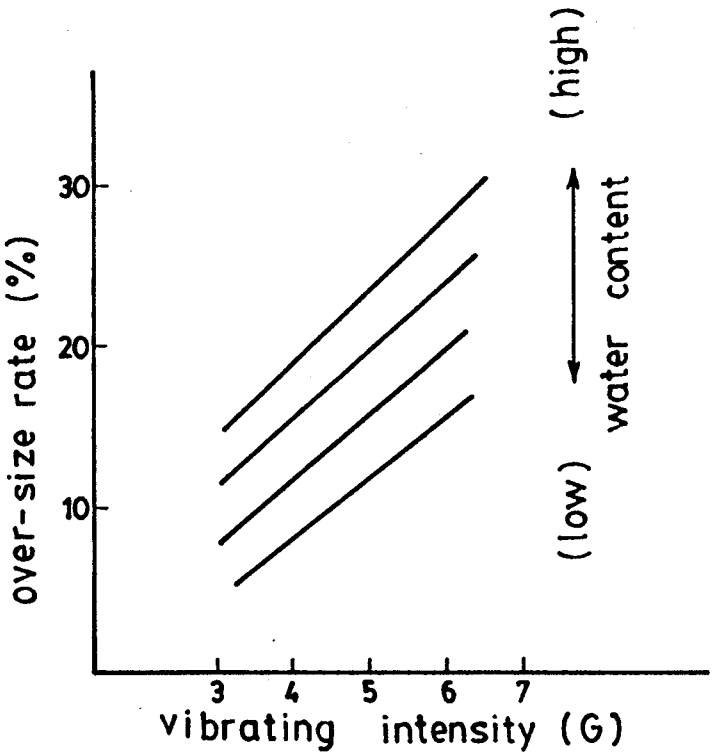
FIG. 25 is a relation graph between the vibrating intensity and ovesize rate in the weight % of the grain more than 10 mm of grain size when taken the water content as a parameter.

The control of the over-size rate more than 10 mm of the grain size by means of the vibrating intensity as schematically shown in FIG. 25 will be explained in detail with reference to FIG. 39.

Figure 39:
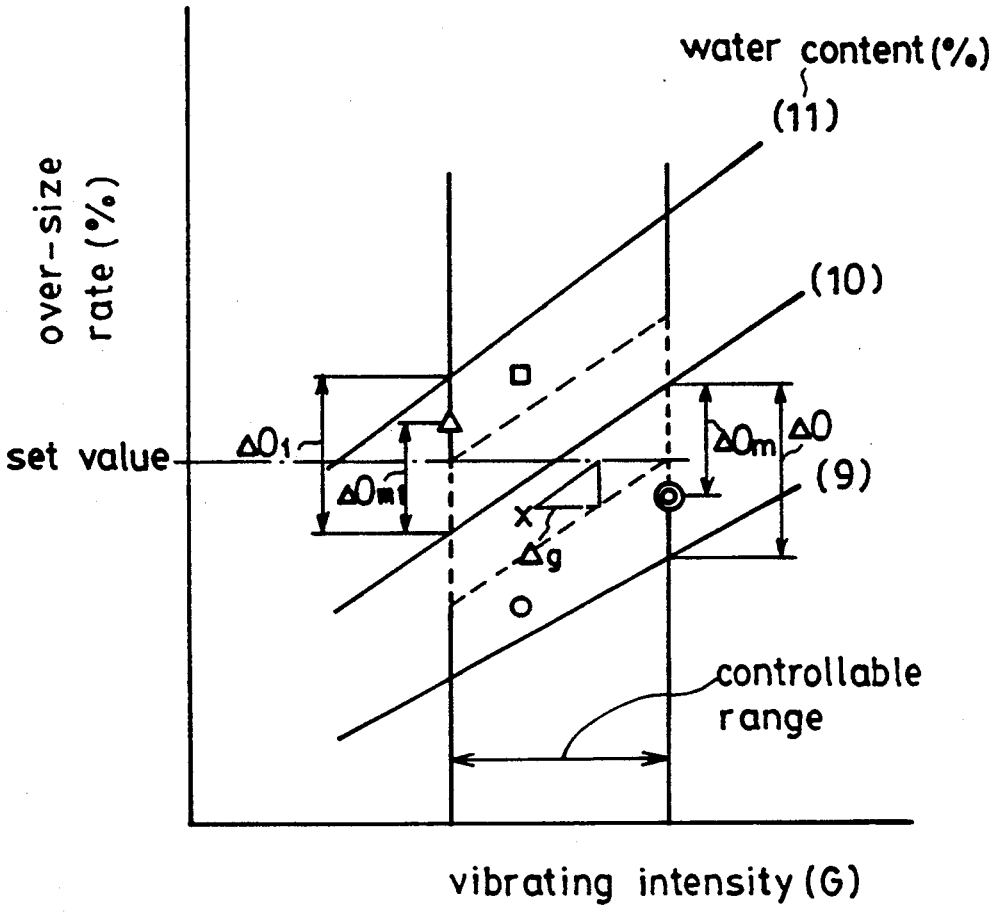
FIG. 39 is an explanatory view of the method for adjusting the over-size rate in the embodiment of the present invention.

(a) Case in which the content of the grain size of more than 10 mm drops in the ordinary controllable range (shown in dotted line in FIG. 39).

When the content of the grain size of more than 10 mm drops in the dotted or broken line range in FIG. 39, the vibrating intensity if feedback-controlled in the controllable range shown. For example, when the vibrating intensity is at the position marked with X, the vibrating intensity is increased by $+\Delta g$, so that the particles of grain size more than 10 mm can be adjusted at the set value.

(b) Case in which the content of the grain size more than 10 mm drops out of the range shown by dotted line in FIG. 39, for example, as shown by a small circle.

The vibrating intensity is raised to the upper limit of the controllable range. When the content of the grains sized more than 10 mm drop in the dotted line range, a control of the case (a) above is carried out.

When the majority of the particle more than 10 mm is lower than the dotted line range after being controlled according to the above operatin, for example, it is at a position of a double circle, the water content $\Delta m$ corresponding to the difference $\Delta Om$ between the water characteristic which has been the set and the content of the grain size more than 10 mm is determined to adjust the adding water amount of $+\Delta m$, and to return the vibrating intensity into its controllable range.

When the majority of grain of the grain size more than 10 mm resultantly drops in the dotted line range, the control procedure described in the case (a) above is carried out.

$\Delta m$ is determined from viewing the drawing as follows.

$$\Delta O = O_{10} - O_9,$$

$$\Delta m = \Delta Om / \Delta O$$

(c) When the majority of grain more than 10 mm in its size is placed at higher position out of the dotted line range, for example, at the position a square.

The vibrating intensity lowers to the lower limit of its controllable range, resultantly when the majority of grain more than 10 mm in its size drops in the dotted line range, the procedure of the case (a) is carried out.

In turn, when the majority of the grain of size more than 10 mm is placed above the dotted line range even after the control being carried out, for example, it is placed at the position of a triangle, the water content $\Delta m_1$ corresponding to the difference $\Delta Om$ between the water characteristic set already and the grain more than 10 mm in its size is determined to adjust the adding water amount of $-\Delta m_1$, and to return the vibrating intensity into its controllable range.

When resultantly the majority of grain which size is more than 10 mm drops in the dotted line range, the control procedure of the case (a) above is carried out.

$\Delta m_1$ is determined from viewing the drawing as follows.

$$\Delta O_1 = O_{11} - O_{10},$$

$$\Delta m_1 = \Delta Om_1 / \Delta O_1$$

The suffixes 9, 10, and 11, respectively show the water contents (%).

The process for controlling the vibrating intensity and the over-size rate of the grain more than 10 mm in its size has been described. It is possible to the over-size rate of the grain more than 10 mm by controlling water content, as well as the vibrating intensity as described above.

According to the embodiment above, when the majority of grains more than 10 mm is placed within the controllable range, the water content is made constant, the controlled result on the grain more than 10 mm in its diameter is transferred to a vibrating intensity control apparatus for being controlled in a manner of cascade. When the result exceeds the controllable range for the vibrating intensity, the set value of water content control changes. It is possible to control one of the vibrating intensity and the water control at the constant value and another one in a manner of cascade.

By adjusting the vibrating intensity and water amount to be added as described above, it is possible to control the over-size rate of more than 10 mm of grain size of the green mini-pelletes.

(4) Embodiment to be carried out in the second stage for adjusting the holding rate of the agglomerating charge contained in the agglomerator and/or vibrating intensity according to brand information of raw materials, supplied ore feed rate, and water content of the charge.

Figure 41:
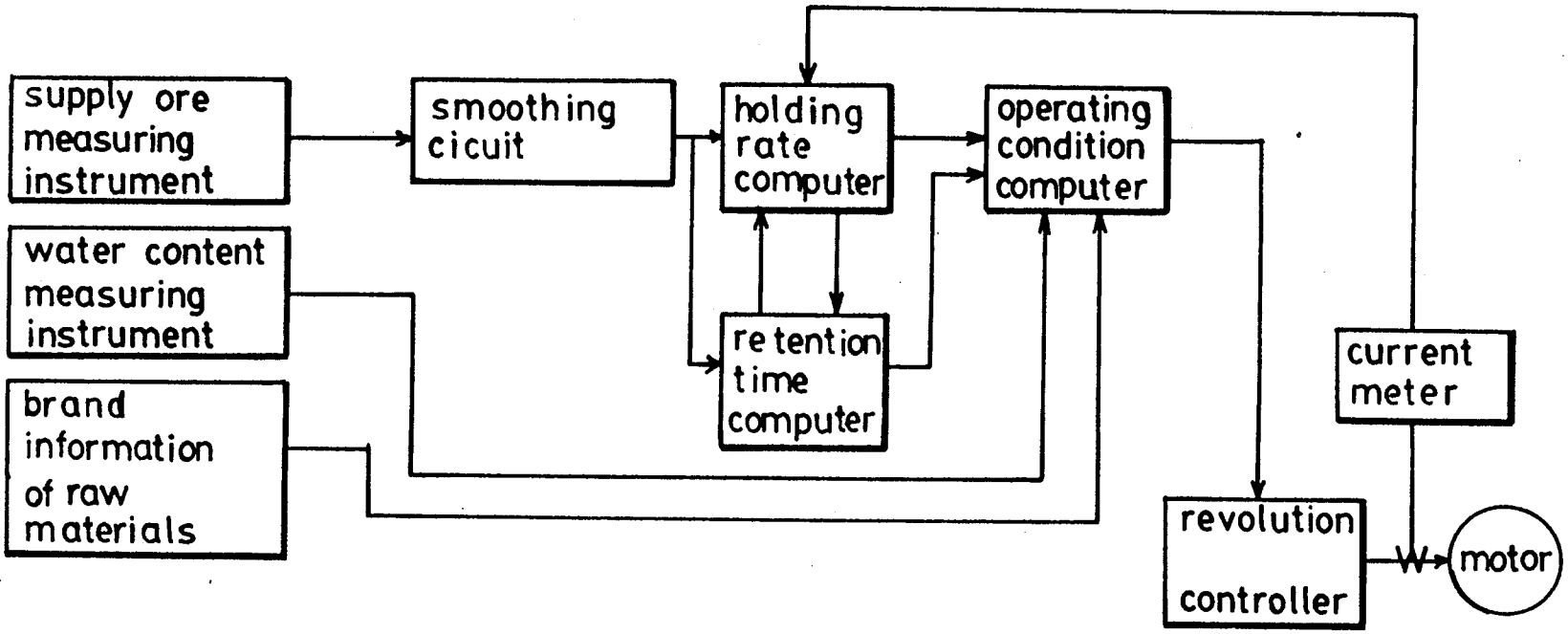
FIG. 41 is a block diagram of the apparatus for carrying out the grain size control of the present invention.

FIG. 41 shows a block diagram depicting the control system of the embodiment of the present invention. A supply ore measuring instrument constituted by, for example, a belt weigher and the like measures the amount of ore. The measurement is inputted to a holding rate computer and a retention time computer through a smoothing circuit. The measurement of current passing through the motor installed in the vibration generator of the agglomerator is inputted to the holding rate computer through a current meter in order to calculate the optimum holding rate of the charge in the agglomerator. The values of the holding rate and the retention time have a fixed interrelation and both computers are mutually corrected interferencially. The outputs of the holding rate computer and the retention time computer are inputted to an operating condition computer.

While, the information memorized in a computer on measurement values of a water content measuring instrument and brand information of raw materials is inputted to the operating condition computer, in which the suitable revolution of the agglomerator vibrating motor and the holding rate in the agglomerator are computed based upon the predetermined operating conditions of the vibrating intensity, the holding rate, the rentention time, and the water content in accordance with the specific brand ore.

Figure 28:
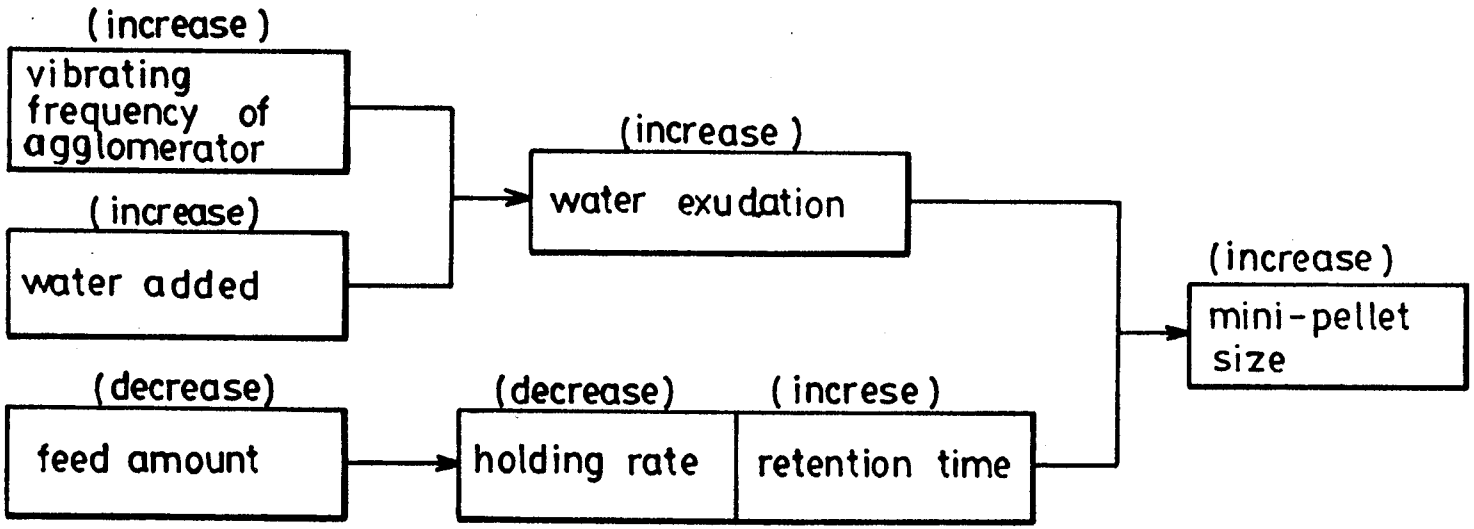
FIG. 28 is a corelation explanatory block diagram of agglomerating factors, FIG. 29(*a*) is a graph of the relation between the mini-pellet compounding ratio and the permeability when taken the agglometation grain size as a parameter, FIG. 29(*b*) shows the relation between the agglomeration grain size and the permeability when taken the mini-pellet compounding ratio as a parameter.

The mean grain size of agglomerated green mini-pellets is effected by the amplitude of vibration of the agglomerator, the holding rate, the retention time, the water content, and the vibration frequency. The mutual relationship among them above is shown in FIG. 28.

It is apparent that when the water content and the agglomeration vibration frequency increase, exuding rate of water in the mini-pellet from its core to the surface during the agglomeration stage increases and sticking or adhering function of pellet increases, so that the size of agglomerated grain increase.

When the supply ore feed rate decreases, the holding rate of the ore in the agglomerator decreases and the retention time increases, and further tumbling effect increases, resulting in enlargement of agglomerated size. These factors above have mutual relationship.

Accordingly, it is preferable to determine previously the operating conditions for the pellets having the suitable mean grain size on respective ore brands, employing a multiple regression analysis, in order to operate under such control factors for producing desired pellets having the target grain size.

In general, the holding rate and the rentention time of the agglomerating charge are necessarily determined according to the production rate, and also water content is determined on the condition of mixing and kneading with vibrating media for each brand ore, so that it is said that the factor having the largest controllability is vibration frequency for generating the vibrating intensity. Consequently, the output of the operating condition computer in the embodiment shown in FIG. 41 is inputted to a revolution controller in order to control the revolution of the vibration motor of the agglomerator to change the vibration frequency. One example is given below. The operating conditions having the factors such as the specific characteristic of the iron ore of a certain brand, water content, supply ore feed rate, and agglomerating vibration frequency regarding to the mean grain size of agglomerated mini-pellets are obtained in advance under experiments using apparatus consisting of a vibrating kneader and a vibrating agglomerator.

The specification and operative conditions of the experimental apparatus are as follows.

Figure 42:
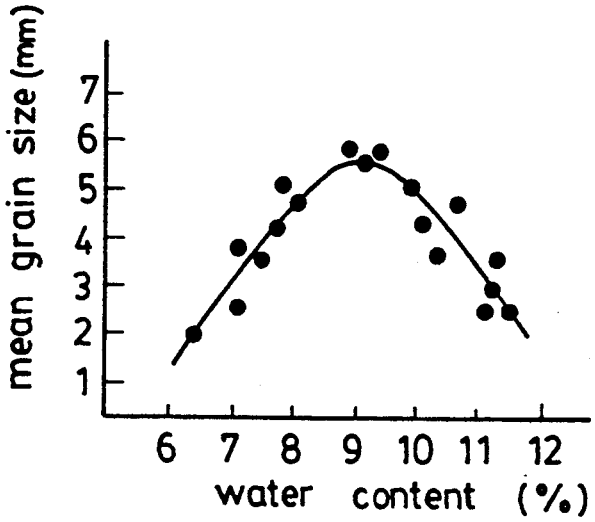
FIGS. 42 to 45 are graphs each showing the relation between the operational condition and the grain size of the present invention.

(a) Specification of the vibrating kneader
drum: horizontal cylinder type
inner diameter 194 mm×length 494 mm
containing capacity: 15 liters
vibration system: circular motion
vibrating intensity: 6 G
amplitude: 7 mm
vibration frequency: 1000 rpm
contained vibrating media: 30% of drum capacity
diameter of vibrating media: 30 mm (b) Specification of the vibrating agglomerator
drum: horizontal cylinder type
inner diameter 194 mm×length 494 mm
containing capacitty: 15 liters
vibration system: circular motion
vibrating intensity: 4 G
amplitude: 7 mm
vibration frequency: 700 rpm FIG. 42 is a graph displaying the water content and the mean graph size of the agglomerating charge of the particular brand ore during kneading stage. It is seen that the grain size has a tendency to decrease in proportion to the negative figure of the water content % squared of the agglomerating charge when the water content exceeds the predetermined value.

Figure 43:
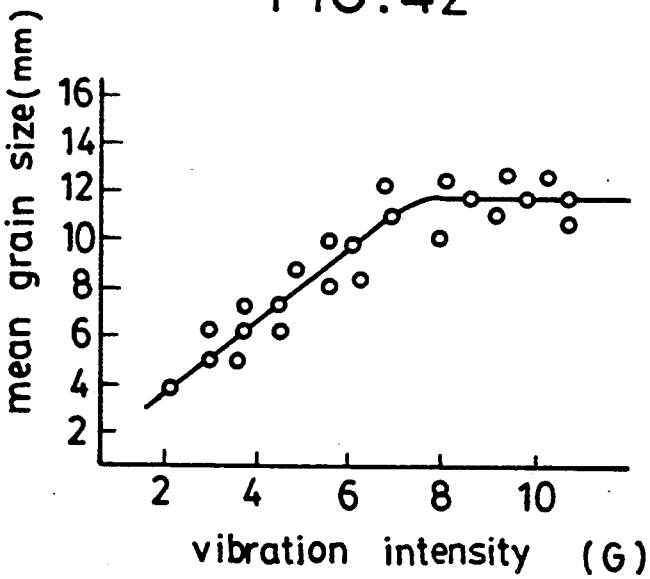

FIG. 43 shows the relation between the vibration intensity and the mean grain size, the vibration frequency being expressed by the vibrating intensity to be applied to the agglomerator. The vibration frequency and the grain size has a substantially linear proportional relation and it is saturated when the vibrating intensity reaches about 8 G as seen. It is noted that when the grain size necessary to sinter the charge is less than 10 mm, the vibrating intensity up to 8 G or so is sufficient to suitably agglomerate the charge.

Figure 44:
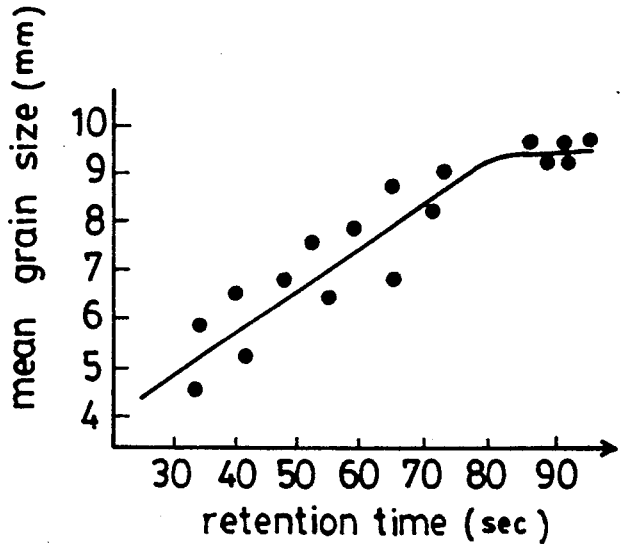
Figure 45:
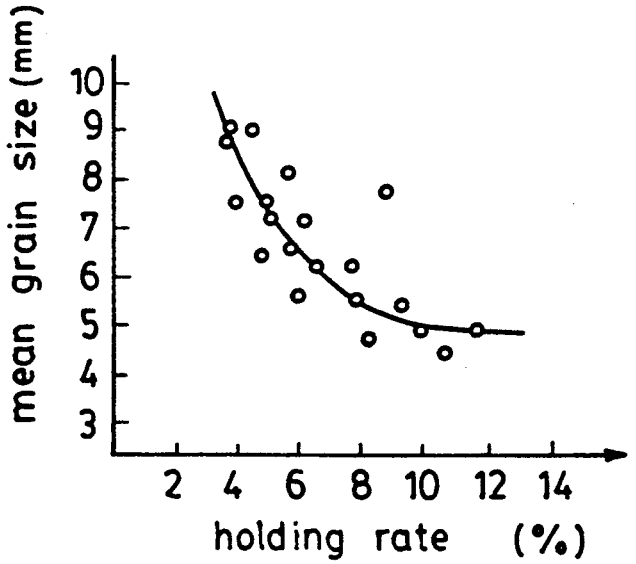

FIGS. 44 and 45, respectively show the relations between the retention time and grain size, and the holding rate and the grain size, depicting that when the retention time lengthens, the grain size increases, and the holding rate and the grain size are substantially proportioned reversely. When these relations above are previously determined for each brand of the agglomerating charge, it is possible to make respective charge of any target grain size according to each brand information.

Figure 46:
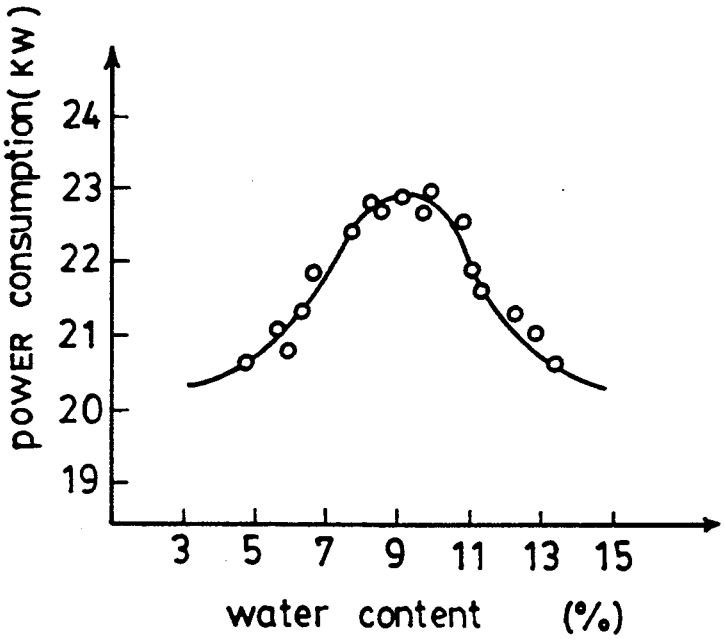
FIG. 46 is a graph showing a relation between the water content of the agglomerating charge and the power consumption of the vibrating kneader when the frequency of the vibrating generator in the kneader is constant.
Figure 47:
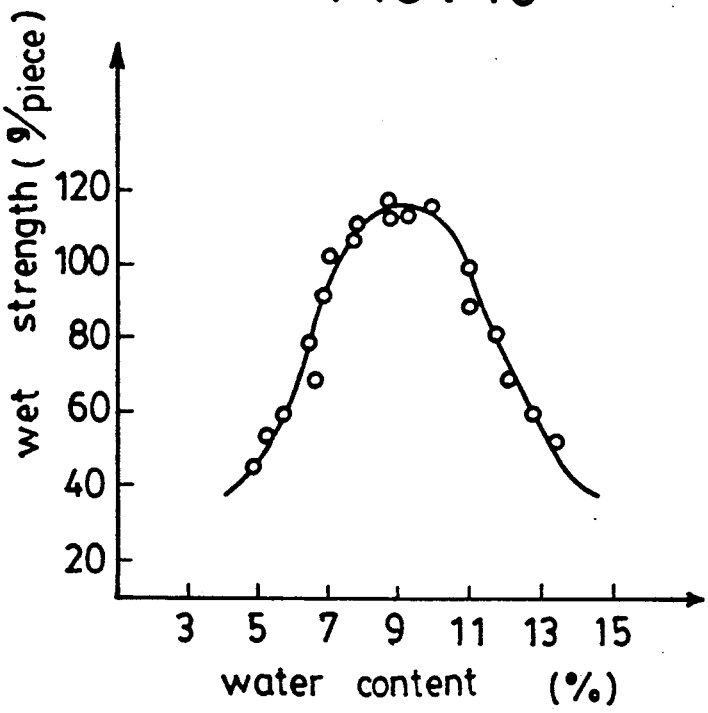
FIG. 47 is a graph showing a relation between the water content of the agglomerating charge and the crushing strength of wet ball after the agglomeration.

(5) An embodiment to be carried out in the first stage, in which the adding water is controlled to make the power consumption of the kneader maximum FIG. 46 shows a relation between the water content of the raw feed in the kneader and the power consumption of the kneader when the ore supply feed rate is 60 ton/hr and retention time is 50 sec, and the frequency of the vibration is a constant. As shown the power consumption is made maximum when the water content is 9 weight %. Other specifications of the kneader are shown below.

vibrating intensity: 5 G
amplitude: 10 mm
holding rate of rods (media for kneading): 10%
diameter of rods: 30 mm
inner diameter of the drum: 300 mm
length of the drum: 1000 mm FIG. 47 show a relation between the water content of the raw feed in the kneader and the strength of agglomerated wet balls. As apparent from FIGS. 46 and 47, the water content which is measured when the power consumption is of maximum and another water content which is measured when the strength is of the highest are identical to each other. So it is possible to determine the proper water content of the raw feed in the kneader by examining the change of power consumption of the kneader. It is said that water content control on the basis of the change of power consumption is possible.

Figure 48:
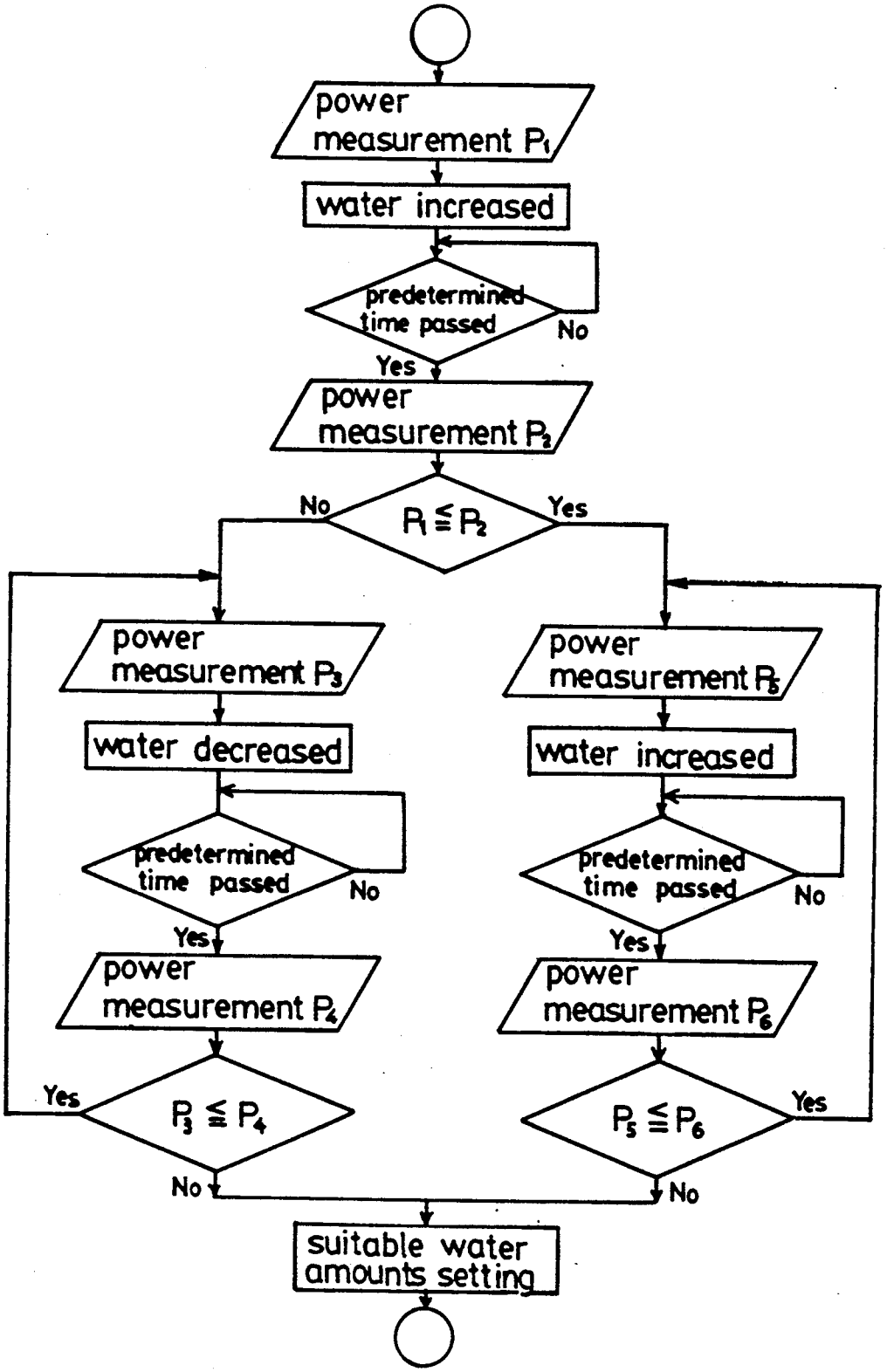
FIG. 48 is a flow-chart showing the process for controlling the water to be added on the basis of the power consumption of the kneader.

FIG. 48 is a flow chart displaying how to control and set the water to be added, during the mixing and kneading stage, on the basis of the power consumption of the kneader.

As shown in the drawing, at first the raw feed is supplied to the vibrating kneader, the measurement of the electric power starts and simultaneously water is supplied to the feed. Then a power level is measured at any time after the stabilizing time of the feed or material in the kneader and additional waiting time of a predetermined length elapse. According to the difference between the former power level and the latterpower level changes along its increasing direction or its decreasing direction, the water amount to be added increases or decreases in order to determine the point of maximum power consumption. Consequently, it is possible to produce the green mini-pellets of the strongest.

(6) An embodiment to be carried out after the second stage, how to supply the mini-pellets to a Dwight-Lloyd continuous sintering machine, measure the permeability of the sintering bed, and adjust the compounding ratio of the mini-pellet and other raw feed.

Figure 29A:
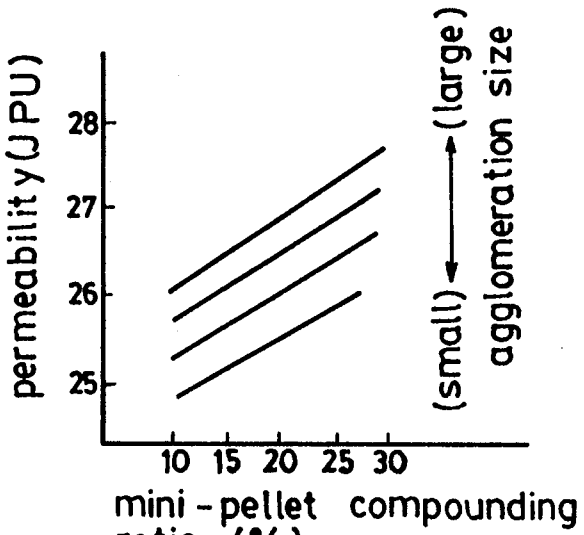
Figure 29B:
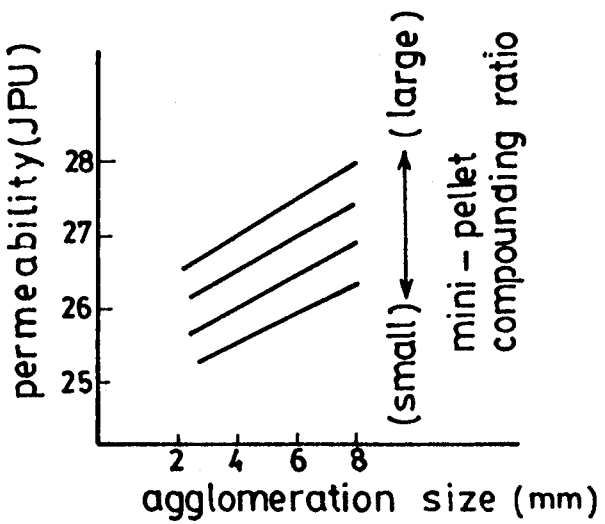

FIG. 29(*a*) is a relation graph between the mini-pellet compounding ratio and the permeability in case that the agglomeration size is used as a parameter, and FIG. 29(*b*) shows a relation graph between the agglomeration size and the permeability in case that the mini-pellet compounding ratio is used as a parameter. It is understood that controlling the mini-pellet compounding ratio or the agglomation grain size enables to control the permeability on the sintering machine.

According to the embodiment of the present invention, the mini-pellets produced in the kneading and agglomerating process mentioned above is composited with other new raw feed of fine ore, limestone, coke and fine return cake, the composite is re-agglomerated by a mixing machine, and the produced sintering mix is supplied to the Dwight-Lloyd continuous sintering machine. The permeability of the sinter mix on the pallets of the Dwight-Lloyd continuous sintering machine is measured and the compounding ratio of the mini-pellet and the other raw feed and/or the grain size of the mini-pellets are adjusted on the basis of the deviation between the measured permability and the set value, so that it is possible to keep the permeability of the sinter mix on the sintering machine at its best condition.

Figure 50A:
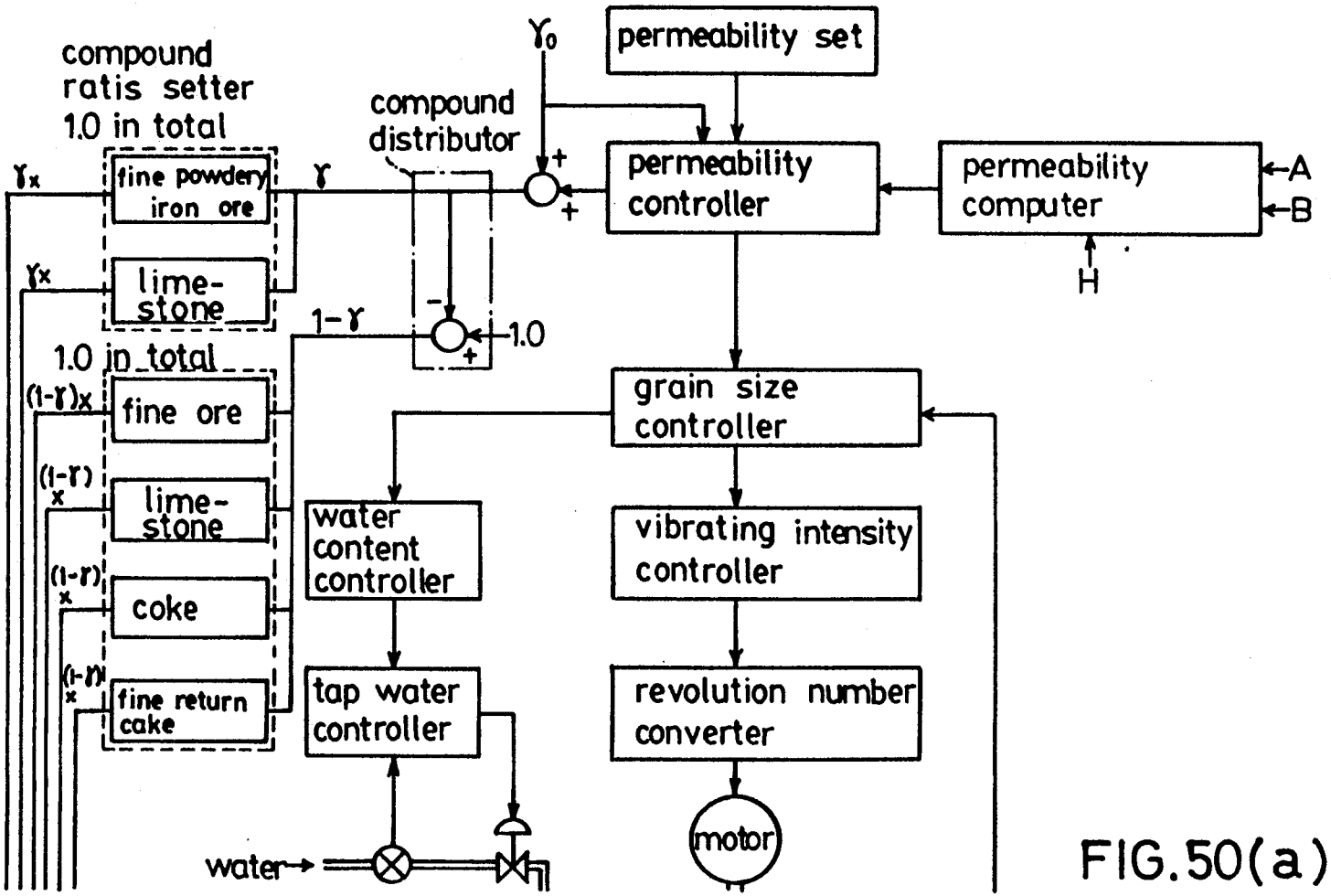
FIG. 50 is a system explanatory view of the control system for preferably carrying out one embodiment of the present invention.
Figure 50:
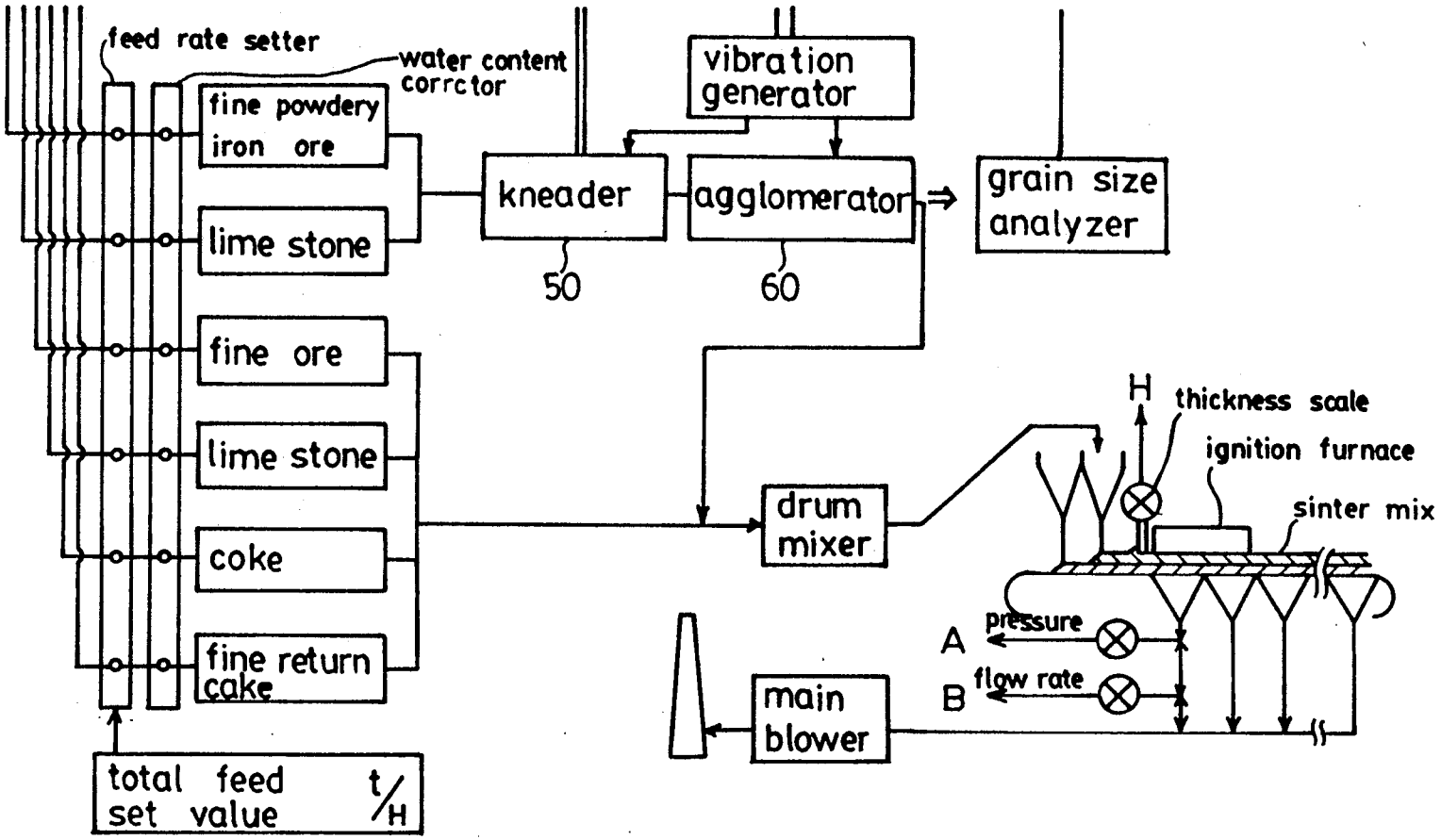

FIG. 50 illustrates a permeability control system on the sintering machine enabling to carry out suitably the present invention. Fine powdery iron ore and limestone of the raw feed are charged to the vibrating kneader 50 containing media for mixing and kneading the raw feed, vibrating intensity of 3 G to 10 G is applied to the kneader 50 to mix and knead with vibration the raw feed in order to make the feed in capillary state. Then, the mixed and kneaded material is charged to the agglomerator 60 providing with a vibrating drum. The vibrating intensity is adjusted not less than 3 g in order to tumble and agglomerate the kneaded material, producing rigid and strong green mini-pellets. The mini-pellets are mixed with other raw feed composed of fine ore, limestone, coke, and fine return cake in a drum mixer, the mixture is re-agglomerated, and the agglomerated sinter mix is charged onto the pallets of the sintering machine through a feed hopper.

Further, in this embodiment, exhaust gas pressure "A" of a wind box of the sintering machine, a flow rate "B" of air, and a thickness H of the sinter mix on the pallets, respectively are measured, and the result is inputted to the permeability computer in order to determine a permeability P as shown below.

$$\text{Permeability } P=(B/A)/H$$

On the basis of the deviation between the measured value P of the permeability and the set value, the compounding ratio of the mini-pellets and the other raw feed to be supplied to the drum mixer for re-agglomeration (this ratio is referred hereinafter as mini-pellet compounding ratio) and/or the mini-pellet grain size are controlled in order to adjust the permiability of the sinter mix on the pallets of the sintering machine.

Figure 49:
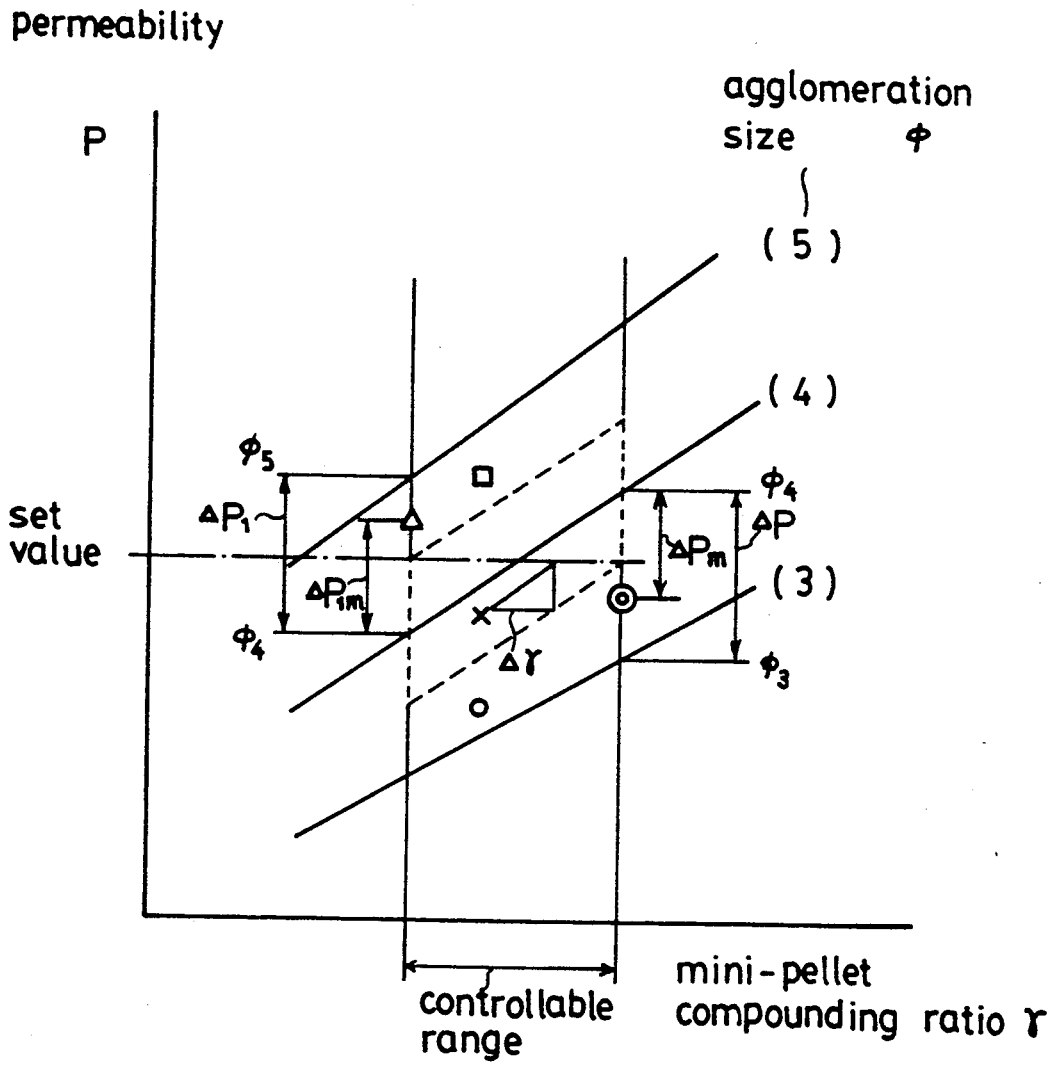
FIG. 49 is an explanatory view of the control method in the present invention.

FIG. 49 shows in detail the process for adjusting the mini-pellet compounding ratio $\gamma$ in order to control the permeability P shown in FIG. 29(*a*). FIG. 49 has a graph provided with the axis of abscissa of the mini-pellet compounding ratio $\gamma$ and the axis of ordinate of the permiability P.

The operation will be given in detail.

(a) Case in which the permeability P resides in ordinary controllable range (shown by dotted line in FIG. 49).

When the permeability P resides in the ordinary control range, inside the dotted lined area in FIG. 49 the mini-pellet compounding ratio $\gamma$ is feedback-controlled in the control range. For example, when the mini-pellet compounding ratio $\gamma$ is at the portion marked X and the mini-pellet compounding ratio is adjusted by adding $+\Delta\gamma$, the mini-pellet compounding ratio $\gamma$ comes to the set value.

(b) When the permeability P resides out of the dotted line range, for example, at the position of marked O, the mini-pellet compounding ratio $\gamma$ is controlled to come to the upper limit of the controllable range of the mini-pellet compounding ratio $\gamma$. When the permeability P enters resultantly in the range shown by the dotted line, the control procedure case (a) above is done.

When the permeability P is lower than the dot-lined range, for example, at the position of double-circle, the grain size $\Delta\phi$ corresponding to the difference $\Delta Pm$ from the characteristics of the agglomerating charge having the grain size $\phi$ already set is determined in order to control the grain size by additing $+\Delta\phi$ and return the mini-pellet compounding ratio $\gamma$ into the controllable range of the ratio $\gamma$. When the permeability P enters resultantly to the dotted-lined range, the control procedure of the above case (a) is carried out.

$\Delta\phi$ is determined by calculating the following equation.

$$\Delta P=P_4-P_3$$

$$\Delta\phi=\Delta Pm/\Delta P$$

(c) When the permeability P resides out of the range shown by the dotted line, for example, at the position of a square, the mini-pellet compounding ratio $\gamma$ is controlled so as to adminish to the lower limit of the controllable range of the ratio $\gamma$. When the permeability P enters consequently into the controllable range shown by dotted line, the procedure of the case (a) above is done.

When the permeability P is higher than the range of dotted lines even after the above control procedure is done, for example, at the position of a triangle, the grain size $\Delta\phi_1$ corresponding to the permeability difference $\Delta Pm_1$ from the characteristic of the grain size $\phi$ already set is determined and the grain size is controlled with $-\Delta\phi_1$, returning the mini-pellet compounding ratio $\gamma$ into the controllable range of the ratio $\gamma$ above. When the permeability P enters as a result into the range shown by dotted line, the control procedure of the case (a) above is carried out.

As apparent from the drawing, $\Delta\phi_1$ is determined by using it as that of $\Delta\phi$ above.

$$\Delta P_1 = P_5 - P_4$$

$$\Delta\phi_1 = \Delta Pm_1/\Delta P_1$$

wherein, these suffixes 3, 4, and 5 designate the grain sizes respectively in mm in diameter.

It is possible to adjust the grain size $\phi$ of the mini-pellet in order to control the permeability P, other than the mini-pellet compounding ratio $\gamma$ adjusted in the above case.

It is consequently possible to control the permeability by adjusting these mini-pellet compounding ratios and/or the grain size of the mini-pellet as mentioned above.

When the permeability through the prepared sinter mix resides in the controllable range of the mini-pellet compounding ratio during this controlling process, the grain size is made constant. The mini-pellet compounding ratio is controlled due to the result of the controlled permeability. When the permeability through the prepared mix resides out of the controllable range of the mini-pellet compounding ratio, the setting of the grain size to be controlled in done. However, it is possible to control the permebility using only controlling the mini-pellet compounding ratio with the constant or fixed grain size, without size control.

(7) An embodiment in which raw material of ore having a grain size distribution difficult to agglomerate is agglomereted In general, water which is contained among the grain particles of the raw feed for sintering preparation adheres particles to each other during the agglomeration process. However, in case of a raw feed containing mainly medium size particles, the adhering force between particles due to water placed between them is too weak to stably keep the adhered condition owing to the weights of these grains themselves. According to the present invention, by adding extremely fine powdery raw feed of the grain size less than 63 μm, which functions as a binder and accordingly good agglomeratability is obtained. When the mixed or prepared material is compounded with the grain size less than 63 μm at the ratio of lower than 20 weight %, the ratio of the grains of grain size of 2 to 5 mm in the sinter mix which are necessary to carry out good sintering operation decreases. So that it is determined of more than 20 weight % in the compounding ratio.

FIGS. 2, 4, and 5 show an appratus for suitably carrying out the embodiments shown.

The apparatus has a vibrating kneader 50 and a vibrating agglomerator 60, which are arranged in series and both the kneader and the agglomerator are each of a drum type. The Carol Lake mine iron ore which has a grain size distribution difficult to agglomerate is used in the apparatus above.

Figure 52:
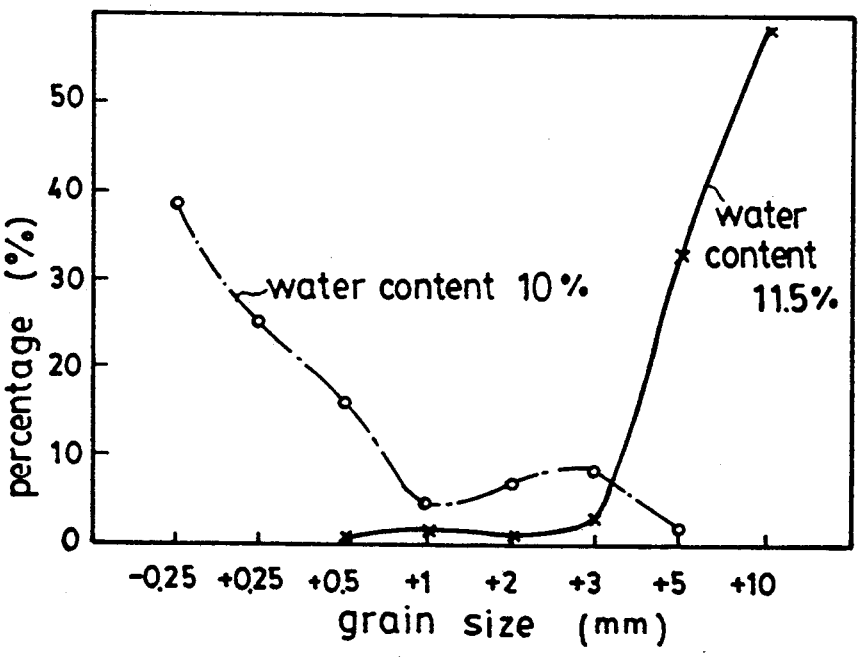
FIG. 52 is a graph showing the size distribution according to the conventional process.

FIG. 52 shows the size distribution of agglomerated pellets by the present process carried out when the water contents are 10 weight % and 11.5 weight % respectively to the Carol Lake mine iron ore feed with a vibrating intensity of 6 G and a vibrating amplitude 7 mm for the vibrating kneader and a vibrating intensity of 4g and a vibrating amplitude 7 mm for the vibrating agglomerator. As apparent from FIG. 52, when the water content is low (10%), the size distribution of the pellets is improper because the proportion of the fine powdery raw feed is too low to grow up the grains. In this situation, even though that sufficient water is added (11.5%) in order to improve the size distribution, much resultant coarse particles of too large size are produced in a wet sticky state.

Figure 51:
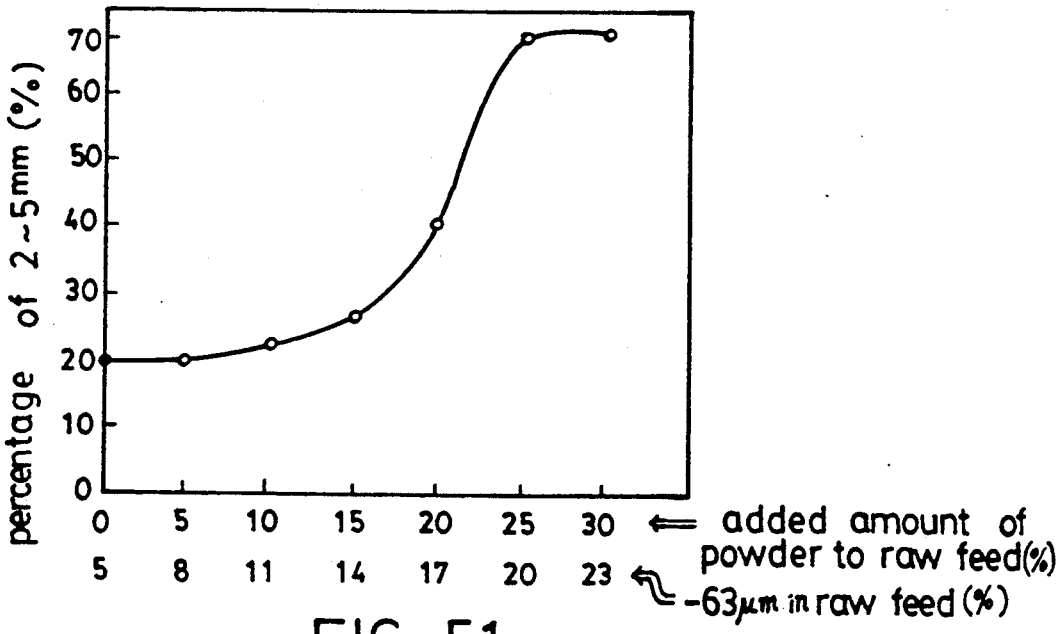
FIG. 51 is a graph showing the yield size proportion in the embodiment of the present invention.

The result shown in FIG. 51 is obtained by the agglomerating process of the embodiment in which fine powder of the grain size less than 63 μm is added to the Carol Lake mine iron ore. The agglomeration process is carried out under the same agglomerating condition as that of FIG. 52. It is noted that when more than 20% of fine powder of the grain size less than 63 μm is mixed to the Carol Lake mine iron ore, the agglomerated size distribution is considerably improved.

(8) An embodiment which is done after the second stage to transfer the mini-pellet on a vibrating conveyor and dry the mini-pellet.

In the embodiment of the third step which is carried out after the agglomerating stage, the agglomerated green mini-pellets are supplied on to the vibrating transfer conveyor bed and hot gas of 150°-200° C. is cross flown upwardly from below the lower face of the conveyor bed for heat exchange with the mini-pellets bed on the conveyor in order to dry the product less than 3 weight % of water content, considerably improving the strength of mini-pellets.

Figure 30:
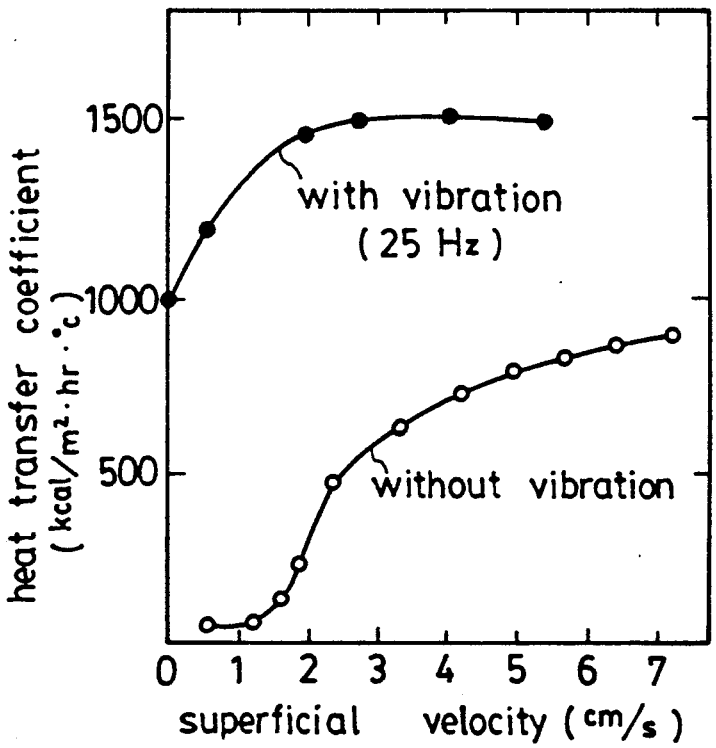
FIG. 30 is a relation graph between the superficial velocity and heat transfer coefficient.

The vibrating transfer conveyor of the embodiment having the similar construction to a vibrating screen transfers mini-pellets with vibration and functions to carry out heat exchange, so that a heat transfer coefficient and production efficiency are high. An example of the heat transfer coefficient is shown in FIG. 30. As shown in the drawing, by adding a vibratin to the feed transfer conveyor, the value of the heat transfer coefficient is made larger than that of fixing layers of feed when the flowing speed of the particles is less than the minimum fluidization velocity. The larger the vibration intensity, the lager the value of the heat transfer coefficient. The reasons for the phenomenon will be described. One of the reasons is the vibrations for activating the motion of particle, i.e., moving speed of particles placed near the heating surface of the vibrating transfer bed increases. Another reason is particle concentration on the heating surface which is not decreased even though the gas flowing speed is large. The latter reason is found on the basis of the experimental result of, during a vibration is applying, the relatively small spreading of the layer. That is, there are two reasons for vibration to give influence on the heat transfer coefficient: the former being considered to happen at the relatively low speed of gas flow and the latter being considered to be dominant in the range of higher speed.

When the apertures at the floor of the vibrating conveyor are slits, each of a width 2 mm and a length 10 mm, the vibrating conveyor has a screen function enabling to displace any fine powder part of the raw feed for sintering preparation and to diminish a permeability resistance of the sintered layer in the sintering process, improving the productivity and lowering the cost of coke and electric power.

It is also possible to economically use the exhaust gas in the sinter cooling neighboring the sintering step as a heat source for drying and to collect some duct contained in the exhaust gas after heat-exchanged, recycling the dust to the entrance of the sintering appratus in order to save the raw feed for sintering preparation.

Figure 53:
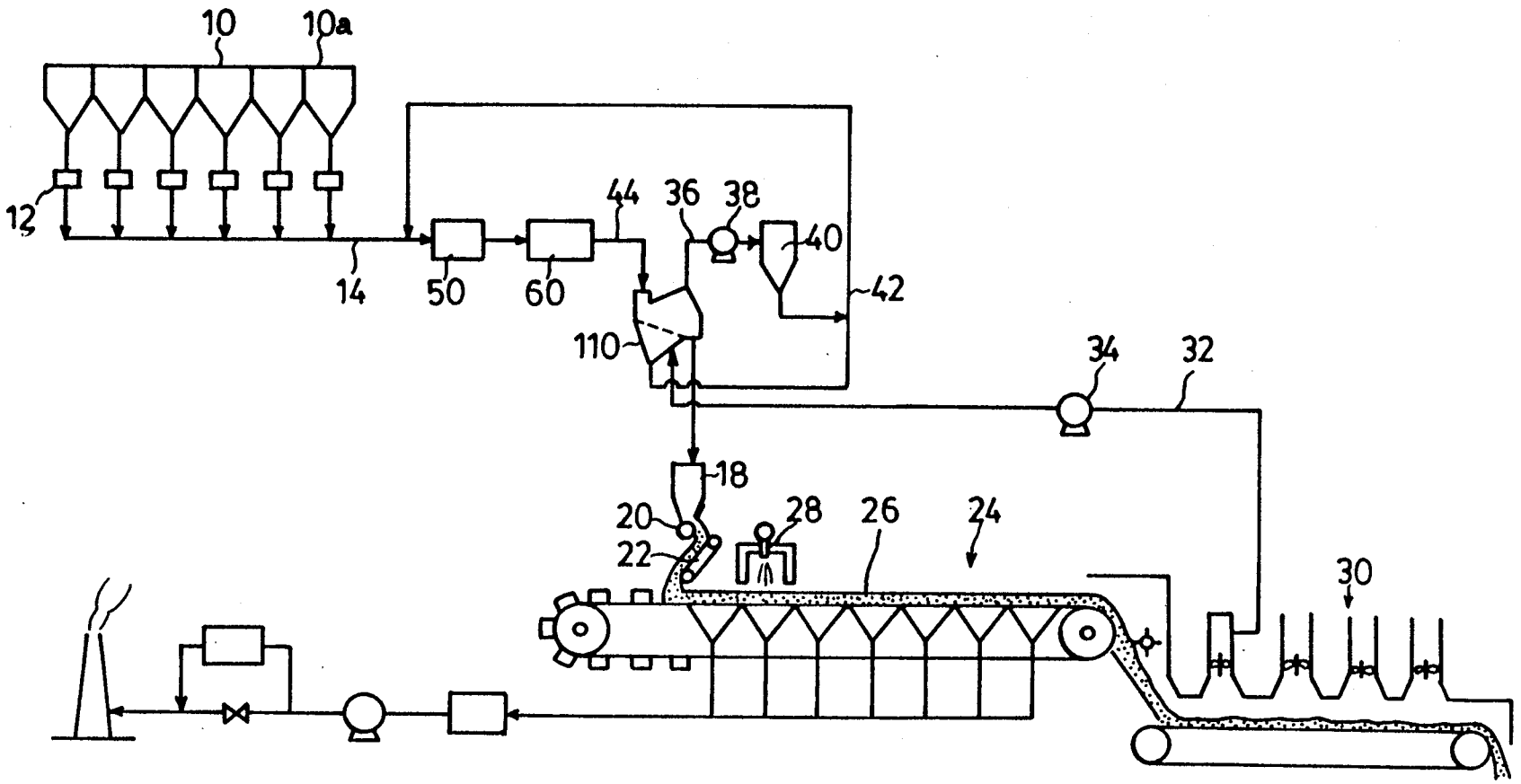
FIG. 53 is an entire flow diagram of the sintering process.

FIG. 53 illustrates an entire system of the sintering operation to which the process of the embodiment according to the present invention is applied. In this systm, the conveyer 14 for the raw feed is connected to the vibrating kneader of the first stage of the present invention in order to mix and knead the raw feed for sintering preparation with vibrating media. After the vibrating kneader the vibrating agglomerator 60 of the second stage is provided in order to agglomerate by tumbling the kneaded material. The agglomerated mini-pellets are dried in the third stage consisting of a vibrating conveyor 110. The dried agglomerated mini-pellets are transferred to a ore supply hopper 18 to be supplied to the sintering machine. The sintering machine sinters the mini-pellets into sintered ore.

Figure 54:
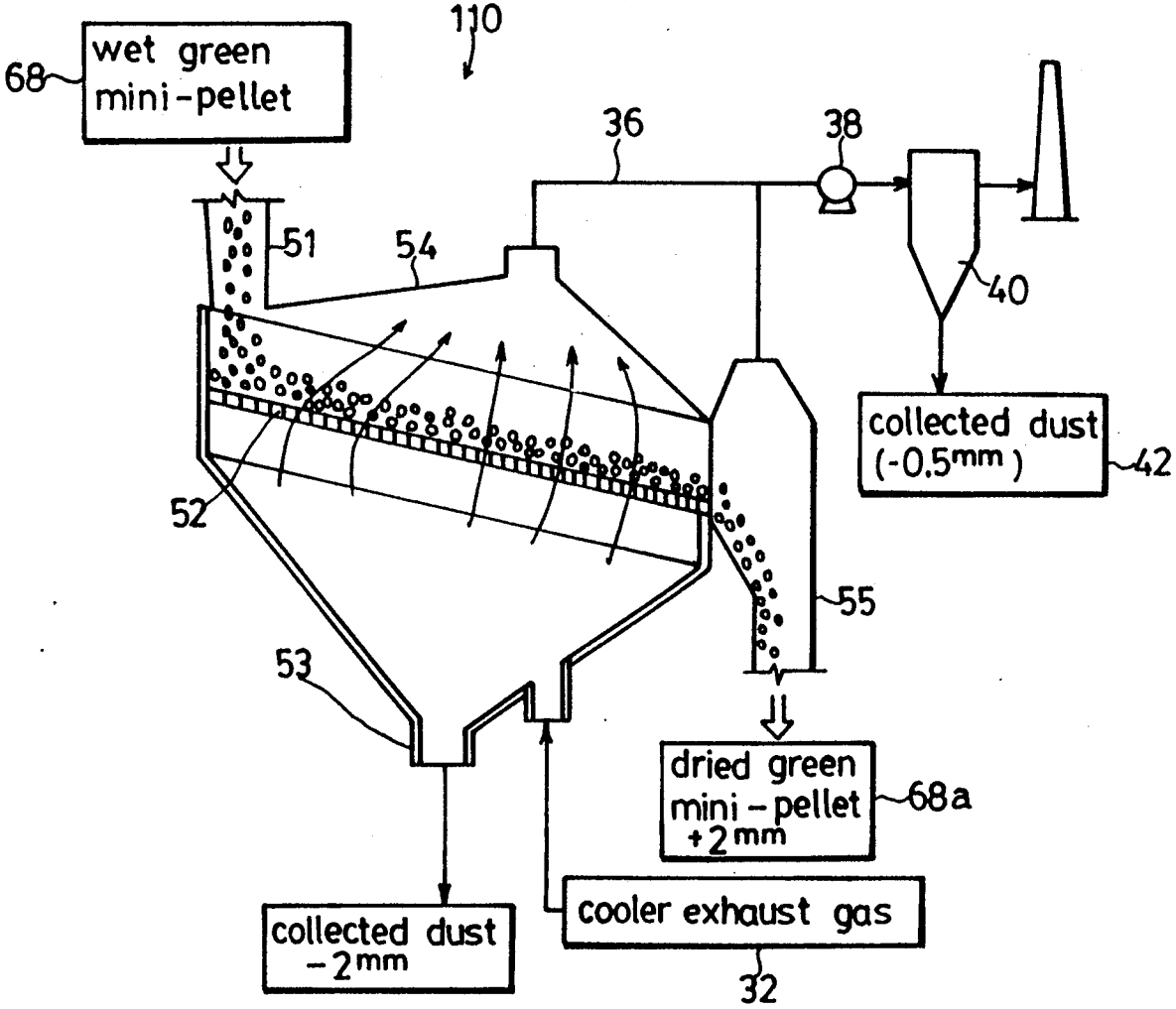
FIG. 54 is a side view of a vibration transfer bed of the embodiment.

The embodiment of the third stage of the present invention will be described. FIG. 54 shows a sectional view of the vibrating conveyor 110 enabling to suitably carry out the third stage of the embodiment.

As already explained with reference to a FIG. 2, the raw feed for sintering preparation is agglomerated to green mini-pellets of the uniform grain size of 2 to 5 mm through the vibrating kneader 50 and the vibrating agglomerator 60. FIG. 31 is a grain size distribution of the product of the mini-pellets produced in the agglomerating process above.

As shown in FIG. 53, FIG. 54, the agglomerated mini-pellet 68 is supplied to the vibrating conveyor 110. The exhaust gas 32 from the sintering cooler 30 is guided to the vibrating conveyor 110 by means of a blower 34 in order to dry the mini-pellets on the vibrating conveyor 110, in which drying process of heat exchange is done. Finally, the dried mini-pellets 68*a* are obtained and discharged as a product. The exhaust gas 36 is sent to a bag filter 40 through a fan 38 in order to separate dust 42 in the exhaust gas and the collected dust is returned to the raw feed.

Figure 55:
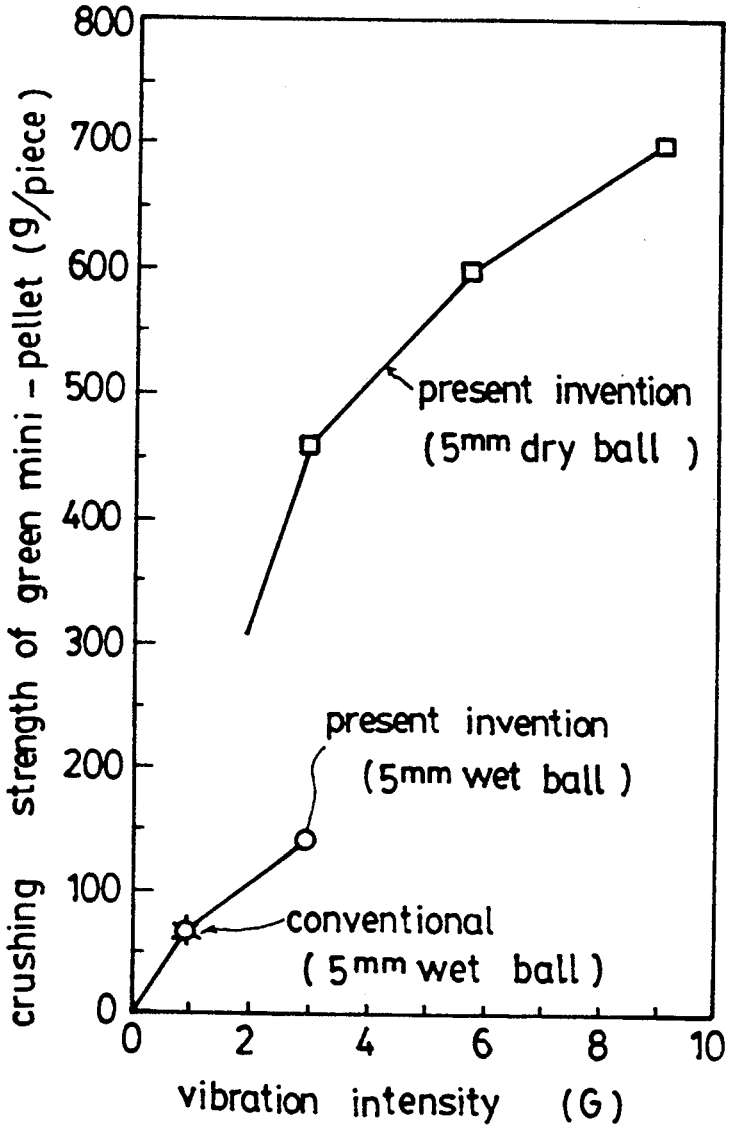
FIG. 55 shows a graph of a crushing strength of green mini-pelletes of the embodiment of the present invention, FIG. 56(*a*) and (*b*) are flowsheets of the embodiment.

FIG. 55 shows the crushing strength of the mini-pellets 68 and the dried mini-pellets 68*a* thus produced and other crushing strength for comparing use.

Comparing to the crushing strength of 70 g/piece of the conventionally agglomerated green balls (wet balls) of the comparison produced by a disc pelletizer, the crushing strength of the embodiment was 140 g/piece. The crushing strength of the green mini-pellets after being dired in the third stage of the present invention was from 460 up to 700 g/piece.

(9) An embodiment in which the first or the second stage is divided in a plurality of parallel routes In the agglomerating method of the present invention, it is possible also to control the grain size by adjusting the water adding amount in the previous mixing and kneading stage with vibration to give capillary state to the raw feed.

The interrelation of the operating factors effecting to the size of the mini-pellets agglomerated has been shown already in FIG. 28.

When the amount of water added in the mixing and kneading with vibrating media stage increases and vibration frequency or the vibrating intensity of the agglomerator increases, much water exudes out to the surface of the pellet from its core, increasing the size of the agglomerated mini-pellets.

When the ore amount to be supplied to the agglomerator decreases, the holding rate of the raw feed in the vibrating agglomerator decreases and the retention time of the feed in the agglomerator increases. It is possible to freely determine the size of the agglomerated mini-pellets according to the water content, vibrating frequency of the agglomerator, and feed amount of raw material.

In the vibrating agglomeration process of the embodiment of the present invention, water contained among the ore particles exudes out of the clustered grains and resultantly the added additives can be uniformly adhered immediately to the wet surfaces of the clusters. Resultantly, it is very easy to adhere the suitable amount of additives to the surface of the particles in accordance with the size of the grain so that it is possible to effectively utilize the function of the additives in the sintering process even though the amount of the additives to be inserted inside the particles is decreased or no additives is inserted, enconomizing the additives or subsidiary feed.

It is preferable to adjust the distribution of the additives existing in the upper layer, the middle layer, and the lower layer of the sintering bed of the DL sintering machine according to the kind of the additives. The upper layer means the portion of 150–160 mm thickness and about one-thirds in thickness of the whole sintering layer by segregation-charging of the sinter mix. According to the embodiment of the present invention, the agglomerating stage is divided into a plurality of parallel routes and they are converged into a single route and mixed into sinter mix. Thus, it is possible to produce the sinter mix having any grain size distribution, and to determine the kind and the amount of additives freely includes in various grain sizes respectively.

It is preferable to supply fine limonite or ore containing high $Al_2O_3$ of high meltability which is easily melted in the sintering process to any of the agglomerating routes.

In the sintering process, the upper layer of the sintering bed is cooled by the atomosphere which is sucked immediately after the ignition and burning of the upper layer. In the upper layer, the burning period is shorter and the cooling speed is faster than those of other layers of the sintering bed.

Accordingly it is preferable to blend fine powdery limonite of high meltability in the small grain size side of the agglomerating process. Then, the ratio of limonite of the upper layer is made larger than that of the other layer. It is reasonable because in the upper layer, a strong cooling phenomenon occurs during the sintering operation. It is preferable to locate small grain size having low melting point in the upper layer. And, using limonite only or an ore composed of a majority of limonite being sufficient to fill the upper layer in the sinter mix and agglomerating such raw feed in the route producing small grain size and charging the sinter mix by segregation-charge to the sintering layer, result in a placement of fine particles at the upper layer. It will contribute production of sintered ore of a good quality.

It is possible to use ore containing high $Al_2O_3$, one of high quality kinds of ores, and the sintering result is almost the same as above embodiment, resulting in a production of sintered ore having a good reductivity and reduction degradation characteristics.

Because the reductivity and reduction degradation characteristics are considered to be contrary to each other, it is difficult to produce sintered ore having both characteristics of good quality.

Secondary hematite in the sintered ore has a good reductivity, however the secondary hematite deteriorates the reduction degradation index (RDI). The reason for the phenomenon above is considered that $Al_2O_3$ is crystallized in the secondary hematite and the $Al_2O_3$ and the secondary hematite have different coefficients of expansion, causing a crack in the structure of the material at the place near the crystal of $Al_2O_3$ during the reduction.

In the sintering process, the sintering upper layer has a high cooling speed, so that the primary hematite itself remains and also the reduced primary hematite remains as magnetite without re-oxidezation. The lower layer is cooled by air of high temperature, so that much secondary hematite is produced, deteriorating the reduction degradation degradation characteristics. With reference to the reduction index (RDI), the value in the lower layer remains worse and larger than that in the upper layer by about 10%, the reason of high RDI resides in the presence of the secondary hematite containing $Al_2O_3$.

When the iron ore used as a raw feed has a small content of $Al_2O_3$, no trouble is happened as mentioned above. When it has much $Al_2O_3$, troublesome problems happen in the sintering process.

Consequently, in order to improve the RDI of sintered ore using high $Al_2O_3$ raw feed, the amount of the secondary hematite, in particular one containing $Al_2O_3$, in the sintered structure of the sintering lower layer is decreased, generating secondary hematite having little content of $Al_2O_3$ or calcium ferite. According to the process for making the mineral structure of the lower layer composed of the secondary hematite having little $Al_2O_3$ content or calcium ferrite, the raw feed for sintering preparation is divided into two groups of one having much $Al_2O_3$ content and another of less $Al_2O_3$ content. The former feed is supplied to the small size produtiion side of the kneading and agglomerating route in order to make the lower layer of less $Al_2O_3$ content and the latter feed is supplied to the large size production side of the kneading and agglomerating route. Both feeds of two groups respectively are agglomerated and mixed, or blended with other materials for sintering preparation. The raw feed is charged to the upper layer portion and the lower layer portion using segregation or separation of grain size happened during charging of feed at the sinter mix supply portion to the sintering machine.

It is necessary to add limestone and/or dolomite to low $Al_2O_3$ content raw feed for sintering preparation in oder to produce much calcium ferrite.

Figure 56:
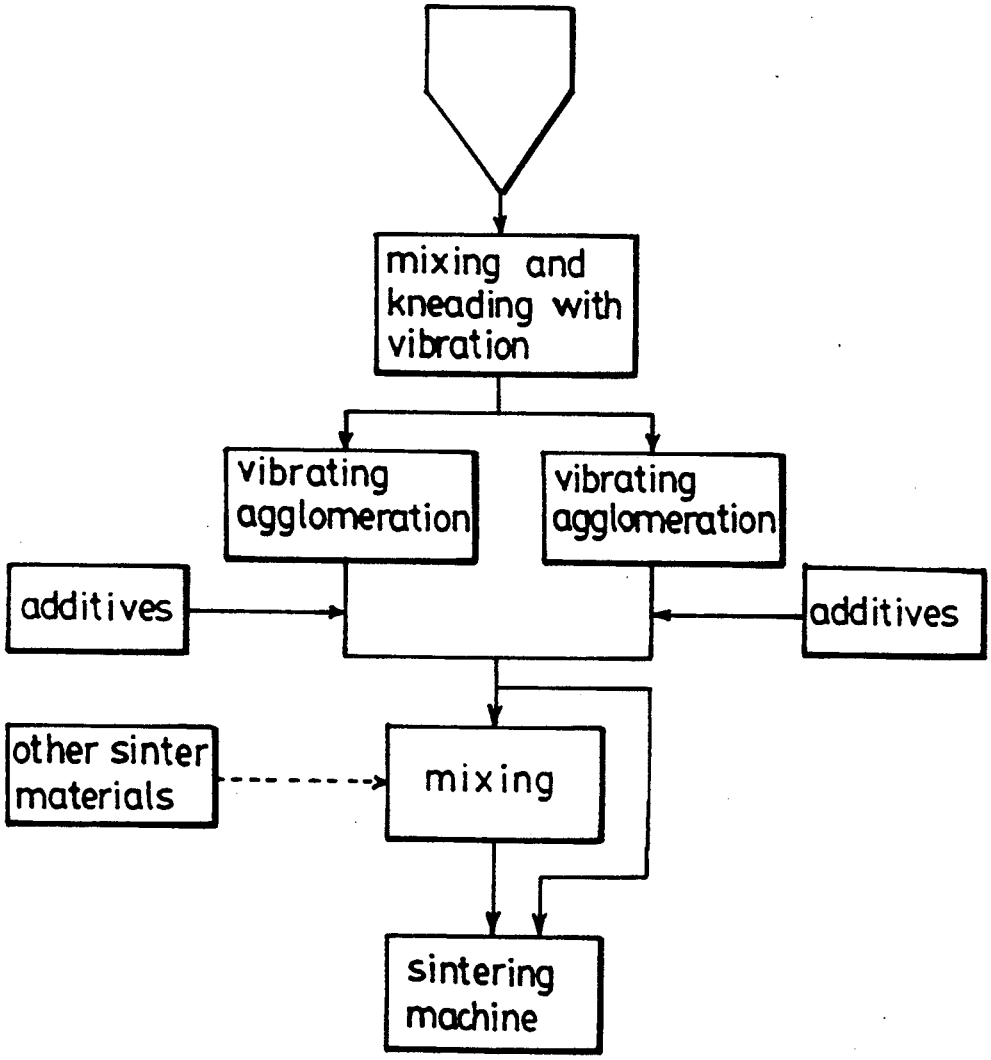
Figure 56:
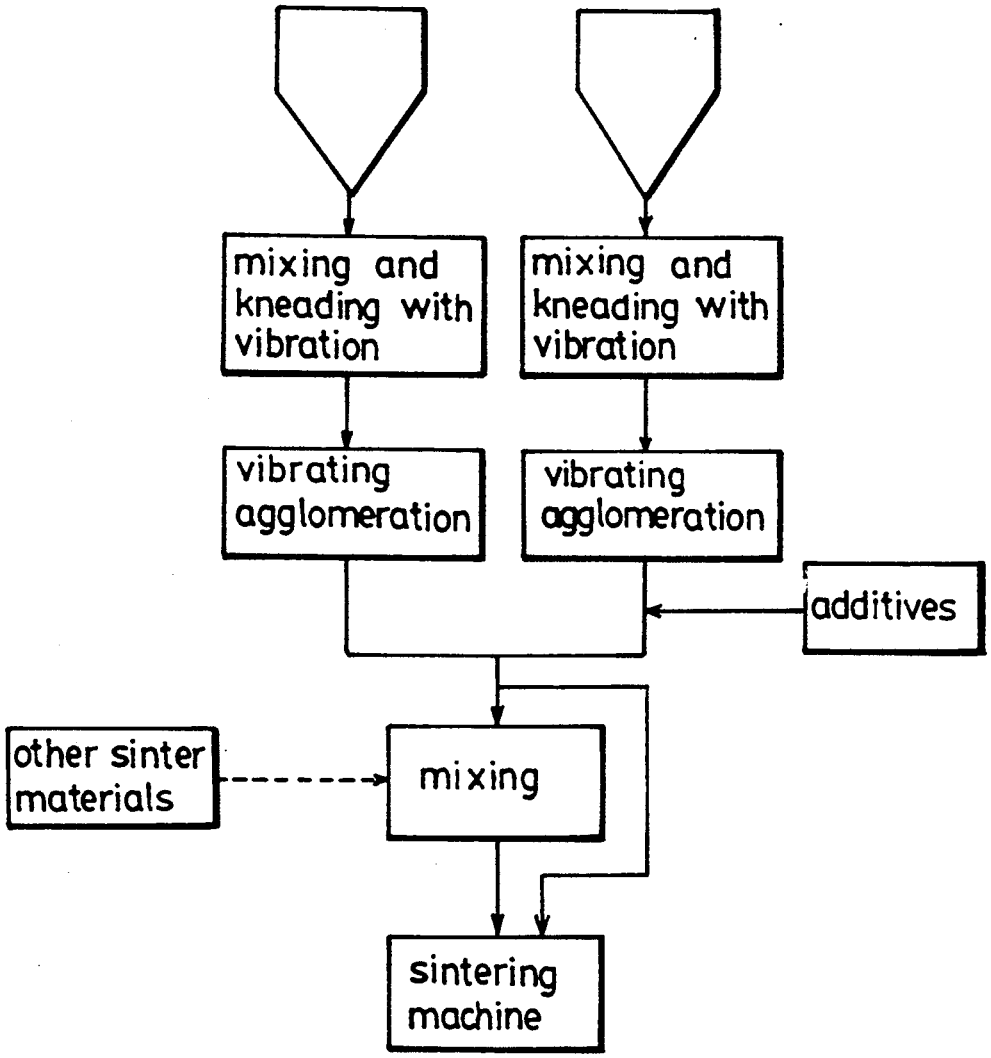

FIGS. 56(*a*) and 56(*b*) show each a flow chart of this embodiment. FIG. 56(*a*) shows an example having a common mixing and kneading with vibration stage and a plurality of parallel vibrating agglomeration routes. The third stage is arranged at the down stream of the vibrating agglomeration stage in order to add the additives on the surfaces of mini-pellets after the second stage.

As any predetermined grain size may be produced in the inventive agglomerating method, a plurality of agglomerating routes enable to produce various grain sizes which form the upper, middle or lower layers respectively in the sintering bed.

FIG. 56(*b*) shows an example in which the mixing and kneading process and the vibration agglomeration process are divided into a plurality of parallel routes. The third stage for adding additives at the down stream of the vibrating agglomeration stage is arranged in the example.

FIG. 56(*b*) shows that the additives are added to only one route of the parallel routes, however it is not limited to one route, it is possible to add the additives in respective routes.

In the vibrating agglomeration process of the embodiment, the respective agglomerating charges in a plurality of routes are separately kneaded, mixed, tumbled with vibration, and agglomerated. According to this particular different system, the sintering preparation of a different kind agglomerating charge, a different mixing and kneading and vibrating condition, a different production rate, and a different water adding amount is carried out, so that various sintering opeations can be achieved at the same time. The casual relation effecting to the grain size of the agglomeration of pellets, such as of supply feed rate, holding rate, retention time, vibrating intensity, water content and the like is identical to that of FIG. 56(*a*).

Figure 57:
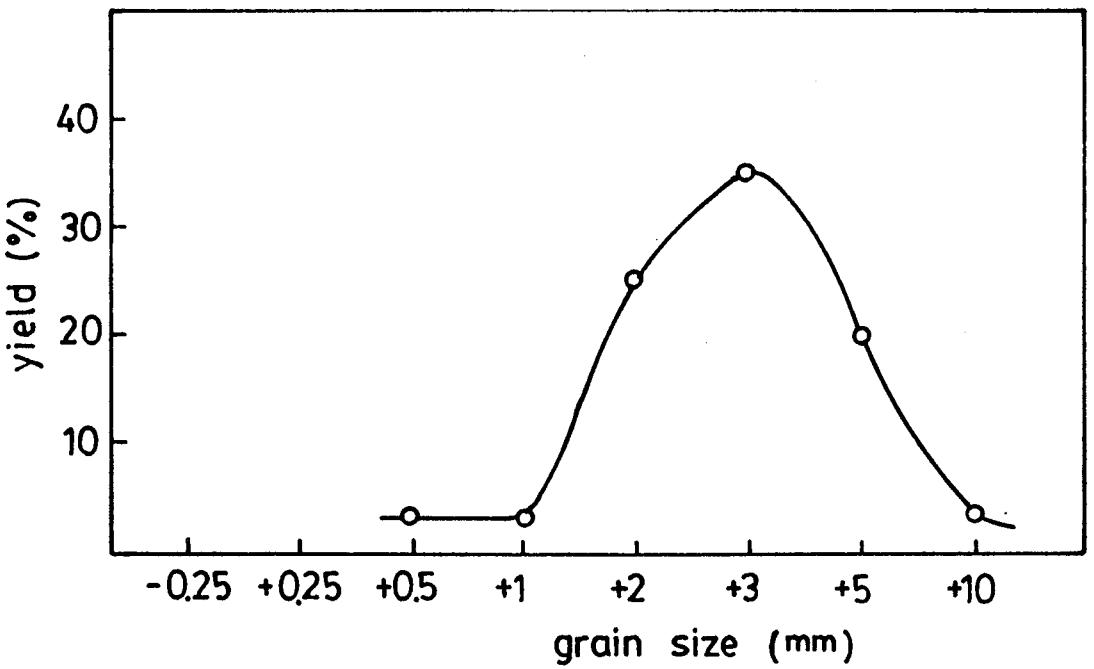
FIG. 57 is a graph showing an example of the grain size distribution of the pellets manufactured according to the embodiment.

As already described, FIG. 32 shows an example of the grain size distribution of product pellets produced when the mixing and kneading with vibration stage and the vibrating agglomeration stage are functioned under different operating conditions with the water content of 9.5 weight % and 10.5 weight %. FIG. 32 shows that the method of the embodiment of the present invention enables to produce green mini-pellets of uniform or constant grain size and the agglomerated mean size can be freely changed. Consequently, by blending the agglomerating charges of various grain sizes and various grain amounts in the agglomerating stage, an agglomerating charge having a predetermined grain size distribution can be obtained. For example, according to the two agglomerating methods of the present invention, pellets of the same volume are mixed so as to obtain the agglomeration having the grain size distribution of most suitable to the sintering process as shown in FIG. 57.

Figure 58:
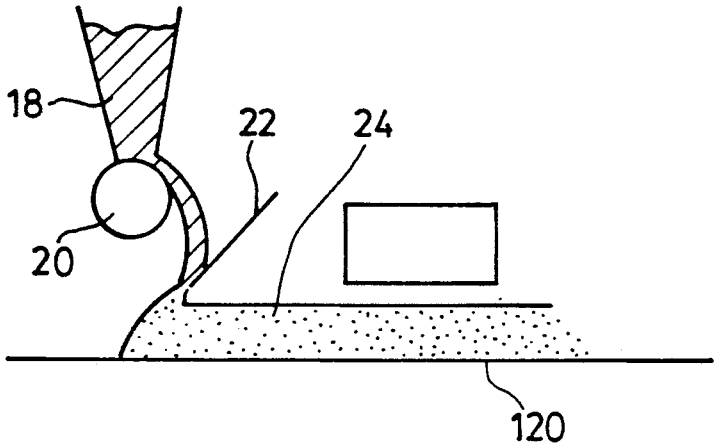
FIG. 58 is an explanatory view of sinter mix supply to the sintering machine.
Figure 59:
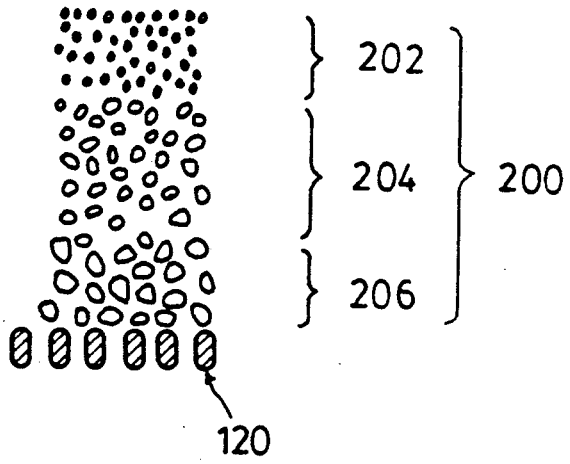
FIG. 59 is a sectional view taken along the height of the sinter layer on the pallets of the sintering machine.

FIG. 58 shows the situation in which the sinter mix is supplied to a sintering machine from a sinter mix feed hopper 18 througt a drum feeder 20 and a chute 22. The sinter mix is charged segregatedly to the chute 22, the sinter layer 24 segregated according to respective grains sizes is formed on the grate bars 120 as shown in FIG. 59. The sinter layer 200 consist of the upper layer 202 having small grain sized feed, the middle layer 204 having middle sized grains, and the lower layer 206 of large grains of the feed.

Figure 60:
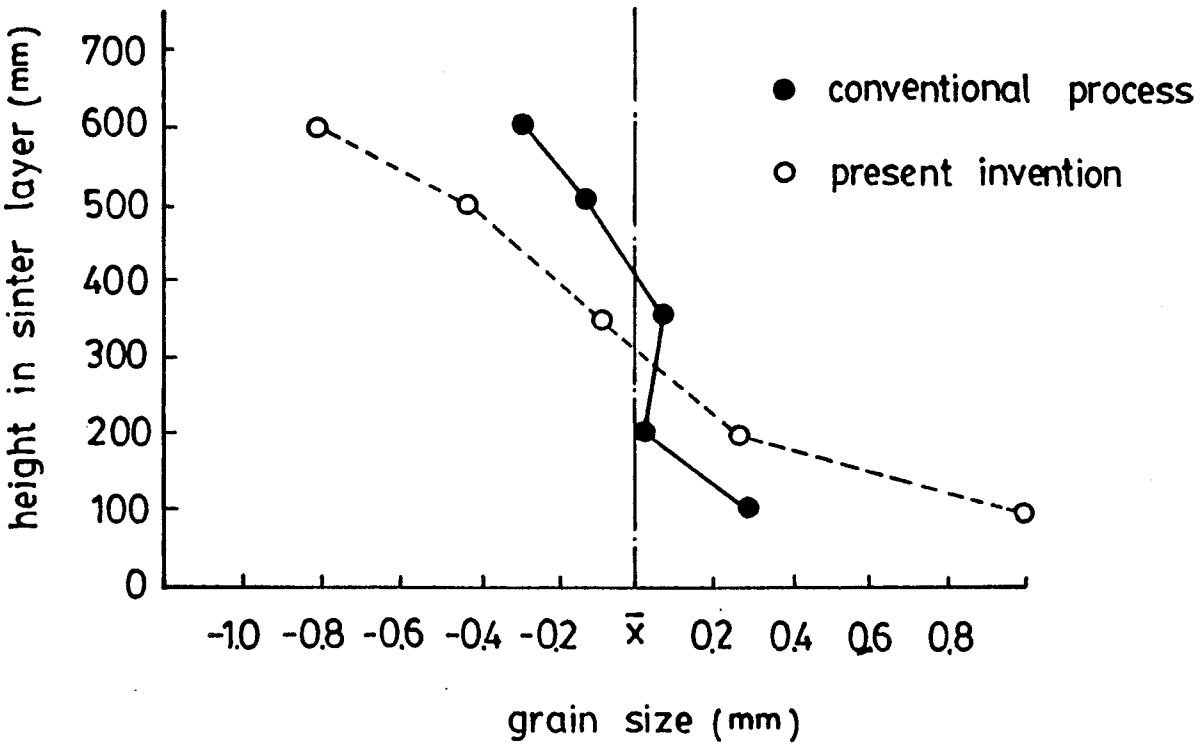
FIG. 60 is a graph showing the grain size distribution along the height of sinter mix on the sintering pallets.
Figure 61:
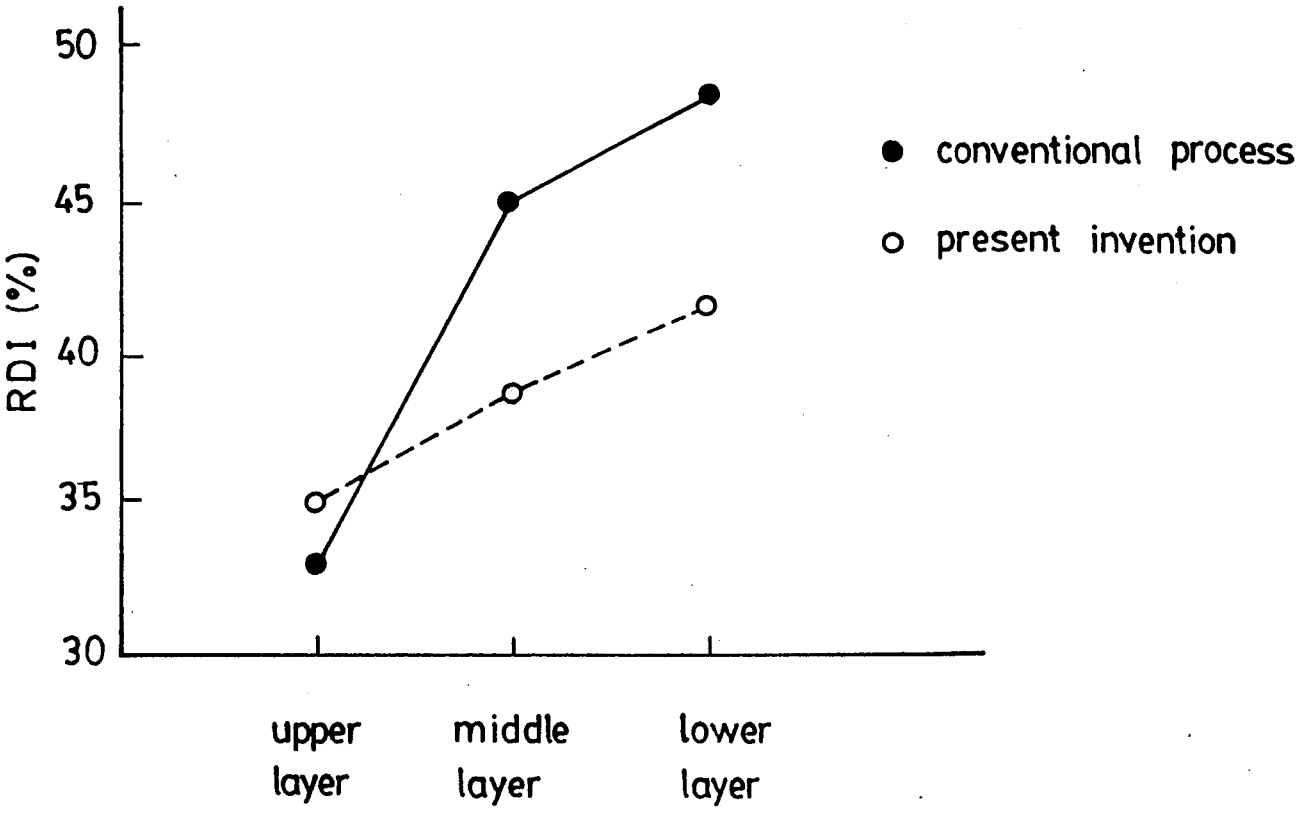
FIG. 61 is a graph showing the RDI in the layers upper, middle and bottom layers of the sinter mix deposited on the pellets of the sintering machine.

FIG. 60 shows the segregated state of the grain size of the sinter mix on the pallets of the sintering machine. As shown, the segreation of the sinter mix prepared by the present invention has a wider size distribution along the height in the sinter layer than that prepared by conventional process. As shown in FIG. 32, the grain size of the agglomerated inventive sinter mix has a sharp grain size distribution of has several mean sizes. Conventional sinter mix has flat in size distribution. Because that in the present invention the grain size of the feed on the pallet of the sintering machine has the wide range of selction of uniform mean grain sizes, the grain size segregation becomes large. FIG. 61 shows the RDI values of each layers when the sinter mix of this segregation is sintered. As apparent from FIG. 61, the RDI of the embodiment adjusted in the grain size has small in the absolute value and a narrow dispersion comparing to the RDI of the conventional process.

Figure 62:
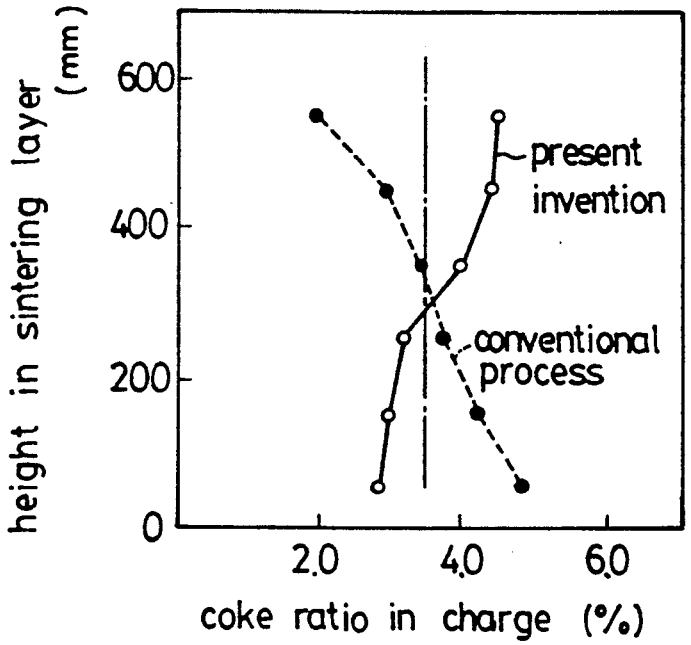
FIG. 62 is a graph showing the coke distribution along the height of the sinter mix on the pallets of the sintering machine.

FIG. 62 shows the dispersion of coke seen along the height of the sintering layer comparing to the dispersion of the conventional art. According to the embodiment of the present invention, it is possible to add additives to the sinter mix of any grain size. Much coke are compounded into the upper layer of the sintering layer on the pallet of the sintering machine, which contains small grain sized feed, and few coke is compounded into the lower layer having large-sized grains. In the agglomeration method of the conventional art in which coke is contained inside the pellets on the sintering machine, the tendency of the amount of coke is opposite to that shown in FIG. 62.

The silica-based raw feed in the additives is used to adjust $Al_2O_3$ or to secure sintering ore bondage. Much silica-based raw feed is added to the agglomerating system of a small grain size route to enter into the upper layer and less silica-based raw feed is added to a large grain size route.

Because that serpentine and dolomite have $SiO_2$-MgO, CaO-MgO, the suitable amounts are selected and used in accordance with the particular basicity of the sinter mix.

Figure 63:
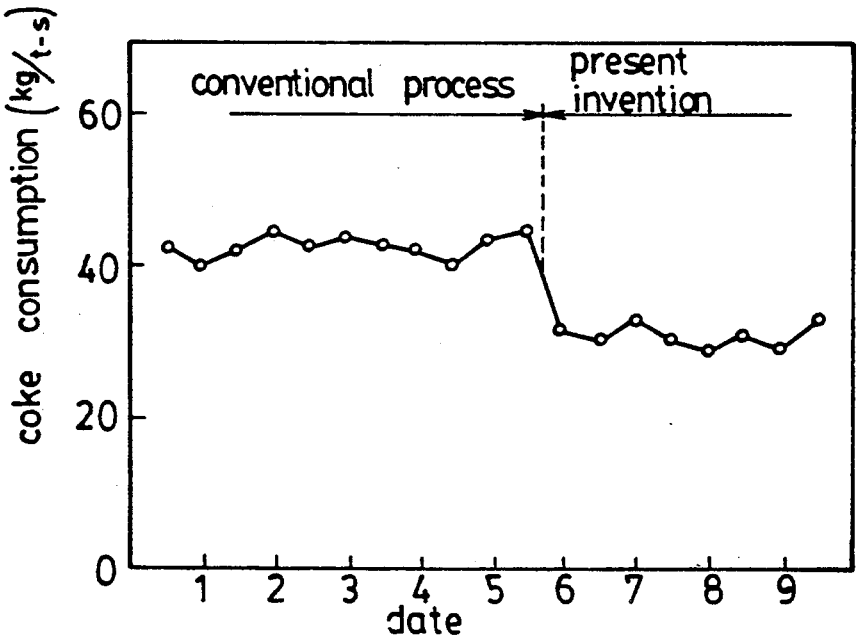
FIG. 63 is a chart showing the change of coke consumption, FIG. 64 to 76 each depicts a graph of the effect of the embodiment.

In the particular embodiment, coke is added on the surfaces of the pellets at the down stream of the agglomeration process and burns effectively in the upper layer on the pallets of the sintering machine. Because that, in addition to the merits above, the permeability of the sinter mix of the lower layer is kept in good condition and the pellets are strong, the coke consumption decreases. FIG. 63 shows the fact mentioned above and the coke consumption decreases comparing to the conventional art by about 20% in the example of the present invention.

As shown in Table 1, four series of the kneading and agglomerating routes are employed each route of which has the target grain size and the controlled coke compounding ratio with reference to each grain size.

Figure 64:
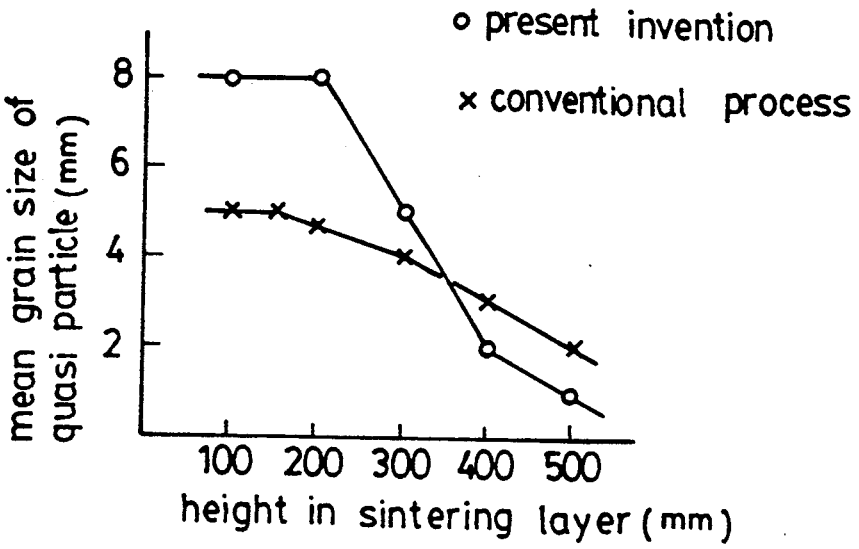
Figure 65:
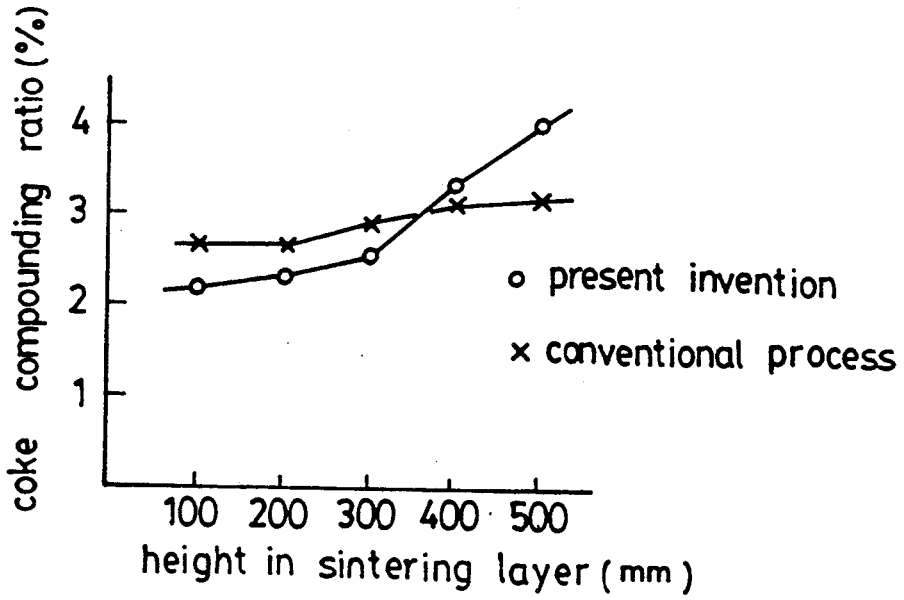

FIG. 64 shows the relation between the height in the sintering layer from the bottom and the mean grain size of the particle, and FIG. 65 shows the coke compounding ratio. In the drawings of FIGS. 64 and 65, a mark of a circle is for the present invention and a mark of a cross shows that of the conventional art.

Figure 66:
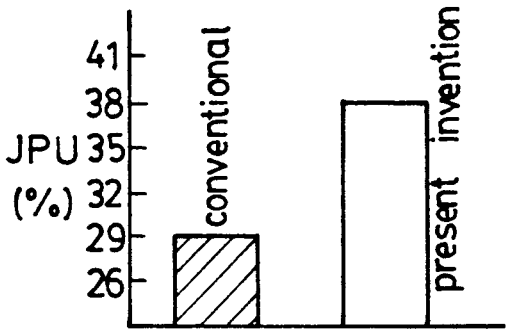
Figure 66:
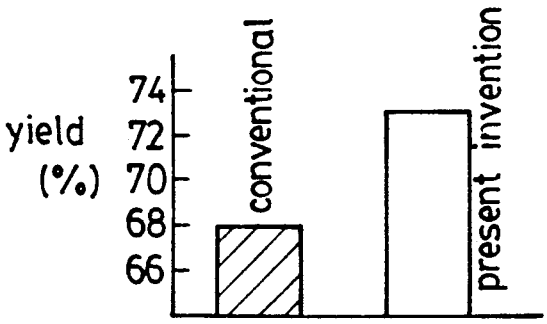

In the embodiment according to the present invention, the grain size distribution and the coke distribution of the sinter mix on the sintering bed are suitable. FIG. 66(*a*) shows permeability in JPU and FIG. 66(*b*) shows the yield of the sintering result of the process.

Table 2 shows various limestone compounding ratio of each routes of four kneading and agglomarating systems mentioned above.

Figure 67:
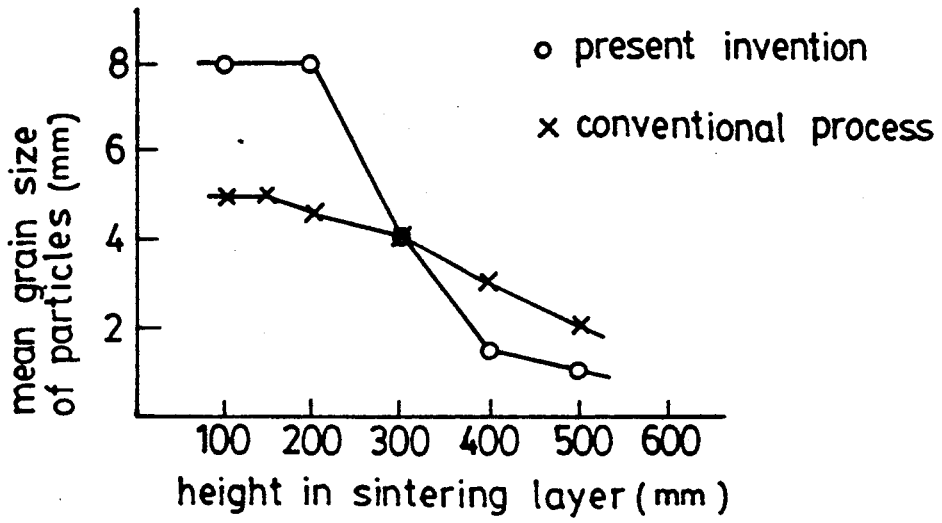
Figure 68:
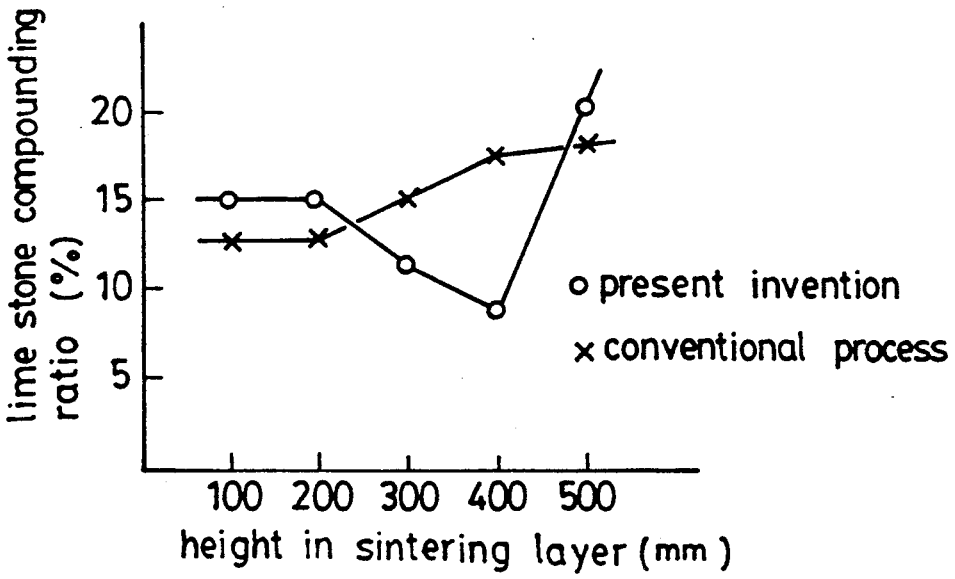
Figure 69:
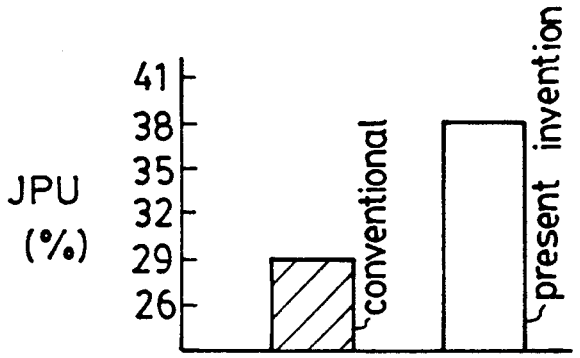
Figure 69:
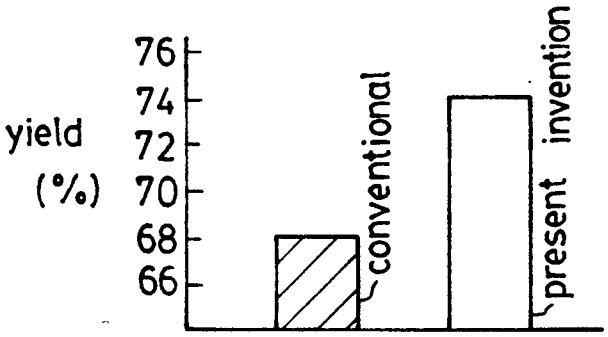
Figure 69:
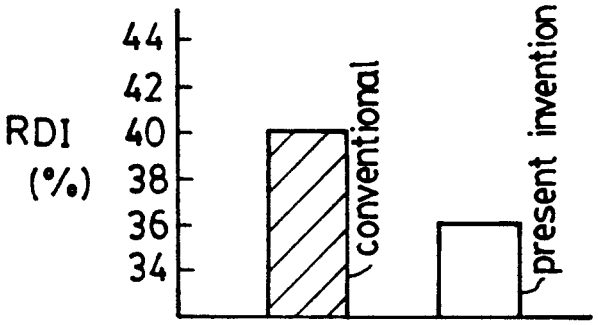

FIG. 67 is a graph showing the segregation of grain sizes and FIG. 68 is a result of the limestone compounding ratio for each layer. FIGS. 69(*a*), (*b*) and (*c*) show the sintering result and as shown JPU, the yield, and RDI are improved.

In the four kneading and agglomerating routes, cokes is added on the surface of the charge of which coke compounding ratios are changed for each grain size (see Table 3).

Figure 70:
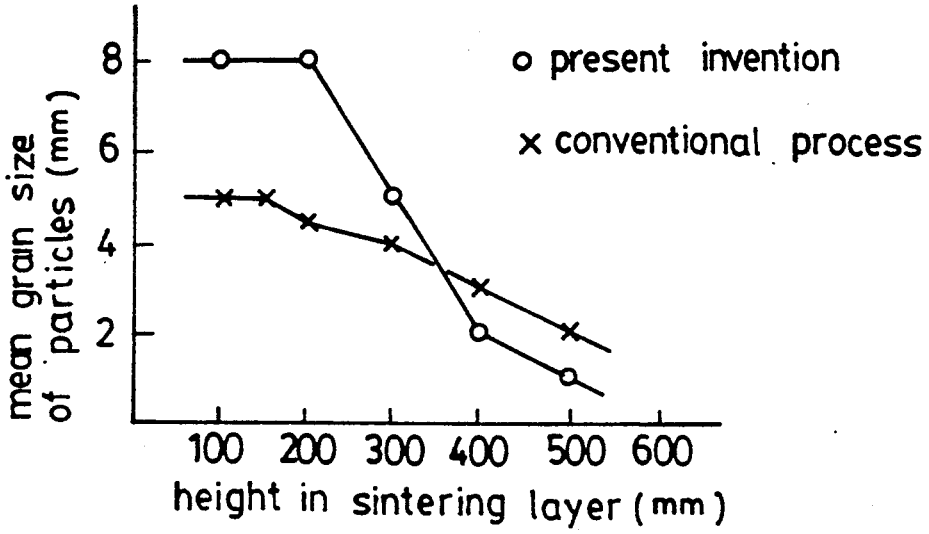
Figure 71:
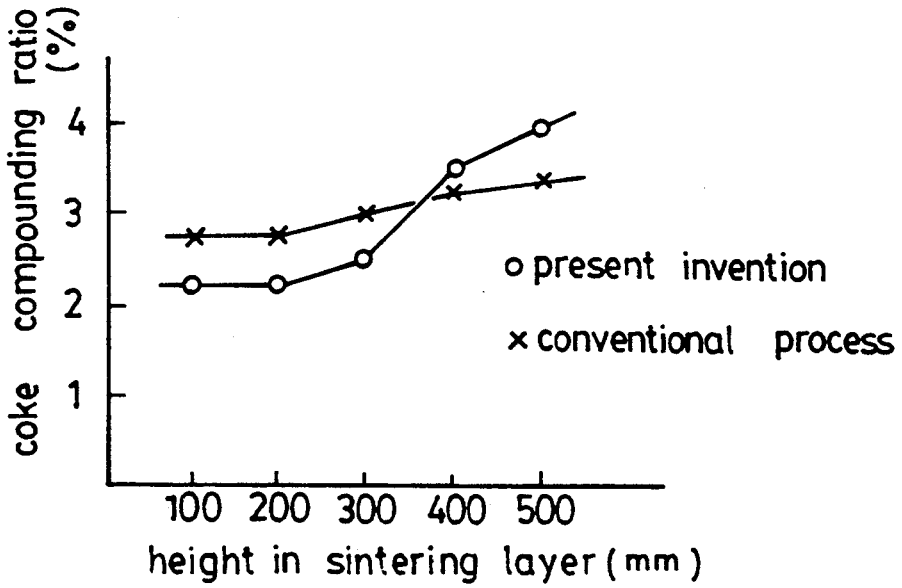
Figure 72:
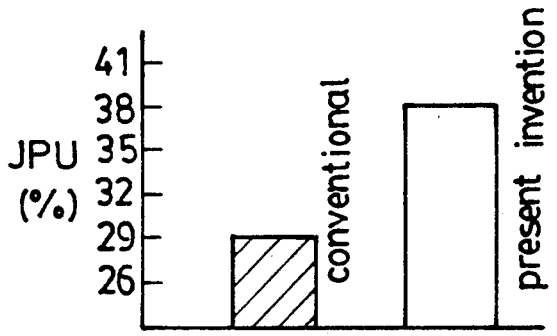
Figure 72:
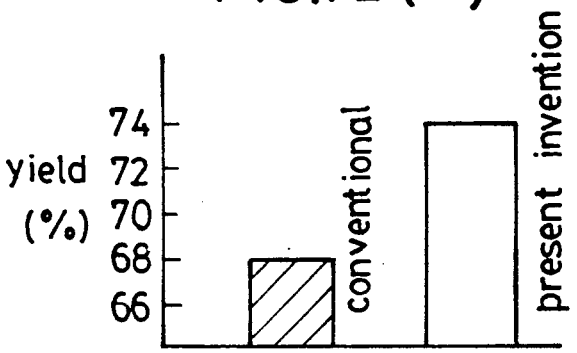
Figure 72:
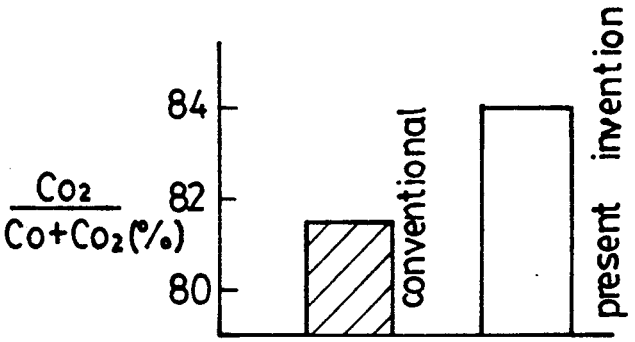
Figure 73:
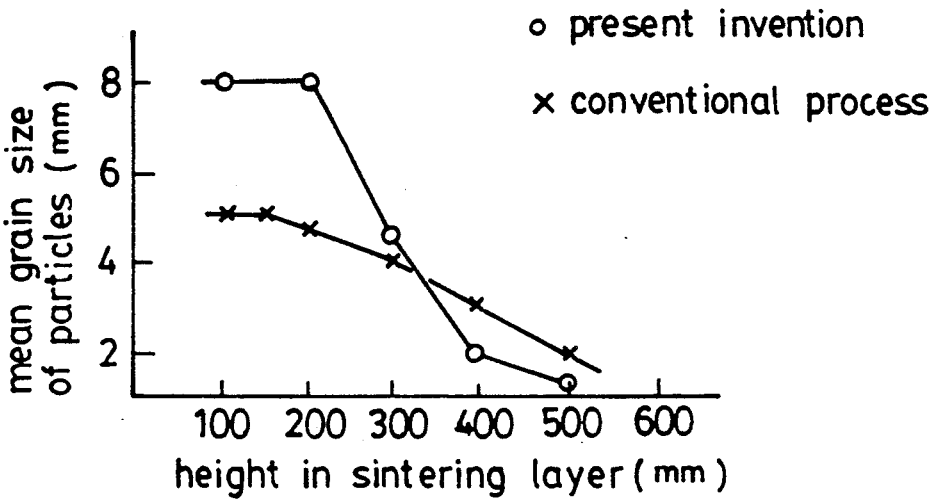
Figure 74:
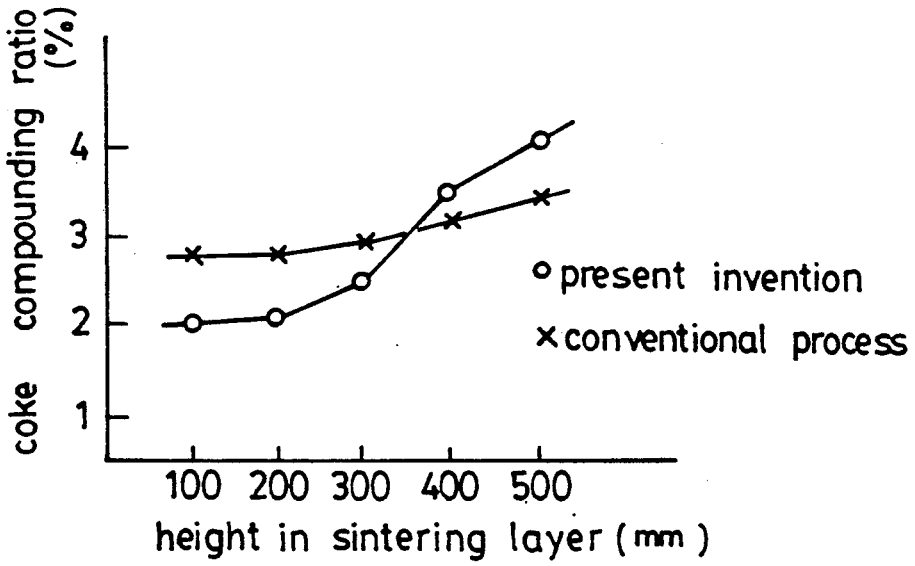
Figure 75:
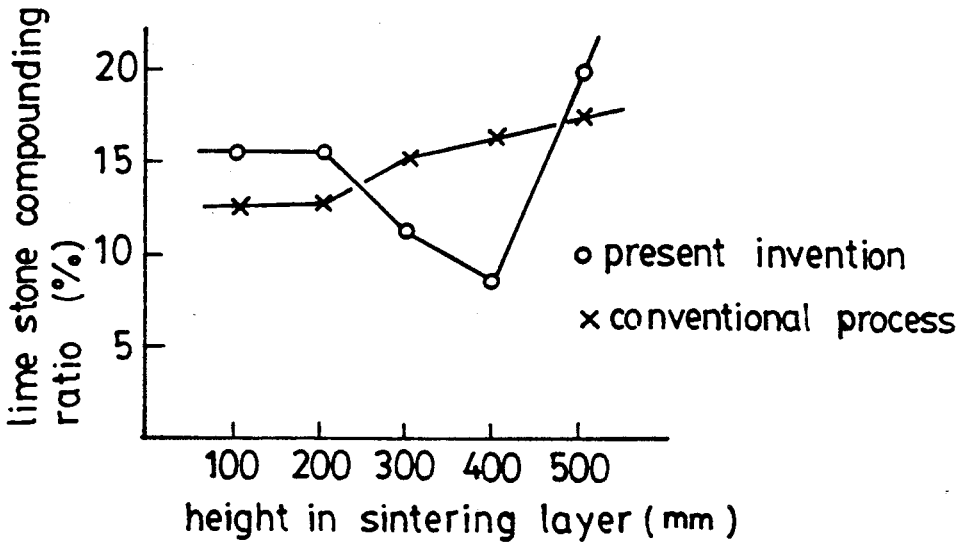
Figure 76:
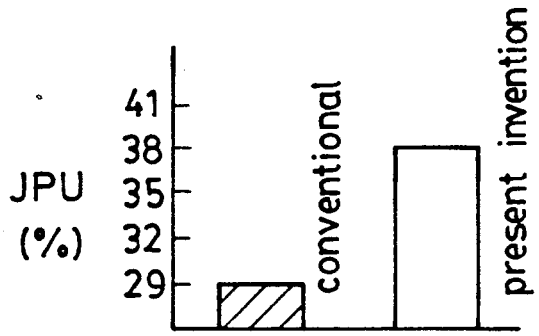
Figure 76:
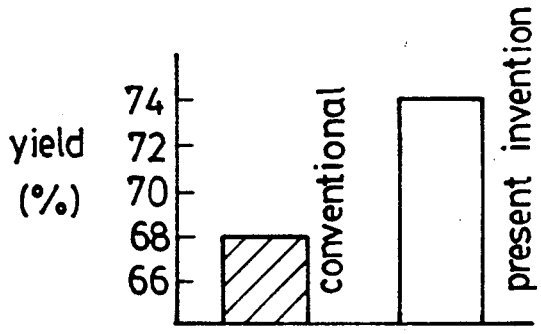
Figure 76:
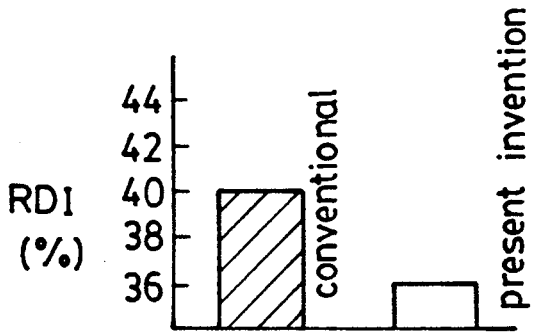

FIG. 70 and FIG. 71, respectively show the grain size distribution and the coke compounding ratio. FIGS. 72(*a*), (*b*) and (*c*) depict JPU, the yield, and $CO_2$ rate % in the exhaust gas.

FIGS. 73, 74, 75, 76(*a*), (*b*) and (*c*) and Table 4, respectively show the cases in which the limestone compounding ratios are controlled for each grain size, and coke and limestone are adhered to the surfaces of particles of the sinter mix. Each case of the embodiments according to the present invention shown in these drawings and the tables depicts that the present invention has an excellent performance than that of the conventional art.

TABLE 1

| | Target grain size (mm) | Coke compounding ratio (%) | Raw feed rate (%) |
|---|---|---|---|
| first route | 8 | 2.5 | 25 |
| second route | 8 | 2.5 | 25 |
| third route | 5 | 3.0 | 25 |
| fourth route | 1 | 4.0 | 25 |

TABLE 2

| | Target grain size (mm) | Limestone compounding ratio (%) | Raw feed rate (%) |
|---|---|---|---|
| first route | 8 | 16 | 25 |
| second route | 8 | 16 | 25 |
| third route | 5 | 8 | 25 |
| fourth route | 1 | 20 | 25 |

TABLE 3

| | Target grain size (mm) | Coke compounding ratio (%) | Raw feed rate (%) |
|---|---|---|---|
| first route | 8 | 2.5 | 25 |
| second route | 8 | 2.5 | 25 |
| third route | 5 | 3 | 25 |
| fourth route | 1 | 4 | 25 |

TABLE 4

| | Target grain size (mm) | Coke compounding ratio (%) | Limestone compounding ratio (%) | Raw feed rate (%) |
|---|---|---|---|---|
| first route | 8 | 2.5 | 16 | 25 |
| second route | 8 | 2.5 | 16 | 25 |
| third route | 5 | 3.0 | 8 | 25 |
| fourth route | 1 | 4.0 | 20 | 25 |

(10) An embodiment in which mini-pellets are covered with additives

When a tumbling process for adhering the additives or material is carried on at the next stage of the agglomerating stage according to the present invention, the desired additives are adhered on the outer surfaces of the green mini-pellets uniformly and quickly by means of the adhereness of water as described above.

According to the agglomerating stage above, it is possible to product strong green mini-pellets of a constant grain size of 2 to 5 mm, which give a good permeability to the sintering layer in the sintering and the desired coke consumption decreases. In addition, the inventors of the present invention have found that, because that the sinter mix has a suitable grain size distribution and good adhereness, a desired amount of additives can be adhered, without any uneven sintering function owing to imperfect covering of the additives. It is possible also to adhere the additives to the mini-pellets in the third stage at the place in the agglomerating stage near the discharge port of the vibration agglomerator.

Figure 77:
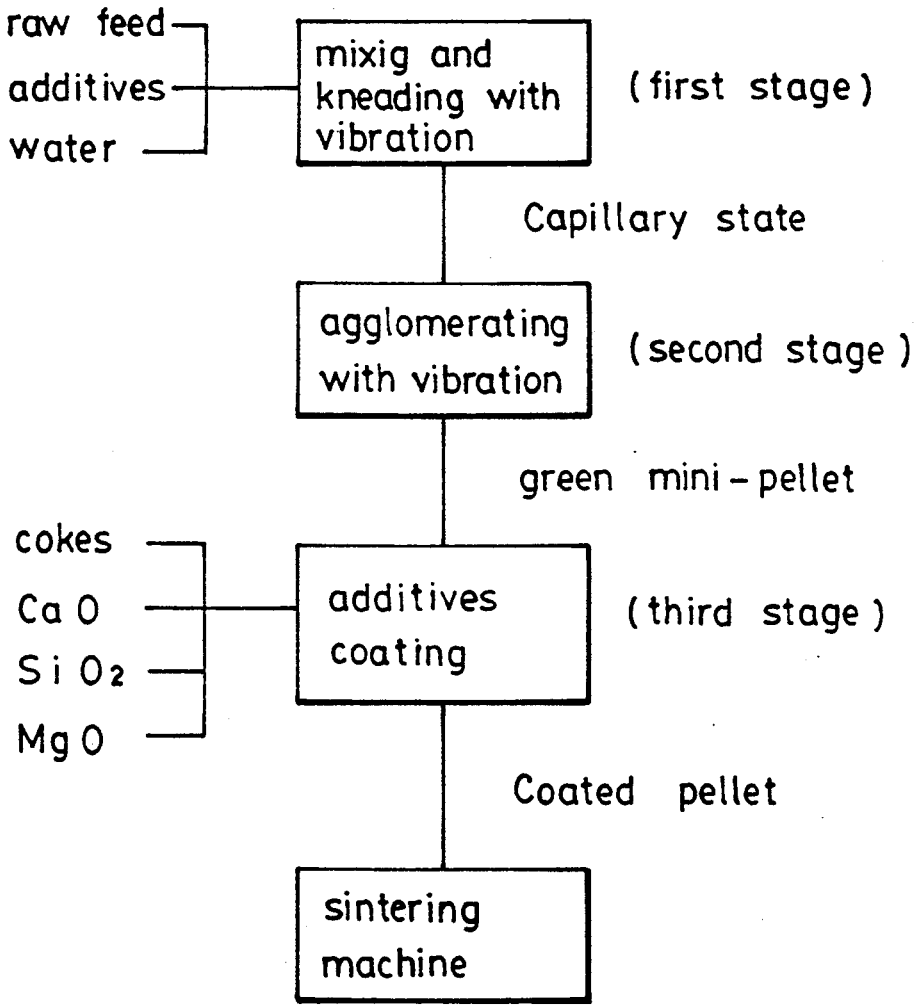
FIG. 77 is a flow-chart of the embodiment of the present invention.

FIG. 77 shows a flow chart of the embodiment of the present invention. In the first and the second stages of the present invention, it is possible to produce green mini-pellets of the constant grain size of 2 to 5 mm. During the stages, the vibration makes water exude uniformly on the surfaces of mini-pellets and the water is used effectively to agglomerate the kneaded material, so that the third stage for covering with additives is placed just after the agglomerating stage of the present invention.

The covering additives on the surfaces of the mini-pellets are coke, CaO, $SiO_2$, MgO. The desired amounts of these additives are determined by determining the difference between the total amounts and the original amounts contained in the raw feed. Because that the covering of the additives can be uniformly adhered to the outer surfaces of these mini-pellets, the burning characteristic and reaction activities are so intense that less amounts of additives are enough comparing to the conventional case in which the additives are contained inside the pellets cluster.

The mechanism will be explained in more detail. In case that the coke is blended with other raw feed and agglomerating process is carried out, the resultant green mini-pellets have uniform composition, so that desired amount to be contained inside the particle is relatively large. In the sintering reaction, the coke placed outside of the particles in the sinter mix starts to burn at first, so that little oxygen is supplied into the inner part of the particles deteriorating the burning activity of the coke. As a result, when the amount of coke contained inside the particles is large, it is necessary to increase the whole content of the coke. When the amount of coke contained inside is small and the amount outside of the particle is large, it is possible to permit less content of total coke.

With reference to the additives, materials such as CaO, $SiO_2$, and etc. to form slag function as a bond material to agglomerate the sintered ore after melting. When the slag enters into the mini-pellets, the sintered strength of ore is low and the yield is low because the amount of the slag for bonding mini-pellets to each other is small.

On the contrary, when the additives is on the surfaces of the particles in the sinter mix, the amount of bonding slag exits much on the surface and the sintered strength is improved.

What is claimed is:

1. An agglomerating process of sinter mix to be supplied to a Dwight-Lloyd continuous sintering machine comprising two stages, in which the first stage comprises the steps of:
   - containing a number of media for mixing and kneading raw feed in a vessel,
   - applying vibration of circular motion having intensity in the range of 3 G to 10 G to the media for revolving the media,
   - supplying raw feed into the vessel with water for complying with a predetermined water content, and
   - producing kneaded material in capillary state, and
   - the sequential second stage comprises the steps of:
   - applying vibration for agglomerating said kneaded material by tumbling having intensity of not less than 3 G, and
   - producing strong green mini-pellets.

2. The agglomerating process according to claim 1, wherein only fine powdery iron ore having more than 60 wt % fraction of grain size less than 63 μm is fed as raw feed whereby producing strong green mini-pellets.

3. The agglomerating process according to claim 1, wherein the first stage further comprises the step of:
   - adjusting water adding amount so as to let the power consumption of the kneading at maximum under given vibration frequency.

4. The agglomerating process according to claim 1, provided with a plurality of parallel routes for mixing and kneading in the first stage as well as for agglomerating in the second stage corresponding to respective routes in the first stage, comprising the steps of:
   - adjusting vibrating intensities of the respective routes to obtain predetermined grain size of the mini-pellets respectively, and
   - mixing obtained products from the parallel routes so as to prepare sinter mix having a predetermined size distribution.

5. The agglomerating process according to claim 1 provided with a plurality of parallel routes for mixing and kneading in the first stage as well as for agglomerating in the second stage corresponding to respective routes in the first stage, in order to produce different grain size agglomerates in the respective routes, further comprising the steps of:
   - feeding an ore containing high $Al_2O_3$ to a route where small grain size agglomerate is producing,
   - adjusting vibrating intensities of the respective routes to obtain predetermined grain sizes of the mini-pellets respectively, and
   - mixing obtained products from the parallel routes for preparing sinter mix having a predetermined size distribution.

6. The agglomerating process according to claim 1 providing a plurality of parallel routes for mixing and kneading in the first stage, for agglomerating in the second stage corresponding to respective routes in the first stage, in order to produce different grain sizes agglomerates in the respective routes, further comprising the steps of:
   - feeding an ore containing high $Al_2O_3$ together with a limestone and/or a dolomite to a route where small size raw feed is agglomerating,
   - adjusting vibrating intensities of the respective routes to obtain predetermined grain size of the mini-pellets respectively, and
   - mixing obtained products from the parallel routes for preparing sinter mix having a predetermined size distribution.

7. The agglomerating process according to claim 1, wherein the first stage further comprises the step of:
   - providing a plurality of parallel routes for mixing and kneading in the first stage; and,
   - the second stage further comprises the steps of:
   - providing previously a plurality of parallel routes for agglomerating in the second stage corresponding to respective routes in the first stage,
   - feeding a high alkali ore to a route where small size grain is agglomerating,
   - adjusting vibrating intensities of the respective routes to obtain predetermined grain sizes of the mini-pellets respectively, and
   - mixing obtained products from the parallel routes for preparing sinter mix having a predetermined size distribution.

8. The agglomerating process according to claim 1, wherein, in the second stage, said kneaded material is agglomerated in an agglomerator having one or more cylindrical drums or troughs for agglomeration.

9. The agglomerating process according to claim 1, wherein, in the second stage, said kneaded material is agglomerated in an agglomerator which applies horizontally oscillating vibration.

10. The agglomerating process according to claim 1, wherein the second stage further comprises the steps of:

supplying said kneaded material into an agglomerator having a cylindrical drum or troughs, and adjusting a supply amount of said kneaded material and/or a slant angle of the agglomerator and/or a vibrating intensity in order to keep a holding ratio of the material contained in the drum or the troughs in a proper range while applying vibration.

11. The agglomerating process according to claim 1, wherein the second stage further comprises the steps of:

measuring an over-size rate of size over 10 mm of the discharging mini-pellets, calculating a deviation between the measured over-size rate and a set value, and adjusting the vibrating intensity in the second stage and adding water in the first stage based upon the deviation.

12. The agglomerating process according to claim 11, wherein the second stage further comprises the step of:

controlling size of the green mini-pellets, during applying vibration, by adjusting a holding rate and/or vibrating intensity according to the kind of the raw feed, supplying amount and water content of the kneaded material.

13. The agglomerating process according to claim 11, wherein the second stage comprises the steps of:

providing previously a plurality of parallel routes for agglomerating in the second stage, adjusting vibrating intensities of the respective routes to obtain predetermined grain sizes of the mini-pellets respectively, and mixing obtained products from the parallel routes for preparing sinter mix having a predetermined size distribution.

14. The agglomerating process according to claim 11, wherein the second stage comprises the steps of:

providing previously a plurality of parallel routes for agglomerating in the second stage, adjusting of supply amount of the kneaded material and kinds of additives, adding respective rates of additives which are supplied to the routes respectively, adjusting vibrating intensities of the respective routes to obtain predetermined grain sizes of the mini-pellets respectively, and mixing obtained products from the respective routes for preparing sinter mix having a predetermined size distribution.

15. The agglomerating process according to claim 11, wherein the second stage comprises the steps of:

providing previously a plurality of parallel routes for agglomerating in the second stage, in order to produce different grain size agglomerates in the respective routes, adjusting vibrating intensities of the respective routes to obtain predetermined grain sizes of the mini-pellets respectively, feeding a limonite having a good meltability effective in the sintering process to a route where small rain size agglomerate is producing, and mixing obtained products from the parallel routes for preparing sinter mix having a predetermined size distribution.

16. An agglomerating process of sinter mix to be supplied to a Dwight-Lloyd continuous sintering machine comprising two stages, in which the first stage comprises the steps of:

containing a number of media for mixing and kneading raw feed in a vessel, applying vibration of circular motion having intensity in the range of 3 G to 10 G to the media for revolving the media, supplying raw feed into the vessel with adding water for complying with predetermined water content, and producing kneaded material in capillary stage, and the sequential second stage comprises the steps of:

applying vibration for agglomerating said kneaded material by tumbling having intensity of not less than 3 G, and providing strong green mini-pellets, and the third stage comprises the steps of:

mixing the green mini-pellets with other raw feed for sintering in a mixing ratio, re-agglomerating the mixed material, supplying the re-agglomerated material onto a continuous sintering bed, measuring permeability of the bed, calculating a deviation between the measured permeability and a preset valve, and adjusting the mixing ratio and/or size of the mini-pellets so that the deviation becomes null.

17. The agglomerating process according to claim 16, wherein a preliminary stage before the first stage is provided which comprises the step of:

adding a fine powder ore of the grain size less than 63 μm to a raw feed which is difficult to agglomerate, so as to include more than 20 weight % of the grain less than 63 μm in the added material, for the raw feed in the first stage.

18. The agglomerating process according to claim 16, wherein a third stage after the second stage is provided which comprises the step of drying the agglomerated green mini-pellets.

19. The agglomerating process according to claim 16, further comprising a third stage for adhering additives to the agglomerated mini-pellets after the second stage.

20. An agglomerating process of sinter mix to be supplied to a Dwight-Lloyd continuous sintering machine comprising two stages, in which the first stage comprises the steps of:

containing a number of media for mixing and kneading raw feed in a vessel, applying vibration of circular motion to the media for revolving the media, supplying raw feed into the vessel with water for complying with a predetermined water content, and producing kneaded material in capillary state; and the sequential second stage comprises the steps of:

applying vibration for agglomerating said kneaded material by tumbling, and producing strong green mini-pellets, wherein the second stage further comprises the steps of:

measuring an over-size rate of size over 10 mm of the discharging mini-pellets, calculating a deviation between the measured oversize rate and a set value, and adjusting the vibrating intensity in the second stage and adding water in the first stage based upon the deviation.

21. An agglomerating apparatus comprising a vibrating kneader provided with a vibrator for revolving a number of media of circular-sectional rods contained in a vessel for mixing and kneading of raw feed for sinter mix, and a vibrating agglomerator provided with a vibrator for applying circular vibrating motion or horizontal oscillation vibration to the material charged from said vibrating kneader for tumbling and agglomerating the charge, one or a plurality of agglomerating troughs with a circular or an arched section with a downward slant from feed inlet to output outlet and a means for varying the slant angle of the troughs, wherein said vibrating kneader and the vibrating agglomerator are arranged in series.

22. The agglomerating apparatus according to claim 21, wherein the agglomerating troughs are arranged in parallel in a single or multiple rows.

23. The agglomerating apparatus according to claim 21, wherein the vibrating agglomerator has a pivot shaft at the lower part of the charge supply side and a slide-groove crank type oscillating drive device at the lower part of the discharge side in order to apply a horizontal oscillation vibration to the agglomerator.

24. The agglomerating apparatus according to claim 23, wherein the slide-groove crank type oscillating drive device is changeable in location along the direction of the axis of the agglomerator.

25. The agglomerating apparatus according to claim 23, wherein the length of the crank arm of said slide-groove crank type oscillating drive machine is changeable.

26. An agglomerating apparatus comprising:

a vibrating kneader provided with a vibrator for revolving a number of media of circular-sectional rods contained in a vessel for mixing and kneading of raw feed for sinter mix, and a vibrating agglomerator provided with a vibrator for applying circular vibrating motion or horizontal oscillation vibration to the material charged from said vibrating kneader for tumbling and agglomerating the charge, wherein said vibrating kneader and the vibrating agglomerator are arranged in series, wherein the vibrating agglomerator has a single or a plurality of agglomerating troughs each having a section of a circle or an arc and having a slant angle along the direction from the charging side to the discharging side of the agglomerating trough and has means for changing the slant angle of said troughs.

* * * * *